United States Patent [19]

Osawa et al.

[11] Patent Number: 4,857,958

[45] Date of Patent: Aug. 15, 1989

[54] ELECTRONIC COPYING APPARATUS HAVING FUNCTION OF PARTIALLY CHANGING IMAGE REPRODUCED FROM ORIGINAL IMAGE

[75] Inventors: Shigenobu Osawa, Kawasaki; Keiji Itaya, Yokohama, both of Japan

[73] Assignee: Kabushiki Kaisha Toshiba, Kawasaki, Japan

[21] Appl. No.: 171,733

[22] Filed: Mar. 21, 1988

[30] Foreign Application Priority Data

Mar. 25, 1987 [JP] Japan ..... 62-70767
Mar. 27, 1987 [JP] Japan ..... 62-71622

[51] Int. Cl.[4] ..... G03G 15/00

[52] U.S. Cl. ..... 355/218; 355/210; 355/265; 355/214

[58] Field of Search ..... 355/14 R, 14 D, 14 CH, 355/3 R, 3 DD, 3 CH, 7

[56] References Cited

U.S. PATENT DOCUMENTS 4,685,794 8/1987 Watanabe ..... 355/7
4,688,923 8/1987 Kohyama ..... 355/14 D
4,761,673 8/1988 Watanabe et al. ..... 355/7 X

*Primary Examiner*—R. L. Moses
*Attorney, Agent, or Firm*—Foley & Lardner, Schwartz, Jeffery, Schwaab, Mack, Blumenthal & Evans

[57] ABSTRACT

An electronic copying apparatus of this invention has a function of partially changing a tone of an image reproduced from an original image. In this apparatus, a predetermined range of an original placed on an original table is designated by a spot light source, and the original is optically scanned by an exposure lamp. An optical image obtained by the exposure lamp is focused on a photoconductive drum having a predetermined surface potential by an optical system, and is developed by a developer constituting a developer unit. The image developed by the developer is transferred to a paper sheet by a transfer charger. An image outside the predetermined range designated by the spot light source is formed on the paper sheet in one tone, and an image inside the predetermined range is erased by an erasure array. The surface potential of the photoconductive drum is changed upon an instruction from a main processor. The image inside the predetermined range is developed and is then transferred to the paper sheet by the transfer charger. In this case, the image inside the predetermined range is formed in the other tone.

15 Claims, 49 Drawing Sheets

ELECTRONIC COPYING APPARATUS HAVING FUNCTION OF PARTIALLY CHANGING IMAGE REPRODUCED FROM ORIGINAL IMAGE

BACKGROUND OF THE INVENTION

1. Field of the Invention

The present invention relates to an electronic copying apparatus and, more particularly, to an electronic copying apparatus having a function of partially changing image properties of an image reproduced from an original.

2. Description of the Related Art

As is known, an electronic copying apparatus has functions of copying an original image on a paper sheet without modifications, and of enlarging or reducing an original image and copying the image. Recently, a copying apparatus which can erase part of an original image, and copy the remaining image has been developed, and is commercially available. An apparatus of this type has a mode of erasing an image of an original in a predetermined range and copying the remaining image (masking mode), or a mode of erasing an image outside the predetermined range and copying the remaining image (trimming mode) in a manner opposite to the masking mode.

In some electronic copying apparatuses which can erase part of an original image and can copy the remaining image, image properties of an original image cannot be changed in the copied image. For this reason, the following problems occur.

More specifically, when the entire original to be copied has a low contrast and locally includes a photograph, a problem occurs in the copied image of the original. For example, in an original, e.g., old newspaper, in which a white background portion has turned yellow and a contrast between characters and the white portion is decreased, if this original includes a photograph among characters, a developing system having a large $\gamma$ (gamma; gradient of a characteristic curve of an image density with respect to a latent image potential) value (soft tone characteristics) is used in order to obtain a high-contrast clear image free from fogging. In this developing system, an exposure amount is set to be rather high. In this case, a copied image of the photograph portion becomes dark and unclear.

In order to clearly copy a photograph and to precisely reproduce a photograph, a developing system having a small $\gamma$ value (rough tone characteristics; the value is ideally 1.0, and the system must have a wide dynamic range) must be used to copy an image.

Therefore, when old newspaper including a photograph portion is to be copied, it is difficult to obtain a clear image if either system is used. Such an original is not limited to old newspaper but may be a color print of a landscape, and the like.

In some apparatus, a polarity of an original to be copied cannot be partially changed. More specifically, in some apparatuses, a positive original image cannot be partially converted to a negative image, and vice versa.

SUMMARY OF THE INVENTION

Accordingly, an object of the present invention is to provide an electronic copying apparatus which has a function of partially changing image properties of an original image, can partially form an image having a different image property from that of the remaining image, and can easily designate a range of changing the image properties.

According to the present invention, there is provided an image forming apparatus, the apparatus comprises image forming means for forming an image using a first image property or a second image property, selecting means for selecting either one of the first image property or the second image property, designation means for designating a range in which the image forming means is to reproduce a partial image, which is located at the designated range, using the selected image property selected by the selecting means, and control means for controlling an image forming operation of the image forming means based on the selected image property selected by the image property selecting means and the designated range designated by the designation means.

According to another aspect of the present invention, there is provided an electronic copying apparatus having a function of partially changing a tone of an image reproduced from an original, the apparatus comprises an original table on which an original is placed, designation means for designating a predetermined range for partially changing the tone of the image reproduced from the original placed on the original table, image forming means for focusing and developing an optical image obtained by optically scanning the original placed on the original table so as to form an image, transfer means for transferring the image formed by the image forming means to a recording medium, changing means for changing the tone of the image corresponding to the predetermined range of the original designated by the designation means, and control means for performing a control operation such that an image inside the predetermined range designated by the designation means is formed on the recording medium in one tone determined by the changing means, and an image outside the predetermined range is formed on the recording medium in the other tone determined by the changing means.

BRIEF DESCRIPTION OF THE DRAWINGS

The manner in which the foregoing and other objects of the present invention are accomplished will be apparent from the accompanying specification and claims considered together with the drawings, wherein:

FIGS. 18A and 18B show displays on a display section in a partial tone copying mode, in which FIG. 18A is a view showing a state wherein a portion outside a designated range of an original is displayed, and FIG. 18B is a view showing a state wherein a portion inside the designated range of the original is displayed;

FIGS. 21A and 21B show paper sheets subjected to partial tone copying, in which FIG. 21A is a view showing a state after a portion outside a designated range is copied, and FIG. 21B is a view showing a state after a final copying operation is performed;

FIGS. 33A and 33B show a pole position in the developing sleeve, in which FIG. 33A is a view showing a state before movement and FIG. 33B is a view showing a state after movement;

FIGS. 38A and 38B show a distance between a photoconductive drum and a developing sleeve, in which FIG. 38A is a view showing a distance before movement and FIG. 38B is a view showing a distance after movement;

FIGS. 51A and 51B show displays on a display section in a partial inversion mode, in which FIG. 51A is a view showing a state wherein a portion outside a designated range is displayed, and FIG. 51B is a view showing a state wherein a portion inside the designated range is displayed;

FIGS. 53A and 53B show paper sheets subjected to the partial inversion copying operation, in which FIG. 53A is a view showing a state after a portion outside a designated range is copied, and FIG. 53B is a view showing a state after a final copying operation is performed;

FIGS. 54A and 54B are graphs for explaining the relationship between a charging potential of a photoconductive drum and a developing bias voltage when normal and inverting development operations are performed, in which FIG. 54A is a graph for normal development and FIG. 54B is a graph for inverting development;

FIGS. 57A and 57B are graphs for explaining the relationship between a charging potential of a photoconductive drum and a developing bias voltage when normal and inverting development operations are performed, in which FIG. 57A is a graph for normal development, and FIG. 57B is a graph for inverting development.

DETAILED DESCRIPTION OF THE PREFERRED EMBODIMENTS

The preferred embodiments of the present invention will now be described with reference to the accompanying drawings.

Figure 1:
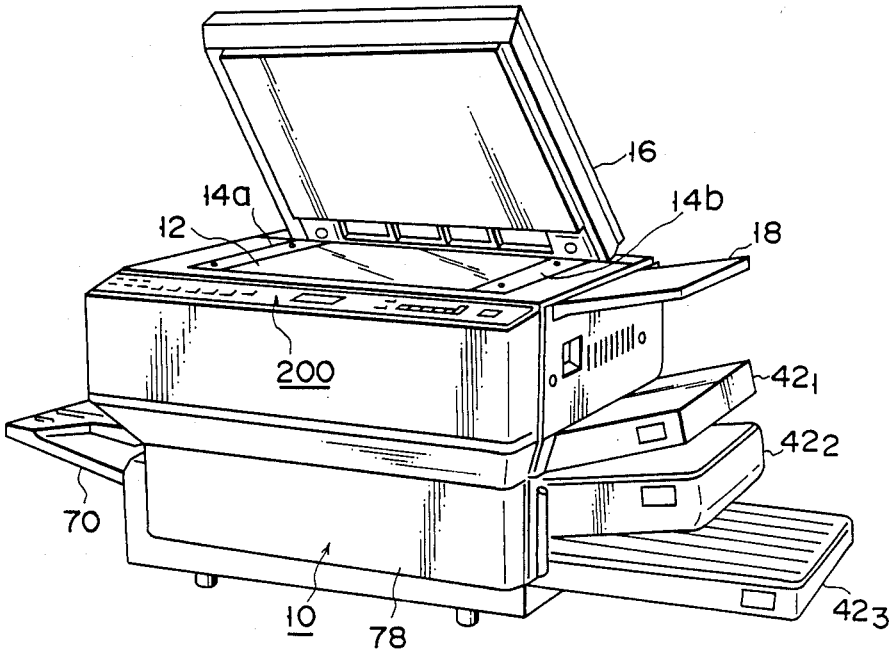
FIG. 1 is a perspective view showing an outer appearance of an electronic copying apparatus according to an embodiment of the present invention.
Figure 2:
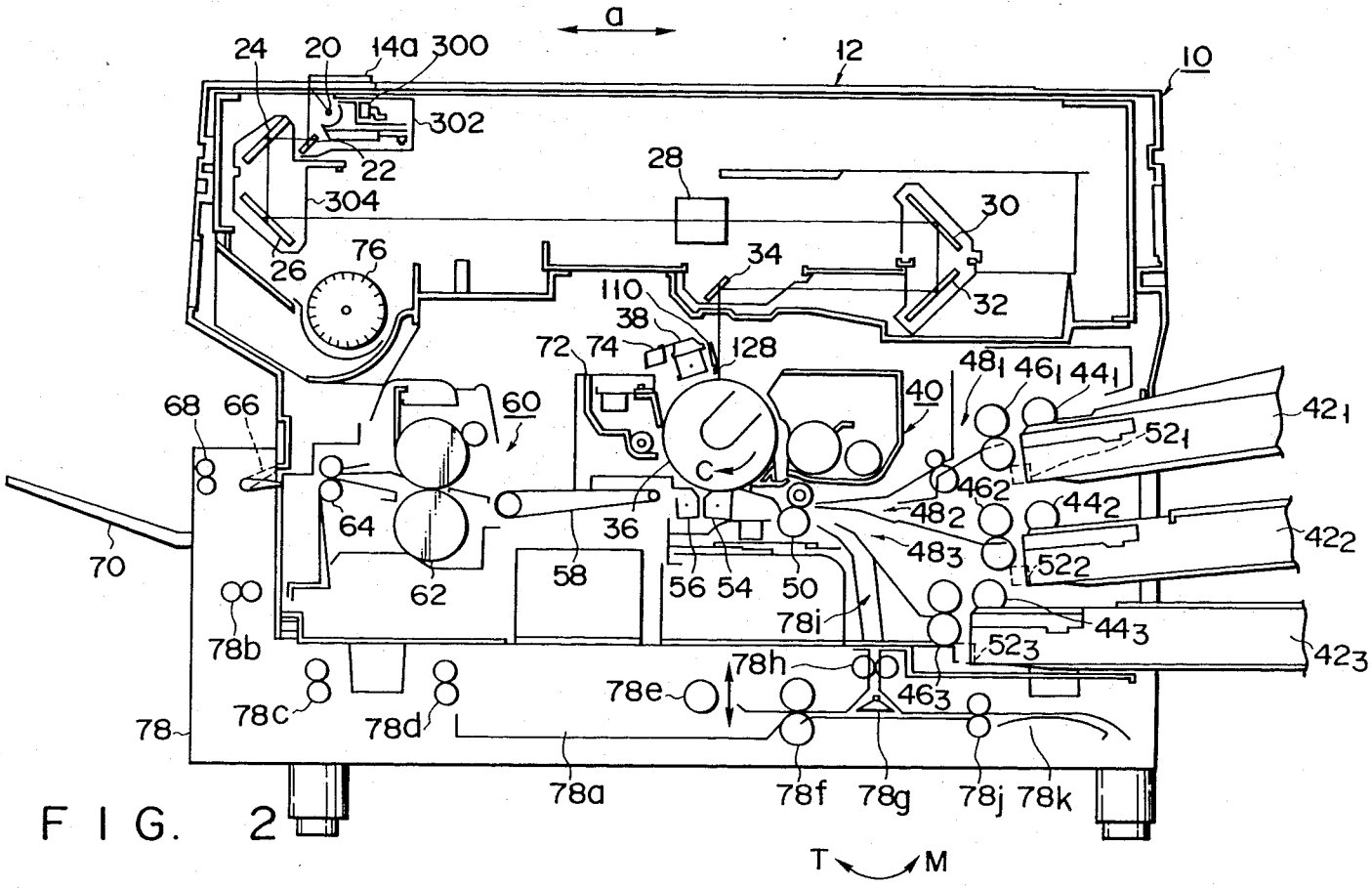
FIG. 2 is a side sectional view of the apparatus shown in FIG. 1.

FIGS. 1 and 2 schematically show an electronic copying apparatus according to the present invention. More specifically, reference numeral 10 denotes a copying apparatus body. Original table (transparent glass) 12 for supporting an original is fixed on the upper surface of body 10. Stationary scales 14*a* and 14*b* serving as setting references for an original are provided at two end portions of original table 12, and openable/closable original cover 16 and work table 18 are provided adjacent to original table 12. An original placed on original table 12 is exposed and scanned during forward movement of an optical system. The optical system comprises exposure lamp 20, and mirrors 22 24, and 26, and is reciprocated in a direction of arrow a along the lower surface of original table 12. In this case, mirrors 24 and 26 are moved at a speed ½ that of mirror 22 so as to maintain a predetermined optical path length. Light reflected by the original upon scanning of the optical system, i.e., light radiated from exposure lamp 20 and reflected by the original, is reflected by mirrors 22, 24, and 26, and is further reflected by mirrors 30, 32, and 34 through variable magnification lens block 28. Light reflected by mirror 34 is guided toward photoconductive drum (selenium drum) 36, so that an image of the original is formed on the surface of photoconductive drum 36. Photoconductive drum 36 is rotated in a direction of arrow c at a peripheral velocity of 166 mm/sec. The surface of drum 36 is charged to a predetermined voltage (e.g., +800 V or +600 V) by charger 38, and thereafter, an image is slit-exposed thereon, thereby forming an electrostatic latent image on the surface. The latent image is visualized by toner supplied from developer unit 40 (to be described later in detail) which is arranged adjacent to drum 36 and stores, e.g., black toner.

Paper sheets (recording medium) P are picked up one by one from upper paper feed cassette $\mathbf{42}_1$, middle paper feed cassette $\mathbf{42}_2$, or lower paper feed cassette $\mathbf{42}_3$ by feed roller $\mathbf{44}_1$, $\mathbf{44}_2$, or $\mathbf{44}_3$, and roller pair $\mathbf{46}_1$, $\mathbf{46}_2$, or $\mathbf{46}_3$, respectively. Then, sheet P is guided to register roller pair 50 through paper guide path $\mathbf{48}_1$, $\mathbf{48}_2$, or $\mathbf{48}_3$, and is then guide to a transfer section by roller pair 50. Cassettes $\mathbf{42}_1$, $\mathbf{42}_2$, and $\mathbf{42}_3$ are detachably loaded to the right lower end portion of body 10, and can be selected at operation panel 200 (to be described later). Note that cassette sizes of cassettes $\mathbf{42}_1$, $\mathbf{42}_2$, and $\mathbf{42}_3$ are respectively detected by cassette size detection switches $\mathbf{52}_1$, $\mathbf{52}_2$, and $\mathbf{52}_3$. Switches $\mathbf{52}_1$, $\mathbf{52}_2$, and $\mathbf{52}_3$ comprise a plurality of microswitches which are tuned on/off in response to insertion of cassettes of different sizes.

Paper sheet P is brought into tight contact with the surface of photoconductive drum 36 at the portion of transfer charger 54, so that a toner image on drum 36 is transferred to sheet P by charger 54. Sheet P with the transferred image is electrostatically peeled from drum 36 by peeling charger 56. Thereafter, sheet P is conveyed by conveyor belt 58, and is fed to fixing roller pair 62 serving as fixing device 60 provided at a trailing end portion of belt 58. Sheet P subjected to fixing is fed to exhaust tray 70 provided outside body 10 by selector gate 66 operated as indicated by the solid line in FIG. 2, and exhaust roller pair 68. Residual toner on drum 36 subjected to transfer is removed by cleaner 72. An after-image is then erased by discharging lamp 74. Thus, drum 36 can be set in an initial state. Note that reference numeral 76 denotes a cooling fan for preventing an increase in temperature in body 10.

Multiple copying unit 78 is provided below body 10. Unit 78 allows a double-sided copying operation on a single sheet and a multiple-copying operation on an identical sheet surface. Unit 78 includes selector gate 66, exhaust roller pair 68, and roller pairs 78*b*, 78*c*, and 78*d* for guiding a sheet picked up by gate 66 toward stacking section 78*a*. Stacking section 78*a* is provided with feed roller 78*e* for feeding sheets temporarily stored in stacking section 78*a*. Roller 78*e* is vertically movable as indicated by an arrow in FIG. 2 in accordance with the total thickness (number) of stored sheets. A sheet fed by roller 78*e* is guided toward control gate 78*g* through separation roller pair 78*f* for separating and feeding sheets one by one. In a multiple copying mode, control gate 78*g* is pivoted in a direction indicated by arrow M in FIG. 2 so as to guide a sheet toward register roller pair 50 through convey roller pair 78*h* and paper guide path 78*i*. In a double-sided copying mode, gate 78*g* is set in the state illustrated in FIG. 2 so as to guide a sheet toward reverse section 78*k* through convey roller pair 78*j*. When sheets are stored in reverse section 78*k*, control gate 78*g* is pivoted in a direction of arrow T in FIG. 2, and guides sheets fed by roller pair 78*j* toward register roller pair 50 through convey rollers 78*h* and guide path 78*i*. In this embodiment, control gate 78*g* is always pivoted in the direction of arrow M in FIG. 2, and only a multiple copying mode is allowed.

Figure 3:
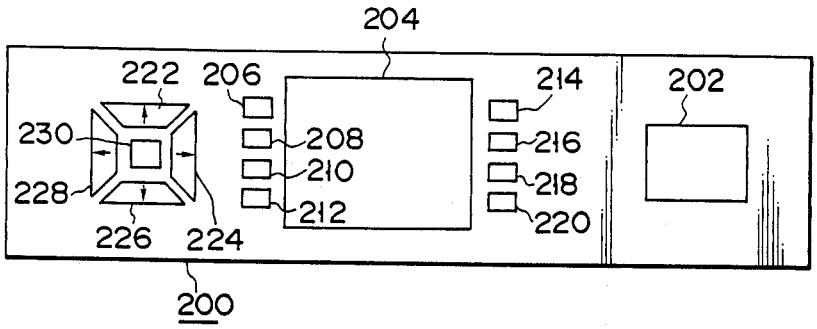
FIG. 3 is a plan view showing an arrangement of an operation panel.

FIG. 3 shows operation panel 200 provided on the upper surface portion of body 10. Panel 200 comprises copy key 202 for instructing start of a copying operation, and display section 204 comprising a liquid crystal dot matrix display, or the like. Display section 204 selectively displays display information stored in memory 106 (to be described later) in accordance with modes. Various selection keys 206, 208, 210, 212, 214, 216, 218, and 220 for selecting a mode displayed on display section 204 are arranged around display section 204.

Operation panel 200 also includes operation keys 222, 224, 226, and 228 for moving spot light source 300 (to be described later) for indicating a predetermined range of an erasure range and a tone changing position, and position designation key 230 for inputting a coordinate position indicated by spot light source 300.

Display section 204 displays machine conditions or the like in characters, graphically displays selection screens of a trimming mode, a masking mode, an image move mode, an edge erasure mode, a copying mode for a plurality of sheets, a copying mode for two originals, a photograph copying mode, a partial inversion mode (conversion from positive to negative or from negative to positive), a multiple copying mode, a centering mode, and the like, and graphically displays a selection screen for selecting whether one or two originals are subjected to the edge mode, a setting screen of a copy count, a selection screen of a copying magnification, and a screen of a copying state.

Figure 4:
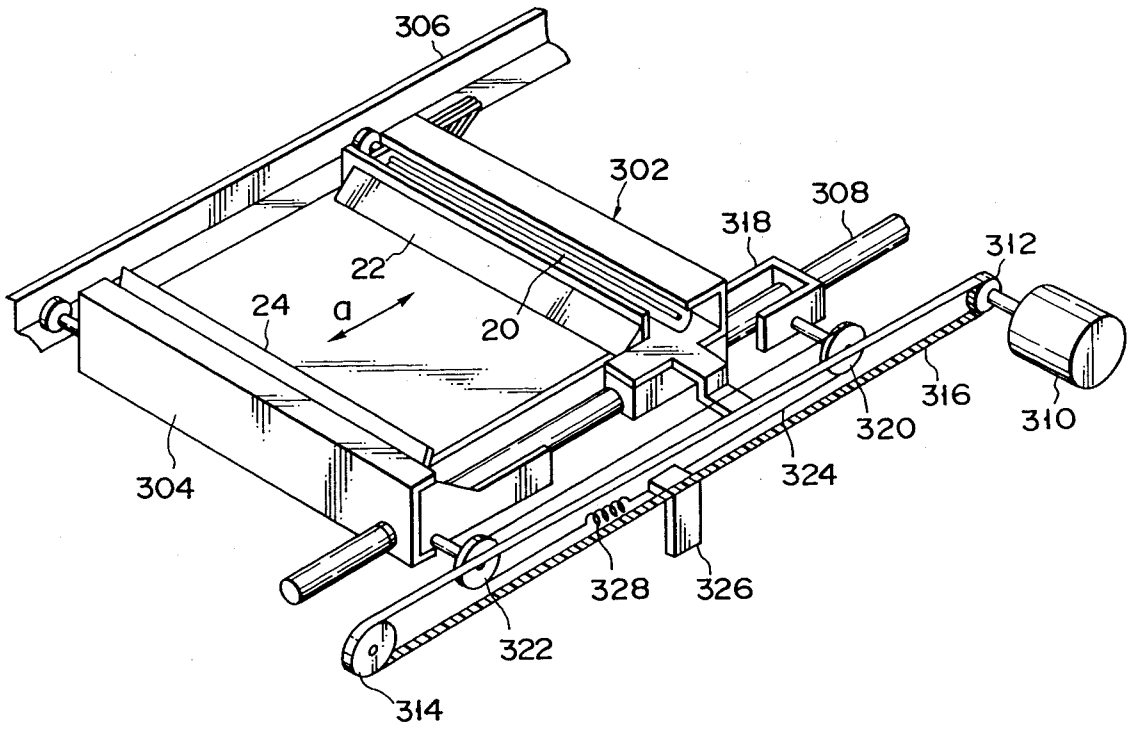
FIG. 4 is a schematic perspective view of a drive mechanism of an optical system.

FIG. 4 shows a drive mechanism for reciprocating the optical system. More specifically, mirror 22 and exposure lamp 20 are supported by first carriage 302, and mirrors 24 and 26 are supported by second carriage 304. These carriages 302 and 304 are guided by guide rails 306 and 308, respectively, and can be moved in a direction of arrow a. 4-phase stepping motor 310 drives pulley 312. Endless belt 316 is looped between pulley 312 and idle pulley 314. One end of first carriage 302 for supporting mirror 22 is fixed to an intermediate portion of belt 316. Two pulleys 320 and 322 are rotatably arranged on guide portion 318 of second carriage 304 for supporting mirrors 24 and 26 so as to be axially separated from each other. Wire 324 is looped between pulleys 320 and 322. One end of wire 324 is fixed to fixing portion 326, and the other end thereof is fixed thereto through coil spring 328. One end of first carriage 302 is fixed to an intermediate portion of wire 324. Therefore, when stepping motor 310 is rotated, belt 316 is rotated to move first carriage 302, and second carriage 304 is moved accordingly. In this case, since pulleys 320 and 322 serve as dynamic pulleys, second carriage 304 is moved in the same direction (direction of arrow a) as first carriage 302 at a speed ½ that of carriage 302. Note that the moving direction of first and second carriages 302 and 304 is controlled by switching a rotating direction of stepping motor 310.

First carriage 302 is moved to a predetermined position (home position depending on a magnification) upon operation of motor 310 in accordance with a selected paper size and a magnification. When copy key 202 on operation panel 200 is depressed, first carriage 302 is moved toward second carriage 304, and thereafter, lamp 20 is turned on. Then, carriage 302 is moved to be separated from carriage 304. When scanning of an original is completed, lamp 20 is turned off, and first carriage 302 is returned to the home position.

Figure 5:
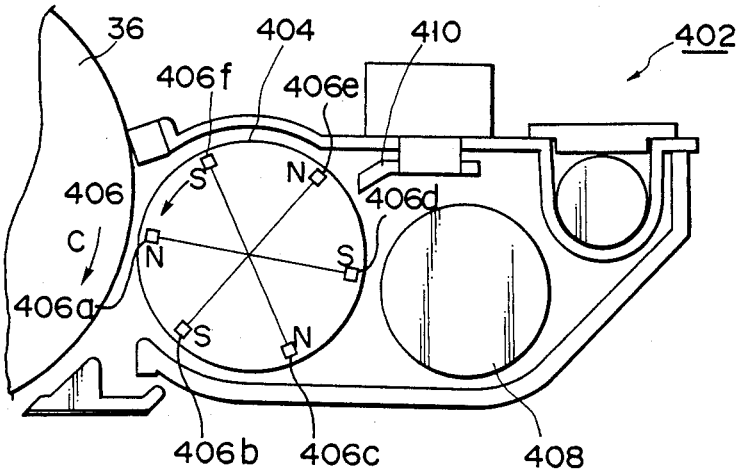
FIG. 5 is a side sectional view showing an arrangement of a developer shown in FIG. 2.

FIG. 5 shows developer 402 constituting developer unit 40. More specifically, developer 402 is constituted by developing sleeve 404 formed of a nonmagnetic material (stainless steel), stationary magnetic poles 406 included in sleeve 404, stirring roller 408 for stirring toner stored in developer 402, and blade 410 for regulating an amount of toner. Developing sleeve 404 is rotated at the same speed (166 mm/sec) as that of drum 36 in the same direction. Stationary magnetic poles 406 comprises developing main pole **406*a*, and convey poles 406*b* to 406*f*. A magnetic force generated on sleeve 404 by main pole 406*a* is 1,000 G (Gauss). Magnetic forces generated on sleeve 404 by poles 406*b*, 406*c*, . . . , 406*f*** are respectively 500 G, 300 G, 300 G, 500 G, and 500 G in the order named.

Sleeve 404 and blade 410 are separated at a predetermined interval, e.g., 1.0 mm, and sleeve 404 and drum 36 are separated at a predetermined interval, e.g., 1.2 mm. In a developing agent used in developer 402, a ferrite carrier having a particle size distribution of 150 to 300 mesh is used as a carrier, and negatively charging toner using a styrene-acrylic resin having an average particle size of 10 μm is used as toner.

Figure 6A:
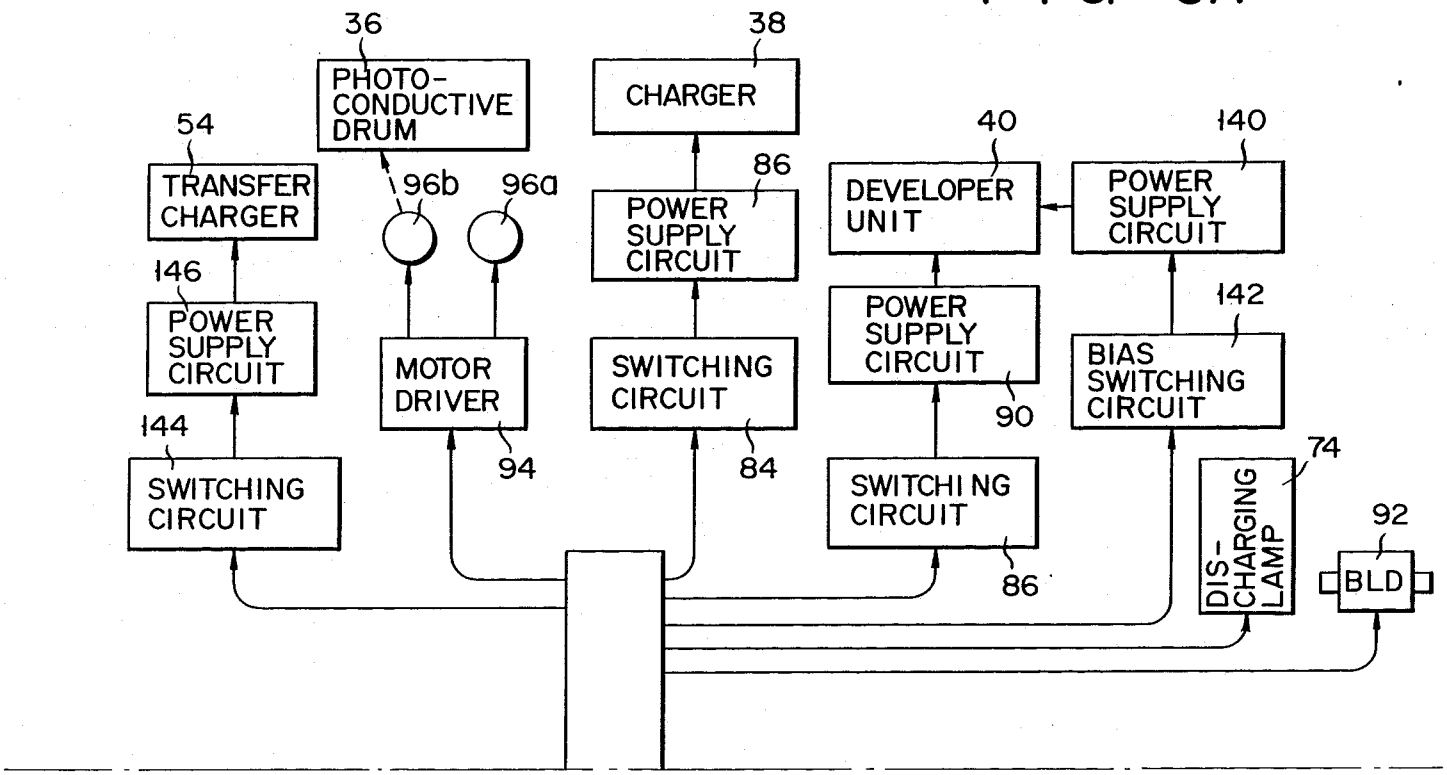
FIGS. 6A and 6B are a schematic block diagram showing the entire control circuit.
Figure 6B:
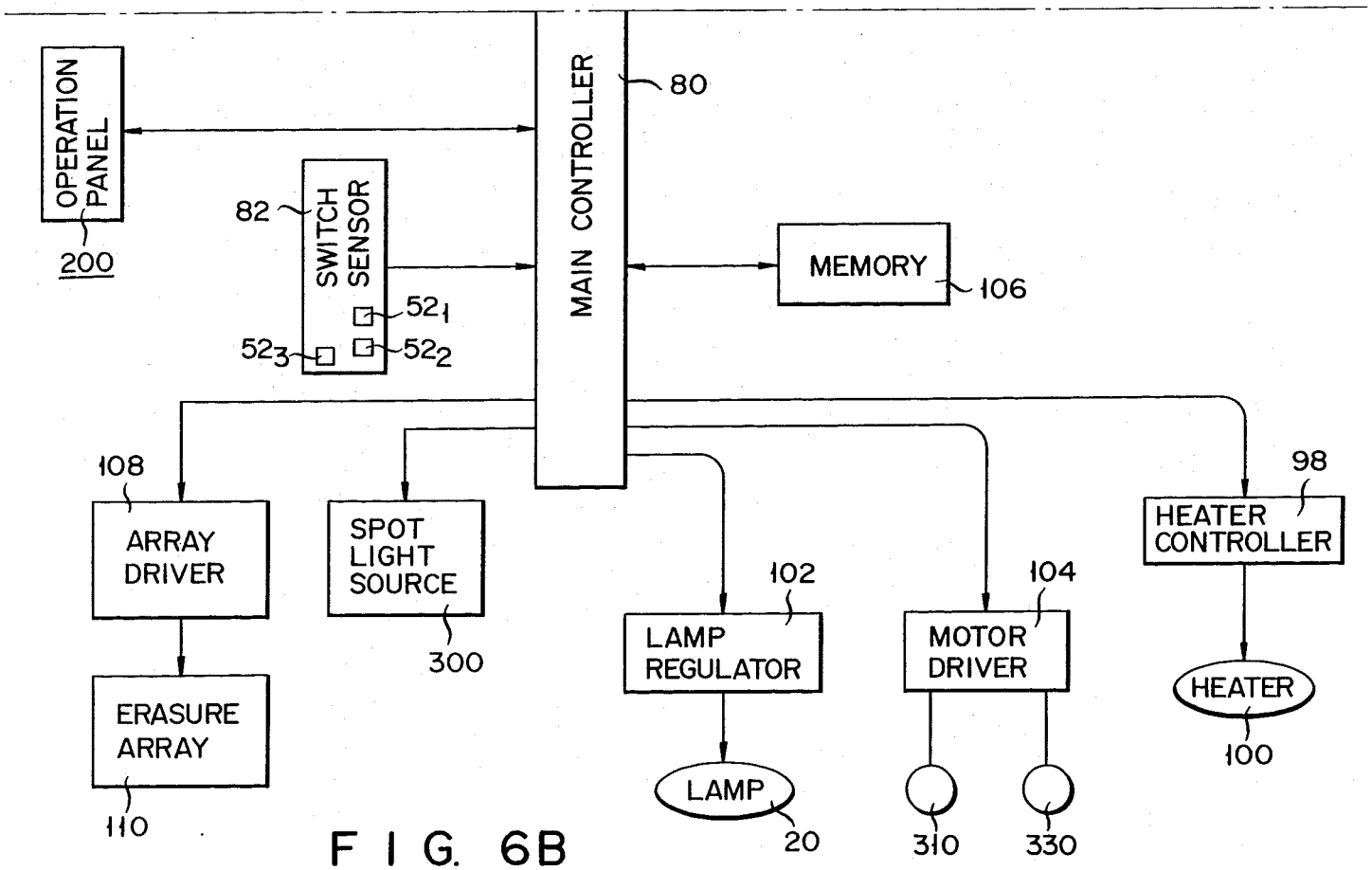

FIGS. 6A and 6B shows the entire control circuit. Main processor 80 detects inputs from operation panel 200 and various switches and sensors, e.g., input devices 82 such as cassette size detection switches $52_1$, $52_2$, $52_3$, and the like, and controls them. Main processor 80 controls power supply circuit (high-voltage transformer) 88 for driving charger 38 and power supply circuit (high-voltage transformer) 90 for applying a predetermined bias voltage to developing sleeve 404 in developer 402 constituting developer unit 40 respectively through switching circuits 84 and 86. Main processor 80 controls discharging lamp 74 and blade solenoid 92 of cleaner 72, and also controls, through motor driver 94, motor **96*a* for driving developing sleeve 404 and motor 96*b* for driving drum 36. Main controller 80 controls heater 100 in fixing roller pair 62 through heater controller 98, exposure lamp 20 through lamp regulator 102, power supply circuit 146 (for applying a predetermined voltage to transfer charger 54) through switching circuit 144, and stepping motors 310 and 330 through motor driver 104, thereby performing the above-mentioned copying operation. Processor 80 also controls spot light source 300, stepping motors 310 and 330, memory 106, erasure array 108 through array driver 108, and the like, thereby performing an operation for erasing an unnecessary portion of an original. Note that spot light source 300, stepping motor 30, memory 106, array driver 108, and erasure array 110** will be described later in detail.

Main processor 80 causes display section 204 to perform character or pattern display corresponding to a selected mode in accordance with character or pattern data stored in a memory (not shown). The memory may comprise a quick disk device.

Figure 7:
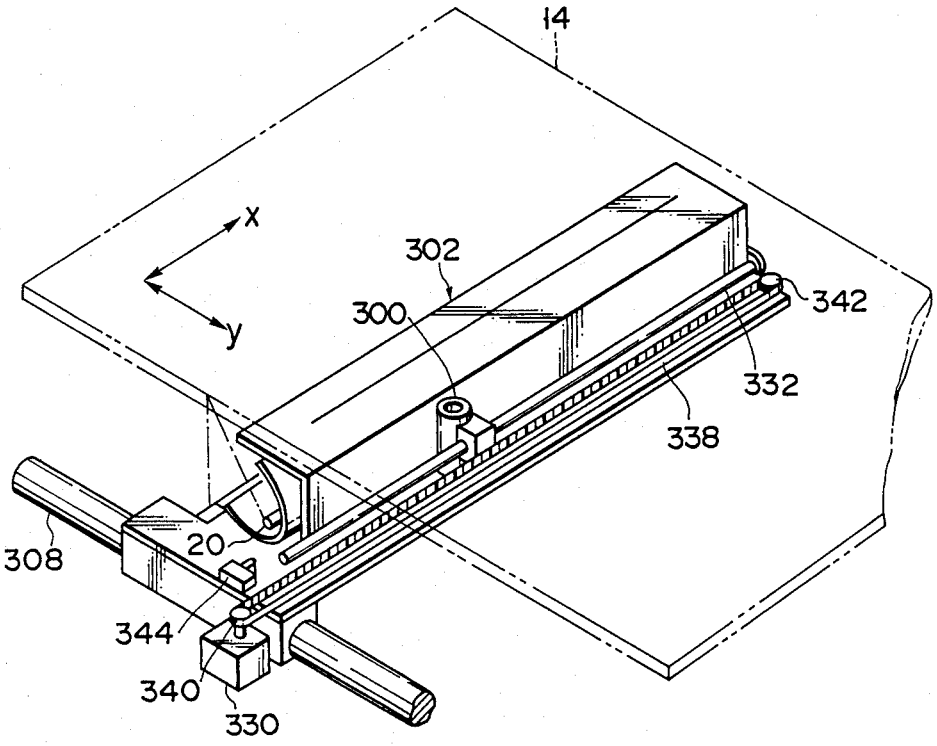
FIG. 7 is a schematic perspective view showing a spot light source.
Figure 8:
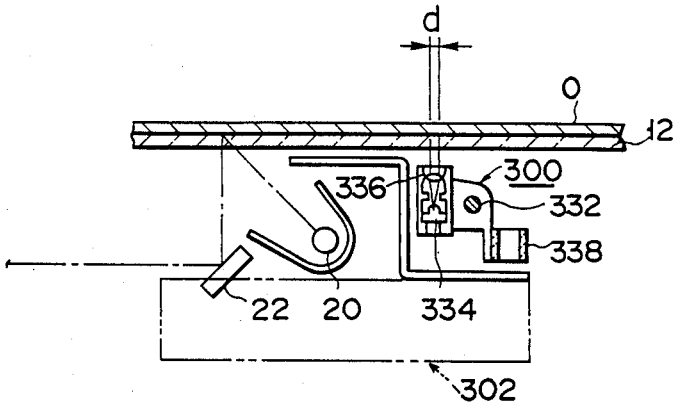
FIG. 8 is a side sectional view showing the spot light source.

An erasure means serving as original image tone changing means will be described below. Referring to FIGS. 7 and 8, first carriage 302 is provided with guide shaft 332 along lamp 20 on a portion shielded from light emitted from lamp 20. Spot light source 300 as means for indicating an erasure range of original O is movably arranged on guide shaft 332. Spot light source 300 comprises light emitting element (e.g., an LED or lamp) 334 facing original table 12 and lens 336. Light emitted from light emitting element 334 is focused by lens 336 to form a light spot having diameter d, and the light spot is radiated on original table 12.

Spot light source 300 is coupled to timing belt (toothed belt) 338 disposed along guide shaft 308. Timing belt 338 is looped between pulley 340 attached to the rotating shaft of stepping motor 330 and driven pulley 342. Therefore, upon rotation of stepping motor 330, spot light source 300 is moved in a direction perpendicular to the scanning direction of first carriage 302. Position sensor 344 for detecting an initial position of spot light source 300 is arranged on first carriage 302 located at an end portion of guide shaft 332 near stepping motor 330. Sensor 344 comprises a microswitch. When spot light source 300 is moved, it first abuts against position sensor 344, thereby detecting its initial position.

A method for designating an erasure range of an original using spot light source 300 will be described with reference to FIGS. 9, 10, 11A, and 11B.

Figure 9:
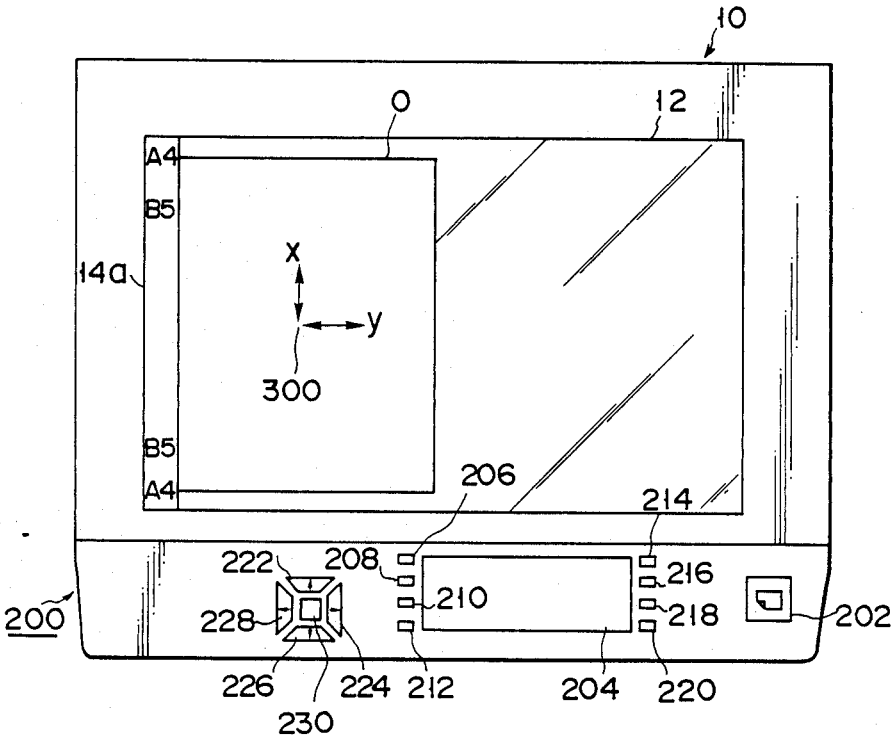
FIGS. 9 and 10 are plan views for explaining a designation operation of a predetermined range of an original using the spot light source.

When the erasure range of original O is designated, original O is set facing down on the side of stationary scale **14*a*, as shown in FIG. 9. In this state, when one of operation keys 222 to 228 is operated, spot light source 300 is moved while light emitting element 334 is kept on. More specifically, when operation key 224 or 228 is depressed, motor 310 is driven, and first carriage 302 and spot light source 300 are moved in the scanning direction (direction of arrow y in FIG. 9). Meanwhile, when operation key 222 or 226 is depressed, motor 330 is driven, and spot light source 300** is moved in a direction (direction of arrow x) perpendicular to the scanning direction.

Figure 10:
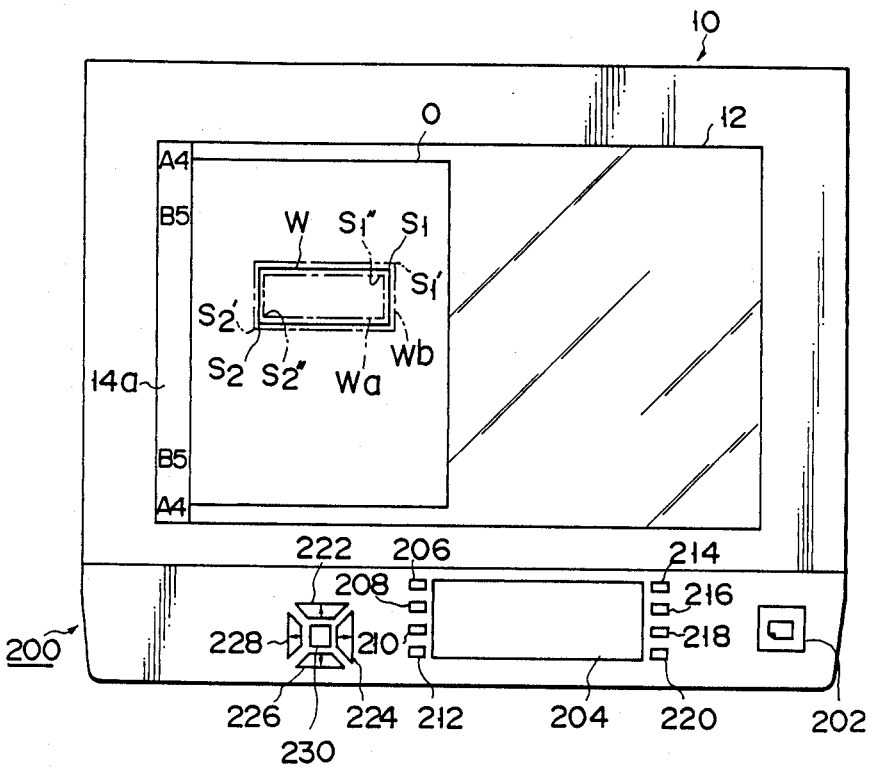

When a photograph copying mode is selected, an operator selectively depresses operation keys 222 to 228 while visually observing a light spot transmitted through original O. The operator then depresses position designation key 230 while the light spot is located at, e.g., point $S_1$ on original O, as shown in FIG. 10. The coordinate position designated by point $S_1$ is stored in main processor 80 shown in FIG. 6. Similarly, when position designation key 230 is depressed while the light spot is located at point $S_2$ on original O, the coordinate position of point $S_2$ is stored in main processor 80. The positions of the light spot can be detected by counting drive steps of stepping motors 310 and 330. Thereafter, as shown in FIG. 10, a rectangular region having points $S_1'$ and $S_2'$ and $S_2'$ as diagonal points of outer edge Wb of frame W defined by points $S_1$ and $S_2$ is designated as an erasure range for a rough-tone copying mode as one tone copying mode (character copying mode; fundamental tone).

A region other than a rectangular region having points $S_1''$ and $S_2'$ as diagonal points of inner edge Wa of frame W defined by points $S_1$ and $S_2$ is designated as an erasure range for a soft-tone copying mode as the other tone copying mode (photograph copying mode).

Figure 11A:
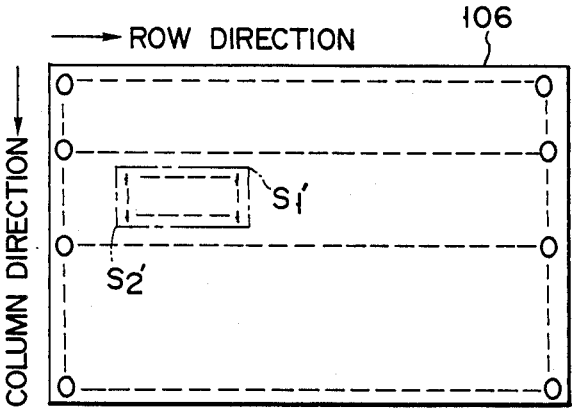
FIGS. 11A and 11B are views for explaining memory contents.
Figure 11B:
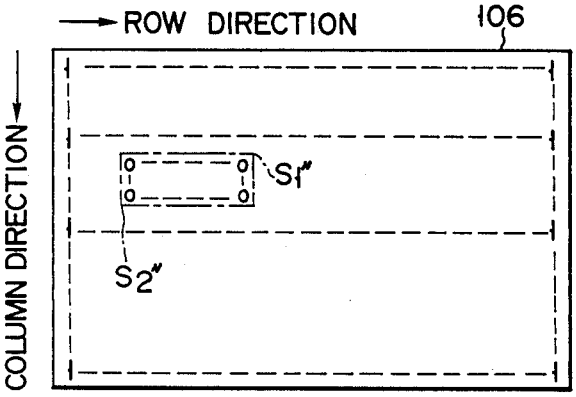

When the erasure range is designated as described above, main processor 80 performs calculations based on the coordinate positions of the two designated points and a copying magnification, and HIGH-level signals "1" are stored in an erasure range portion of memory 106 and LOW-level signals "0" are stored in the other portion. More specifically, memory 106 comprises a RAM (random access memory) which has a capacity in a column direction substantially coinciding with (moving distance of spot light source 300 in the x direction) (positional resolution in the y direction). Based on data supplied from main processor 80, if the rough-tone copying mode (fundamental tone) is selected, HIGH-level signals are stored at addresses corresponding to a portion inside outer edge Wb, as shown in FIG. 11A; if the soft-tone copying mode is selected, HIGH-level signals are stored at addresses corresponding to a portion outside inner edge Wa, as shown in FIG. 11B, and LOW-level signals are stored at other addresses in both cases.

Original O for which the erasure range is designated is reversed in the y direction shown in FIG. 9, and is set to face down on the side of stationary scale 14*a*. Therefore, in this state, an original image corresponds to the erasure data stored in memory 106.

Figure 12:
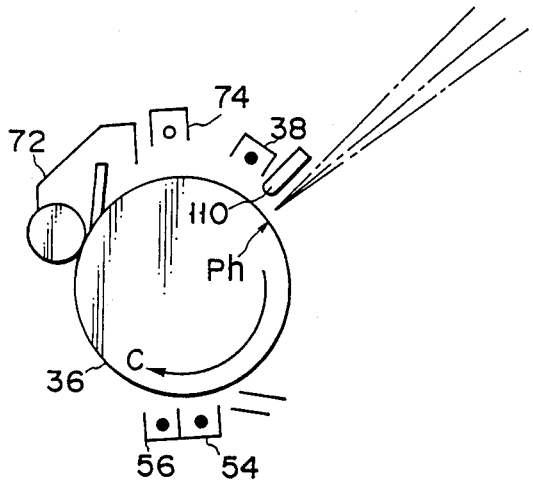
FIG. 12 is a schematic side sectional view showing an arrangement of an erasure array.
Figure 13:
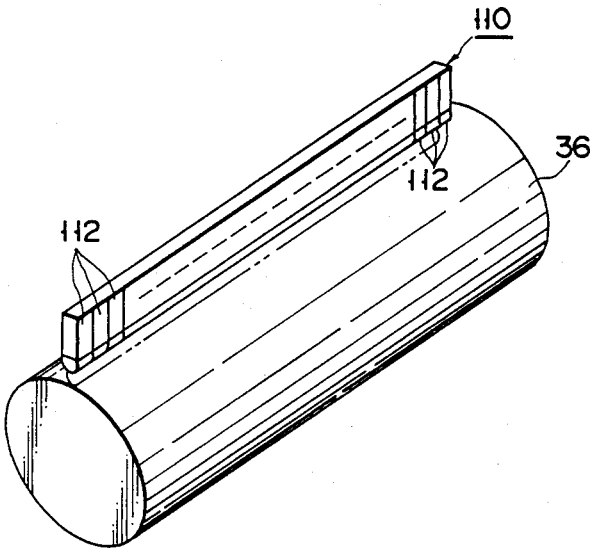
FIGS. 13 and 14 are respectively a schematic perspective view and a schematic front view showing the positional relationship between the erasure array and a photoconductive drum.
Figure 14:
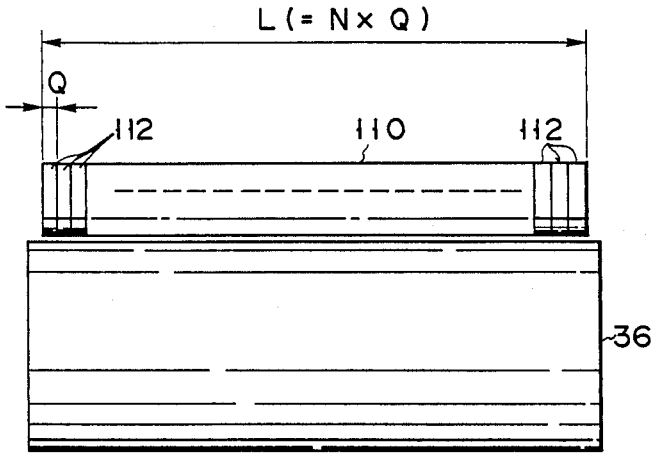
Figure 15A:
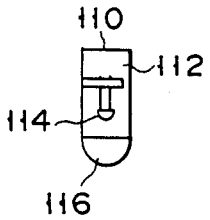
FIGS. 15A and 15B are respectively a side sectional view and a partially cutaway sectional view showing an arrangement of the erasure array.
Figure 15B:
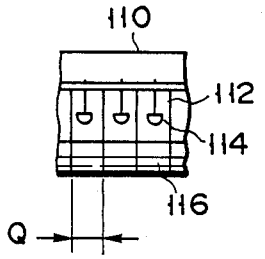

As shown in FIG. 12, erasure array 110 as erasure means is closely arranged between charger 38 and exposure portion Ph of photoconductive drum 36. As shown in FIGS. 13 and 14, in erasure array 110, a plurality of light shielding cells 112 are arranged in a direction perpendicular to the rotating direction of drum 36. Light emitting element 114 comprising, e.g., an LED is provided in each cell 112, as shown in FIGS. 15A and 15B. Lens 116 for focusing light emitted from element 114 on the surface of drum 36 is provided at an opening of each cell 112 opposing drum 36. The number of light emitting elements disposed in erasure array 110 coincides with the capacity in the column direction of memory 106. If a width of each light emitting element 114 is given as Q and the number of the light emitting elements is given as N, total length L of erasure array L is $L=N\times Q$.

Figure 16:
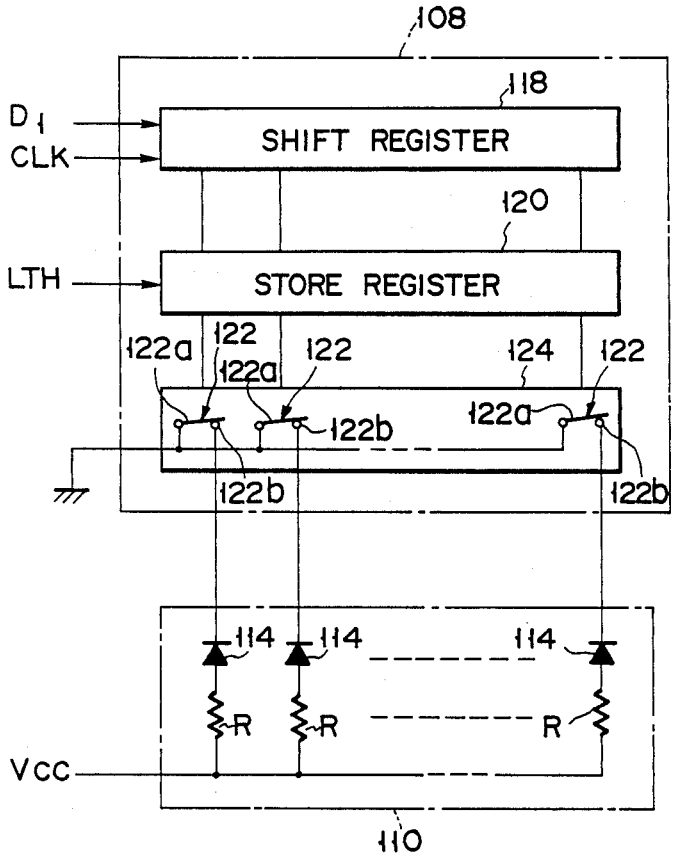
FIG. 16 is a circuit diagram showing an arrangement of an array driver.

Erasure array 110 is driven by array driver 108 described above. As shown in FIG. 16, array driver 108 comprises shift register 118 having the same number of bits as that in the column direction of memory 106, store register 120 for storing the content of shift register 118, and switch circuit 124 comprising a plurality of switch elements 122 which are turned on/off in response to output signals from store register 120. Movable contact 122*a* of each switch element 122 is grounded, and fixed contact 122*b* thereof is connected to the cathode of each light emitting element 114 constituting erasure array 110. The anode of each light emitting element is connected to power supply Vcc through current-limiting resistor R.

After the erasure range of original O is designated as described above, original cover 16 is closed, and copy key 202 is depressed. First carriage 302 and drum 36 are operated, and data for one line in the row direction is sequentially read out from memory 106 (FIGS. 11A or 11B). Readout data $D_1$ is transferred to shift register 118 of array driver 108 in response to clock signal CLK. After one-line data is transferred to shift register 118, when a charged portion of photoconductive drum 36 has reached erasure array 110, latch signal LTH is output from main processor 80, and the storage data in shift register 118 is supplied to store register 120 in accordance with latch signal LTH. More specifically, since erasure array 110 is arranged between charger 38 and exposure portion Ph, the output timing of latch signal LTH is controlled such that one-line data output from memory 106 is supplied to store register 120 before $\theta_1/\omega$ if the angle defined between erasure array 110 and exposure portion Ph is $\theta_1$ and drum 36 is rotated at angular velocity $\omega$.

Each switch element 122 in switch circuit 124 is controlled by the output signal from store register 120. More specifically, when store register 120 outputs a HIGH-level output signal, corresponding element 122 is turned on; otherwise, it is turned off. As a result, when switch element 122 is turned on, light emitting element 114 connected thereto is turned on; otherwise, it is turned off. Therefore, the charged portion of drum 36 is locally discharged by ON light emitting elements 114. If the discharged portion is exposed, no latent image is formed, and as a result, the original image is erased. Similarly, one-line data is sequentially read out from memory 106, and image erasure is performed.

Figure 17:
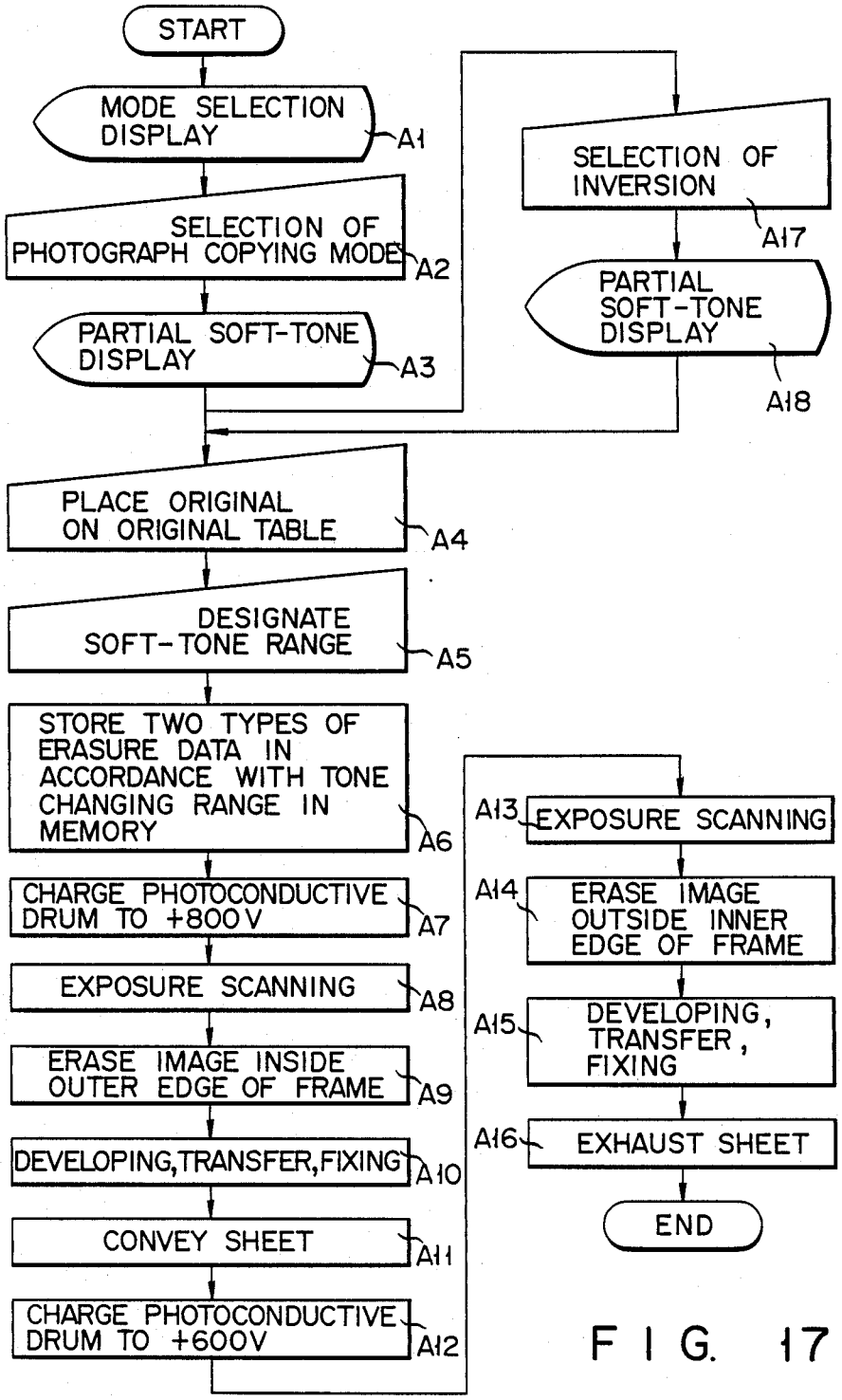
FIG. 17 is a flow chart for explaining a copying operation of an original.

The copying operation of the present invention with the above arrangement will be described with reference to the flow chart shown in FIG. 17.

Figure 18A:
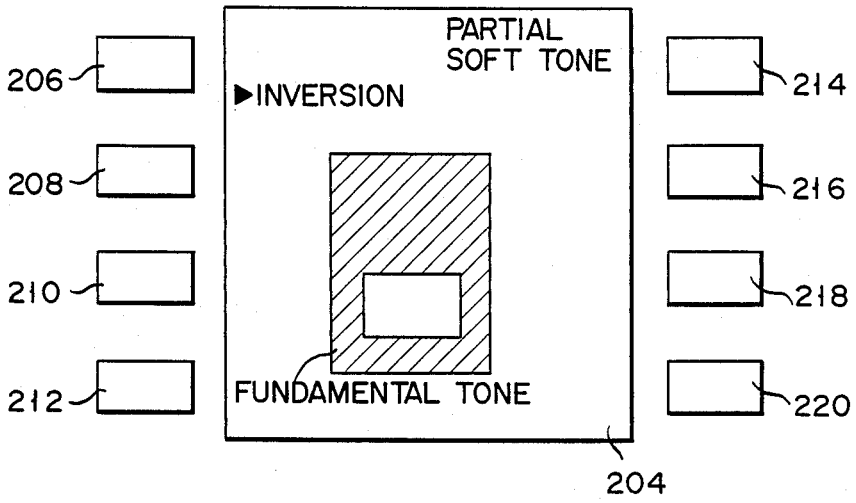

Assume that the trimming mode, masking mode, image move mode, edge erasure mode, and the like are displayed on display section 204. In this mode selection state (step A1), an operator selects a photograph copying (tone changing) mode by selection key 216 (step A2). A selection screen for inversion of tone change is displayed in correspondence with selection key 206 shown in FIG. 18A, and an original frame pattern and a designation range pattern (pattern frame) are displayed at the same time (step A3). In this case, a fundamental tone (rough tone) portion is displayed to perform partial soft-tone display.

The operator places original O on which image is formed to face down on original table 12 (step A4). The operator then designates points $S_1$ and $S_2$ as a tone changing range on original O using operation keys 222, 224, 226, and 228, and position designation key 230 (step A5). Then, main processor 80 performs calculations based on inner and outer frames Wa and Wb, i.e., coordinate positions of points $S_1''$ and $S_2''$ and those of points $S_1'$ and $S_2'$ of frame W designated by spot light source 300. In memory 106, HIGH-level signals are stored as erasure data for a photograph (soft tone) portion at addresses corresponding to a portion inside outer edge Wb of frame W defined by spot light source 300, and LOW-level signals are stored at addresses corresponding to a portion outside outer edge Wb defined by spot light source 300, as shown in FIG. 11A. Similarly, as erasure data for a rough-tone portion, HIGH-level signals are stored at addresses corresponding to a portion outside inner edge Wa of frame W defined by light source 300, and LOW-level signals are stored at addresses corresponding to a portion inside inner edge Wa of frame W by light source 300, as shown in FIG. 11B (step A6).

Figure 20:
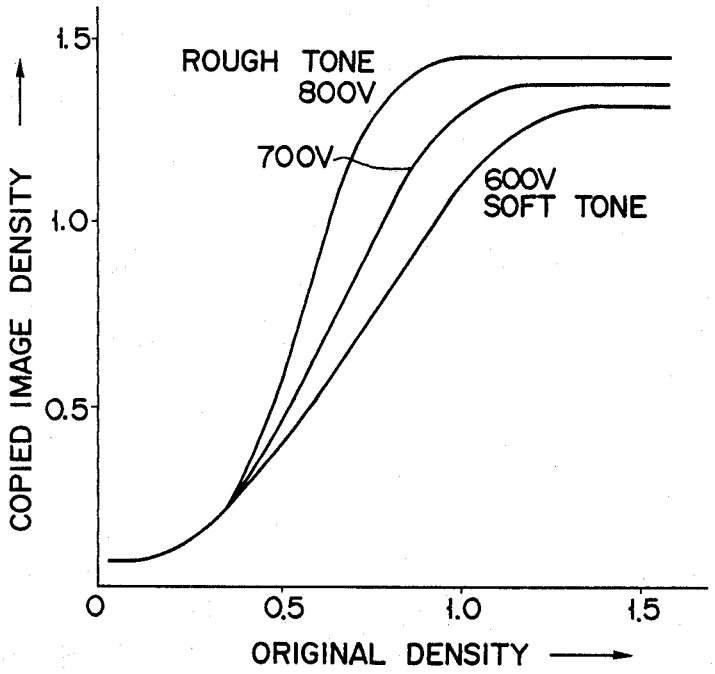
FIG. 20 is a graph showing the relationship between an original image density and a copied image density in accordance with a surface potential of the photoconductive drum.

In this embodiment, charger 38 receives a power supply voltage from power supply circuit 88. Photoconductive drum 36 is charged to +800 V or +600 V by charger 38. A charging voltage (surface potential) of drum 36 is changed by corona discharge, so that a copied image density is changed with respect to an original density, as shown in FIG. 20. If the charging voltage of drum 36 is +800 V, a saturated image density is high, and a rough-tone image which has a narrow dynamic range with respect to a developing density and a large $\gamma$ value is obtained. However, if an original has a high background density and a low contrast, a high-contrast image free from fogging can be obtained by adjusting exposure. If the charging voltage of drum 36 is +600 V, a soft-tone image which has a small $\gamma$ value and a wide dynamic range with respect to an original density can be obtained, and this mode is suitable for copying a continuous tone object such as a photograph. That is, an apparent tone property is improved, and half-tone reproduction can be satisfactorily performed.

If copy key 202 is depressed in the state of step A6, main processor 80 controls switching circuit 84. Upon this switching control, the power supply voltage of power supply circuit 88 is switched to a high voltage, and drum 36 is charged to 800 V by charger 38 (step A7). Thereafter, a copying operation of a portion other than a tone changing portion of original O is performed using developer 402 and erasure array 110. More specifically, first carriage 302 is moved to perform exposure scanning of original O (step A8).

Upon this operation, erasure data of the photograph (soft tone) portion shown in FIG. 11A is supplied from memory 106 to array driver 108. Erasure array 110 is operated in accordance with the erasure data, and a charge corresponding to a portion inside outer edge Wb of frame W is removed from drum 36 (step A9).

Figure 21A:
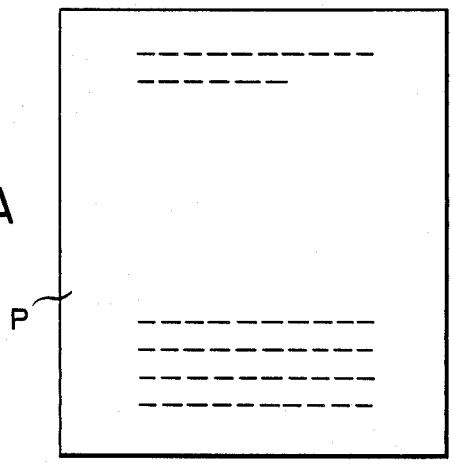

Therefore, when the image is developed and transferred, a high-contrast image of only a portion other than a range surrounded by outer edge Wb of frame W and having a large $\gamma$ value (characteristic curve for 800 V shown in FIG. 20) can be copied on paper sheet P, as shown in FIG. 21A (step A10). Thereafter, copied sheet P is conveyed again to the transfer section by multiple copying unit 78 (step A11).

Main processor 80 switches switching circuit 84. Upon this switching control, the power supply voltage of power supply circuit 88 is set to be a low voltage, and drum 36 is charged to 600 V (step A12). Then, a copying operation of the tone changing portion of original O is performed using developer 402 and erasure array 110. More specifically, first carriage 302 is moved to perform exposure scanning of original O (step A13).

With this operation, erasure data of the rough-tone portion shown in FIG. 11B is supplied from memory 106 to array driver 108, and erasure array 110 is driven in accordance with the erasure data. With this operation, a charge corresponding to a portion outside inner edge Wa of frame W is removed from drum 36 (step A14).

Figure 21B:
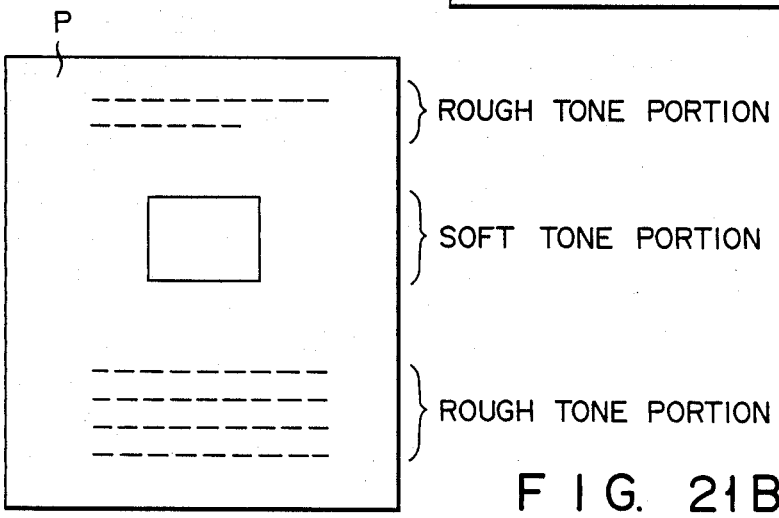

Therefore, a soft-tone (small $\gamma$ value; characteristic curve for 600 V in FIG. 20) image of a portion of a range surrounded by inner edge Wa of frame W on original O is formed on the surface of drum 36 with high photograph reproducibility (step A15). In synchronism with this operation, paper sheet P conveyed to the transfer unit is fed by multiple copying unit 78, and the image of the range surrounded by inner edge Wa of frame W is transferred onto paper sheet P. As shown in FIG. 21B, an image of a portion of original O other than a range surrounded by outer edge Wb of frame W is formed as a soft-tone image, and an image of a portion inside the range surrounded by inner edge Wa of frame W is formed as a rough-tone image on paper sheet P. Sheet P is fed to exhaust tray 70 via exhaust roller 68 (step A16).

In this manner, an image of a soft-tone photograph can have a good tone property, and an image of rough-tone characters can have a high contrast. Thus, a clear copied image which is easy to see can be obtained. Upon tone changing operation, images do not overlap each other but can be clearly copied.

Figure 18B:
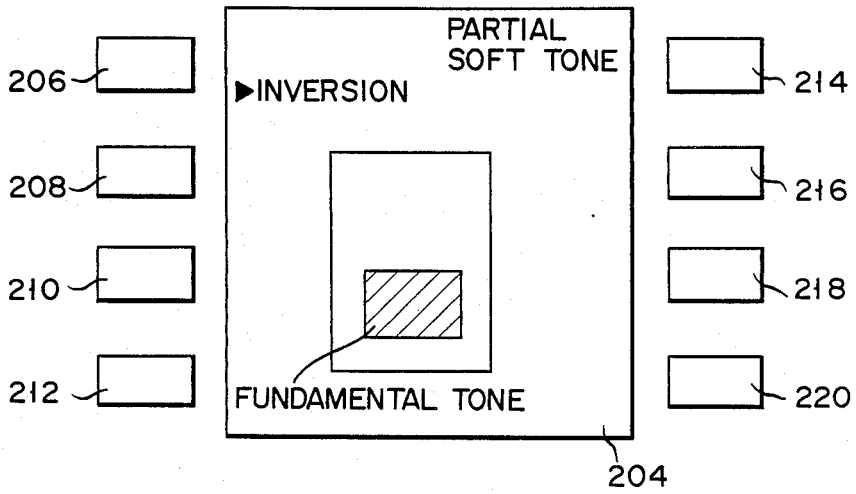
Figure 19:
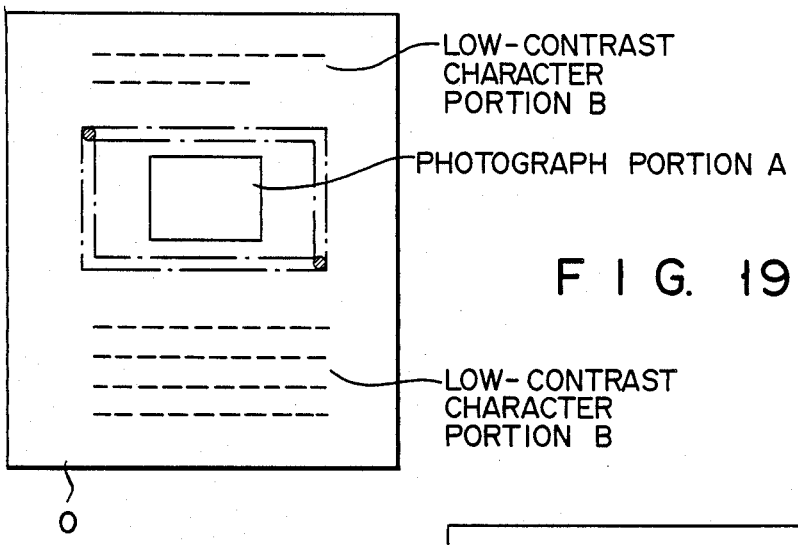
FIG. 19 is a view showing an original subjected to a partial tone copying mode.

The operator depresses selection key 206 in accordance with display of step A3, thereby selecting an inversion mode (step A17). Display section 204 displays a portion inside the pattern frame, thereby performing a partial tone display, as shown in FIG. 18B (step A18). Thereafter, the operation of steps A4 to A18 is performed. In this manner, an image of a soft-tone photograph can have a good tone property, and an image of rough-tone characters can have a high contrast. Thus, a clear copied image which is easy to see can be obtained.

When a tone changing operation of a photograph portion is to be performed, i.e., when a predetermined portion of an original is copied in a different tone (soft-tone) mode, a portion inside the designated range is erased and the surface potential of the photoconductive drum is charged to +800 V during the first copying operation. During the second copying operation, a portion outside the designated range is erased, and the surface potential of the photoconductive drum is charged to +600 V. Therefore, an image of a soft-tone photograph can have a good tone property, and an image of rough-tone characters can have a high contrast. Thus, a clear copied image which is easy to see can be obtained.

A tone changing range can be easily designated by using a light spot, resulting in good operability.

In the first embodiment, the erasure array is used to erase a designated range for which a tone property is to be changed. In a second embodiment described below, an LED array and a liquid crystal array are used as the tone changing means. A description of the same arrangement and operation as those in the first embodiment will be omitted.

Figure 22A:
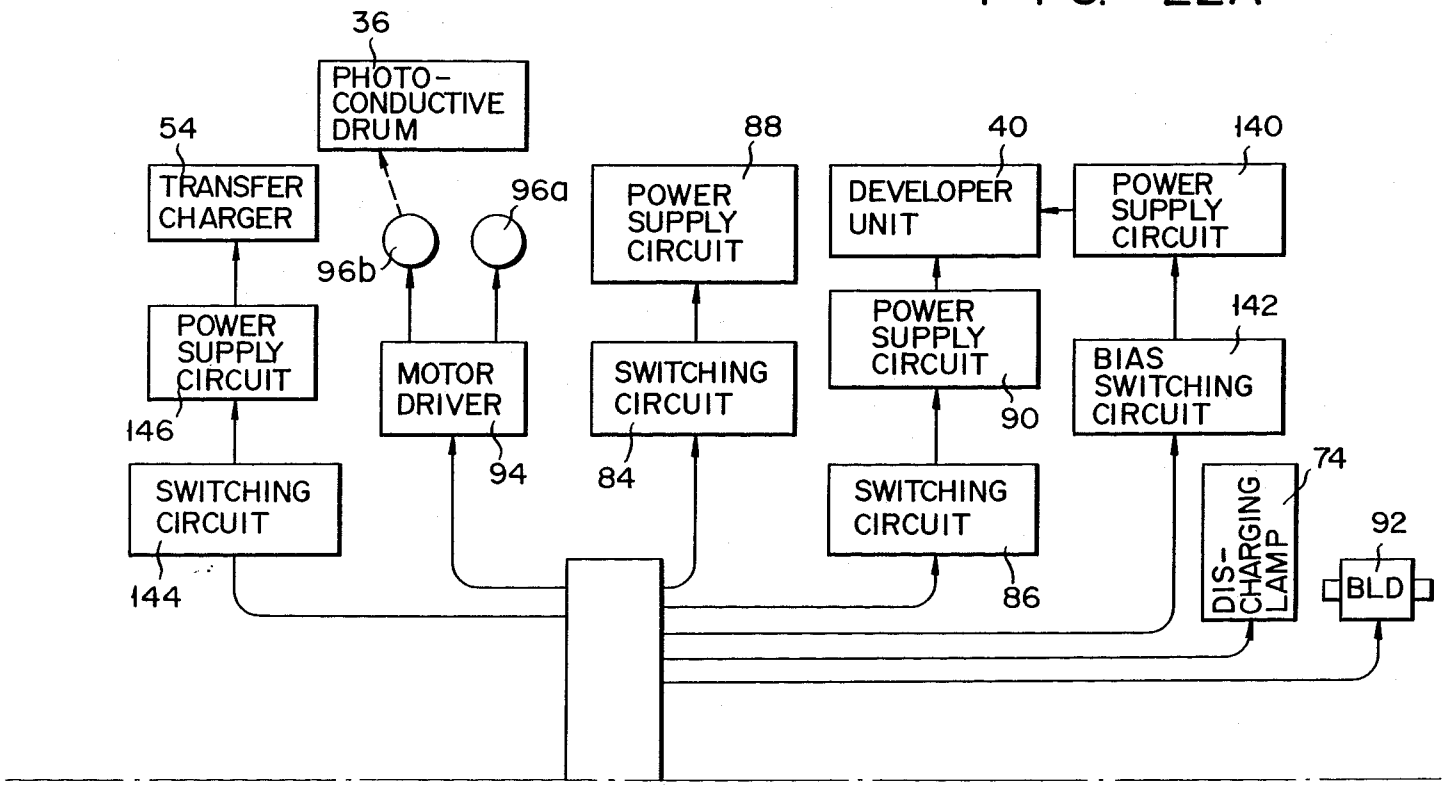
FIGS. 22A and 22B are a schematic block diagram showing the entire control circuit according to a second embodiment of the present invention.
Figure 22B:
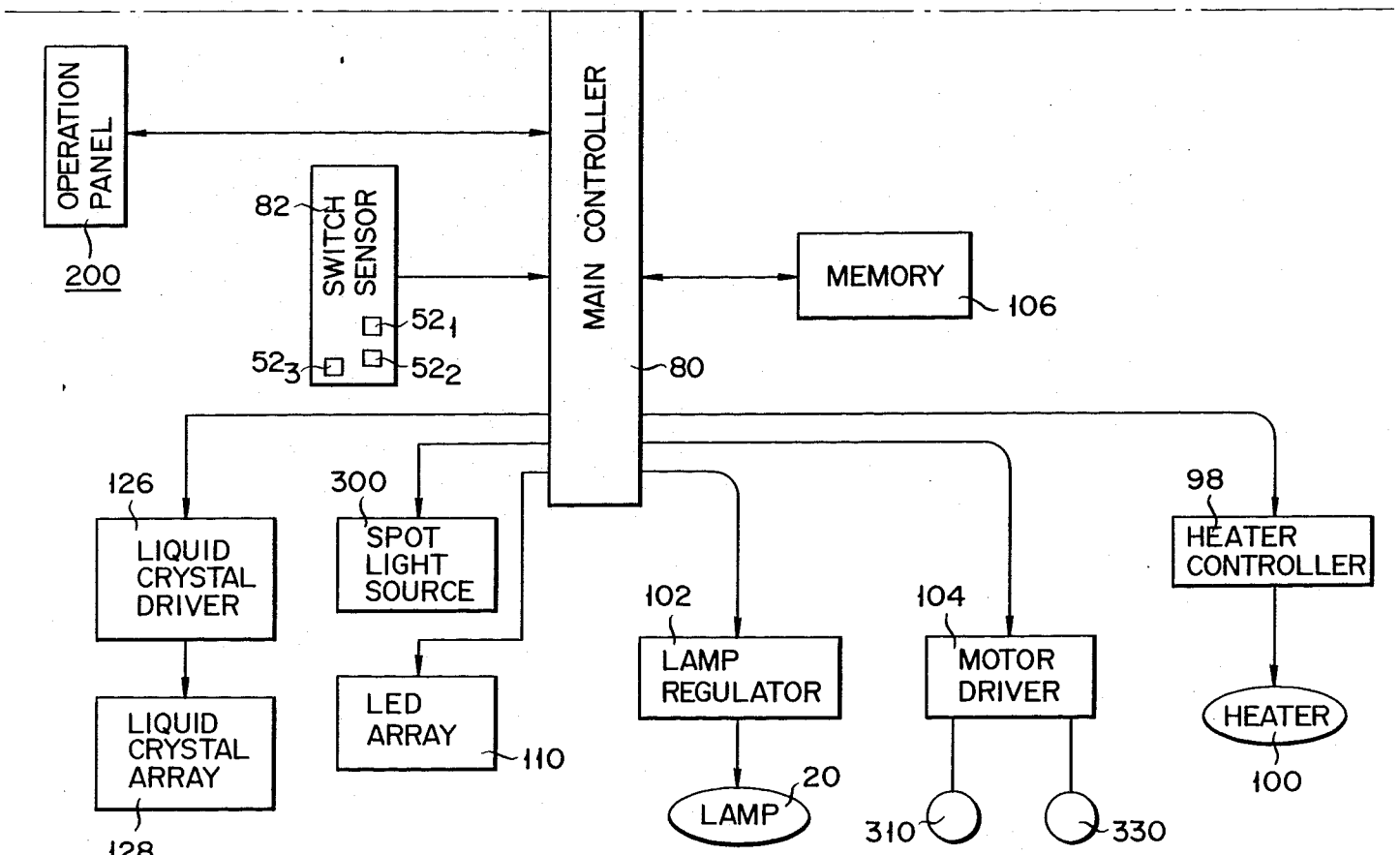

Referring to FIGS. 22A and 22B, LED (light emitting diode) array 11 is controlled by main processor 80 through liquid crystal driver 126. Liquid crystal array 128 is also controlled by main processor 80.

Figure 23:
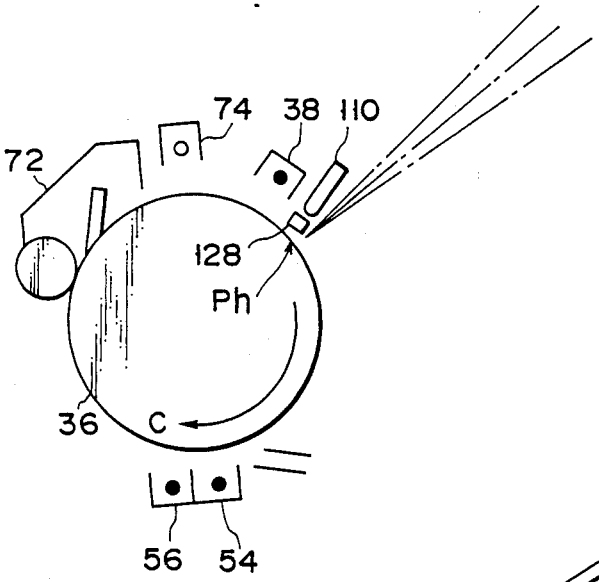
FIG. 23 is a schematic side sectional view showing an arrangement of an LED array and a liquid crystal array.

As shown in FIG. 23, LED array 110 and liquid crystal array 128 as the erasure/tone changing means are arranged adjacent to each other on photoconductive drum 36 between charger 38 and exposure portion Ph.

Figure 24:
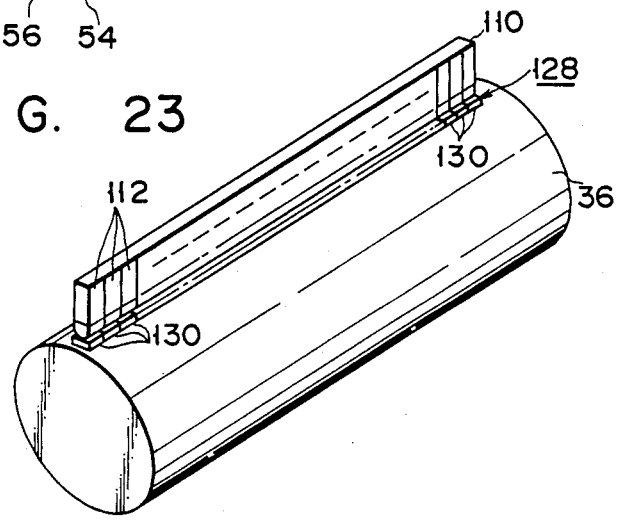
FIGS. 24 and 25 are respectively a schematic perspective view and a schematic front view showing the positional relationship between the LED array and a photoconductive drum.
Figure 25:
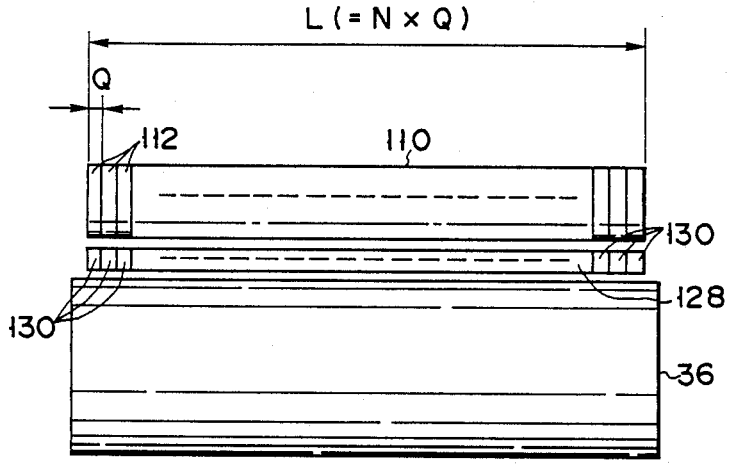

Liquid crystal array 128 is provided between LED array 110 and photoconductive drum 36, as shown in FIGS. 24 and 25, and a plurality of liquid crystal elements 130 are disposed on a glass substrate (not shown) to face light emitting elements 114 (see FIGS. 15A and 15B) in LED array 110. The number of liquid crystal elements 130 disposed in array 128 coincides with the number of light emitting elements 114. Liquid crystal array 128 changes an amount of transmission light of discharging light from corresponding LED array 110 (light emitting elements 114) by liquid crystal contrast adjustment.

Figure 26:
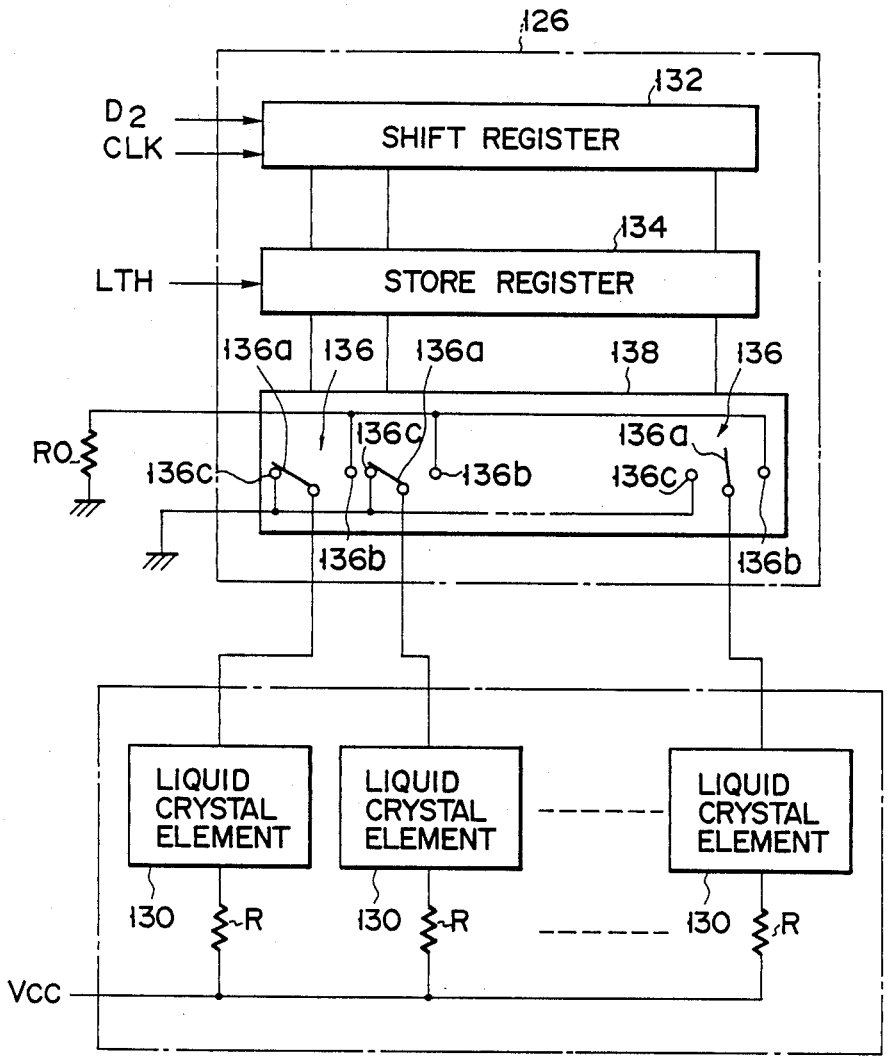
FIG. 26 is a circuit diagram showing an arrangement of a liquid crystal driver.

Liquid crystal array 128 is driven by liquid crystal driver 126. Liquid crystal driver 126 comprises shift register 132 having the same number of bits as that in the column direction of memory 106, store register 134 for storing the content of shift register 132, and switch circuit 138 comprising a plurality of switch elements 136 which are turned on/off in response to output signals from store register 134 and switching signals (erasure signal and tone changing signal) from main processor 80, as shown in FIG. 26. Movable contact **136*a* of each switch element 136 is connected to one end of a corresponding one of liquid crystal elements 130 constituting liquid crystal array 128. The other end of each liquid crystal element 130 is connected to power supply Vcc through current-limiting resistor R. Fixed contact 136*b* is grounded through resistor RO, and fixed contact 136*c*** is grounded.

When movable contact **136*a* is connected to fixed contact 136*b*, liquid crystal element 130 receives voltage Vs voltage-divided by resistors R and RO. Thus, upon liquid crystal contrast adjustment of this liquid crystal element 130, light amount La corresponding to part of light emitted from element 114 is transmitted. When movable contact 136*a* is connected to fixed contact 136*c*, liquid crystal element 130 receives voltage $V_{ER}$ voltage-divided by resistor R. Thus, upon liquid crystal contrast adjustment of this element 130, light amount Lb (La<Lb) emitted from corresponding light emitting element 114 is directly transmitted. When movable contact 136*a* is connected to neither fixed contact 136*b* nor 136*c* (is opened), light emitted from corresponding light emitting element 114 is shielded by liquid crystal contrast adjustment of liquid crystal element 130**.

Voltage Vs is selected by resistor RO such that light amount La transmitted through liquid crystal element 130 is 90% to 50% of light amount Lb.

After the erasure range or tone changing range of original O is designated, original cover 16 is closed, and copy key 202 is depressed. First carriage 302 and photoconductive drum 36 are operated, and one-line data in the row direction is sequentially read out from memory 106 (FIGS. 11A or 11B). Readout data $D_2$ is transferred to shift register 132 of liquid crystal driver 126 in response to clock signal CLK. After one-line data is transferred to shift register 132, when a charged portion of drum 36 has reached LED array 110, latch signal LTH is output from main processor 80. Then, the storage data in shift register 132 is supplied to store register 134 in accordance with latch signal LTH. More specifically, since a discharging (surface potential changing) position by LED array 110 is located between charger 38 and exposure portion Ph, the output timing of latch signal LTH is controlled such that one-line data output from memory 106 is supplied to store register 134 before $\theta_1/\omega$ if an angle defined between LED array 110 and exposure portion Ph is $\theta_1$ and drum 36 is rotated at an angular velocity of $\omega$.

Each switch element 136 of switch circuit 138 is controlled by the output signal from store register 134. More specifically, in a state wherein a tone changing signal is supplied as a switching signal from main processor 80 (i.e., in the photograph copying mode), when store register 134 outputs a HIGH-level output signal, movable contact **136*a* is connected to fixed contact 136*b*. When register 134 outputs a LOW-level output signal, movable contact 136*a* is opened. As a result, when movable contact 136*a* of switch element 136 is connected to fixed contact 136*b*, liquid crystal element 130 connected to each switch element 136 allows light amount La corresponding to part of light emitted from corresponding light emitting element 114 to pass therethrough. Meanwhile, when movable contact 136*a* is opened, light emitted from element 114** is shielded.

Therefore, a portion of the charged portion of drum 36, which is irradiated with part of light emitted from light emitting elements 114, i.e., light amount La, is slightly discharged, that is, the surface potential of this irradiated portion is slightly decreased. A latent image of a low-potential step is formed on this portion with the decreased surface potential by exposure performed later. Thus, this is equivalent to a tone changing operation of an original image. Thereafter, one-line data is similarly read out from memory 106, and slight discharging is performed.

In a state wherein an erasure signal is supplied as the switching signal from main processor 80 (i.e., in the trimming or masking mode), when store register 134 outputs a HIGH-level output signal, movable contact **136*a* is connected to fixed contact 136*c*; when it outputs a LOW-level signal, movable contact 136*a* is opened. As a result, when movable contact 136*a* of switch element 136 is connected to fixed contact 136*c*, corresponding liquid crystal element 130 allows light amount Lb of light emitted from light emitting element 114 to pass therethrough. In contrast to this, when movable contact 136*a* is opened, light emitted from light emitting element 114** is shielded.

Therefore, a portion of the charged portion of drum 36, which is irradiated with light amount Lb from light emitting elements 114 is completely discharged. No latent image is formed on the discharged portion by exposure performed thereafter, and the portion of the original image is erased. Thereafter, one-line data is similarly read out from memory 106, and image erasure is performed.

A discharging amount of the surface potential on drum 36 by LED array 110 and liquid crystal array 126, i.e., light amount La transmitted through liquid crystal array 126, is about 5 to 50% of an image exposure amount. Thus, a toner density in a partial tone region is not decreased.

Figure 27:
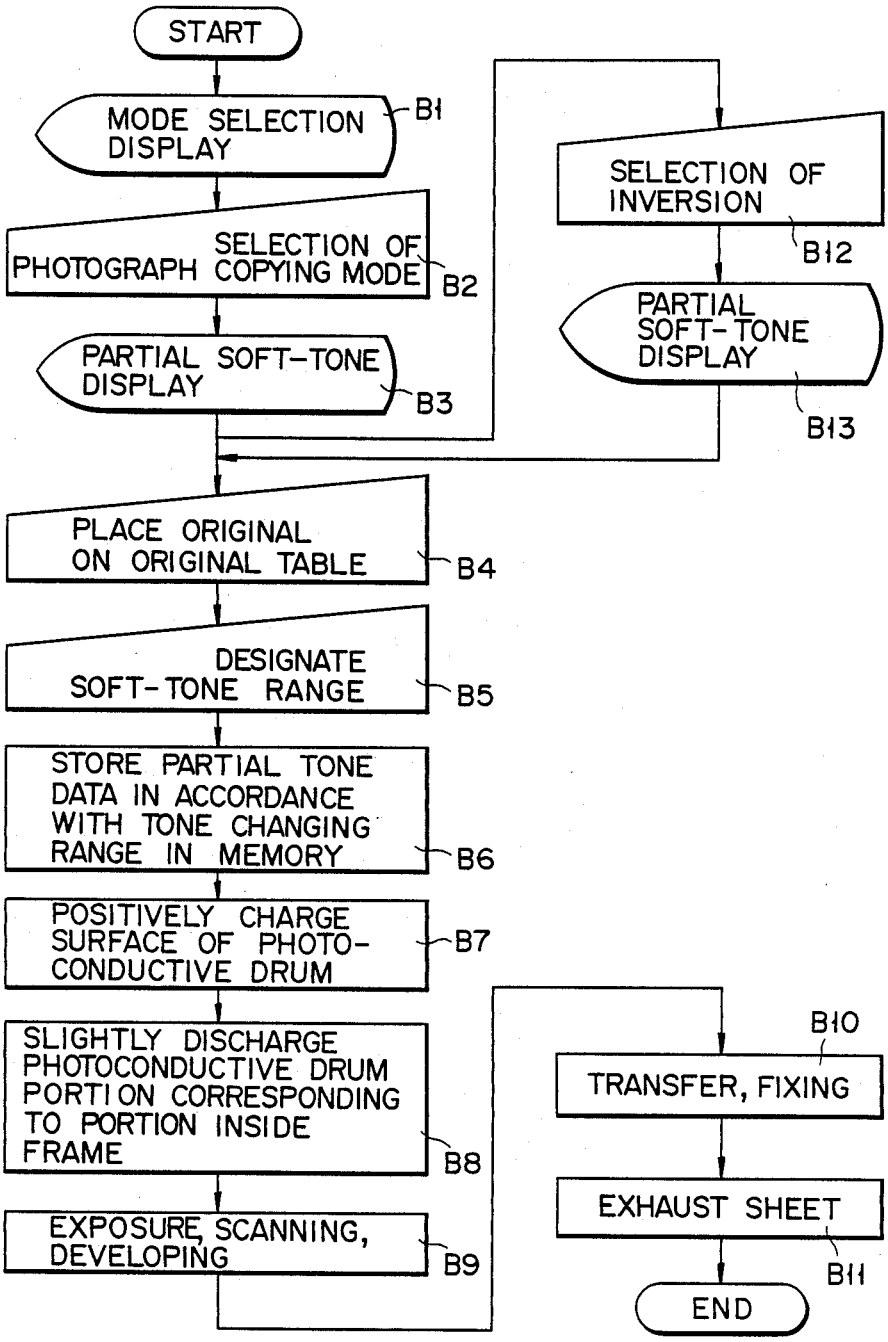
FIG. 27 is a flow chart for explaining a copying operation of an original of the second embodiment.

The copying operation according to the second embodiment will be described with reference to the flow chart shown in FIG. 27. Steps B1 to B5 in the flow chart of FIG. 27 are the same as steps A1 to A5 in the flow chart (FIG. 17) of the first embodiment, and a description thereof will be omitted.

When a tone changing range on original O is designated in step B5, main processor 80 performs calculations based on inner and outer edges Wa and Wb of frame W, i.e., coordinate positions of points $S_1''$ and $S_2''$ and those of points $S_1'$ and $S_2'$ of the range designated by spot light source 300. In memory 106, HIGH-level signals are stored as partial tone data of a photograph (soft tone) portion at addresses corresponding to a portion inside outer edge Wb of frame W designated by spot light source 300, and LOW-level signals are stored at addresses corresponding to a portion outside outer edge Wb of frame W designated by light source 300, as shown in FIG. 11A. Similarly, as erasure data of a rough-tone portion, HIGH-level signals are stored at addresses corresponding to a portion outside inner edge Wa of frame W designated by light source 300, and LOW-level signals are stored at addresses corresponding to a portion inside inner edge Wa of frame W designated by light source 300, as shown in FIG. 11B (step B6).

When copy key 202 is depressed in this state, a copying operation of original O is performed using developer 402, LED array 110, liquid crystal array 128, and the like. More specifically, the surface of photoconductive drum 36 is uniformly and positively charged by charger 38 (step B7).

Light emitting elements 114 of LED array 110 are turned on, and partial tone data of the photograph (soft tone) portion shown in FIG. 11A is supplied from memory 106 to liquid crystal driver 126. Liquid crystal array 128 is operated in accordance with the partial tone data, and a charge corresponding to the portion inside outer edge Wb of frame W is slightly discharged from drum 36 (step B8). Thereafter, exposure scanning and developing for original O are performed (step B9).

With this operation, on the surface of drum 36, a soft-tone image of a portion of original O corresponding to a range surrounded by inner edge Wa of frame W is formed with high photograph reproducibility, and a high-contrast (rough-tone) image of a portion other than the range surrounded by outer edge Wb of frame W is formed. When the image on drum 36 is transferred, only a portion of original O other than a range surrounded by outer edge Wb of frame W is copied in the partial tone mode on paper sheet P, and the other portion is copied in a fundamental tone mode, as shown in FIG. 21B (step B10).

Therefore, a rough-tone image of a portion of original O other than the range surrounded by outer edge Wb of frame W is formed on paper sheet P, and a soft-tone image of a portion inside the range surrounded by inner edge Wa of frame W is formed thereon. Sheet P is then exhausted onto exhaust tray 70 via exhaust roller pair 68 (step B11).

In this manner, an image of a soft-tone photograph portion has a good tone property, and an image of a rough-tone character portion has a high contrast. Thus, a clear image which is easy to see can be copied. Upon a tone changing operation, images do not overlap each other, but can be clearly copied.

The operator depresses selection key 206 to select an inversion mode in accordance with the display in step B3 (step B12). Display section 204 then performs a partial tone display such that a portion inside a pattern frame is displayed, as shown in FIG. 18B (step B13). Thereafter, the operation of steps B4 to B11 is performed. As a result, an image of a soft-tone photograph portion has a good tone property, and an image of a rough-tone character portion has a high contrast. Thus, a clear image which is easy to see can be copied. The selection of the inversion mode may be performed after the tone changing range is designated.

When image erasure of a predetermined range is performed in the trimming mode, the same operation as described above is performed. In this case, a charge in the predetermined range is completely discharged from drum 36 by LED array 110 and liquid crystal array 128, thereby erasing an image.

When a tone changing operation of a photograph portion is to be performed, i.e., when a predetermined portion of an original is copied in a different tone (soft tone) mode, the surface potential on the photoconductive drum is slightly decreased by light radiation onto the drum which is controlled by the liquid crystal elements. Thus, a portion inside a designated range is slightly discharged (developing characteristics are partially changed) to copy an image. Therefore, an image of a soft-tone photograph portion has a good tone property, and an image of a rough-tone character portion has a high contrast. Thus, a clear image which is easy to see can be copied. In this case, since soft- and rough-tone portions can be copied by a single copying process, the copying process can be simplified.

The erasure operation of images having different discharging amounts from the photoconductive drum and the tone changing operation can be performed commonly by a set of discharging elements and liquid crystal elements, thus simplifying the arrangement.

In this embodiment, a combination of the LED array and the liquid crystal array is used as the tone changing means. However, the present invention is not limited to this. For example, a combination of a fluorescent lamp or a cold cathode discharge tube and a liquid crystal array may be employed. In the second embodiment, the tone changing operation and the erasure operation are separately performed. However, these operations may be performed at the same time. That is, a mode for changing a tone of one range and erasing an image of another range may be provided.

In the second embodiment, the LED array and the liquid crystal array are arranged between the charger and an image exposure position but may be arranged between the image exposure position and a developing position. In addition, the erasure operation and the tone changing operation are performed by a set of discharging elements and liquid crystal elements. However, the present invention is not limited to this. For example, these operations may be performed by separate sets of discharging elements and liquid crystal elements.

In the first and second embodiments, a charge in a predetermined range on the photoconductive drum is adjusted using the erasure array, the LED array, the liquid crystal array, and the like, thereby performing a tone changing operation. In a third embodiment described below, a rotational frequency of a developing sleeve in a developer is changed, thereby performing a tone changing operation.

Figure 28:
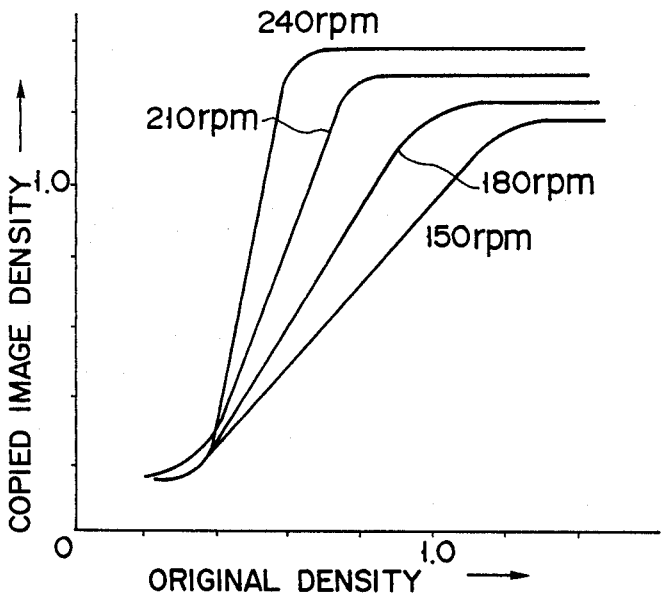
FIG. 28 is a graph showing the relationship between an original image density and a copied image density in accordance with a rotational speed of a developing sleeve according to a third embodiment of the present invention.

More specifically, the rotational frequency of developing sleeve 404 in developer 402 shown in FIG. 5 is changed, so that a copied image density with respect to an original density is changed, as shown in FIG. 28. When the rotational frequency of developing sleeve 404 is relatively high, e.g., 240 rpm, a saturated image density is high, and a rough-tone image which has a narrow dynamic range with respect to a developing density and a large $\gamma$ value is obtained. However, if an original has a high background density and a low contrast, a high-contrast image free from fogging can be obtained by exposure adjustment.

In contrast to this, when the rotational frequency of sleeve 404 is relatively low, e.g., 150 rpm, a soft-tone image which has a small $\gamma$ value (about 1.0) and a wide dynamic range with respect to an original density can be obtained, and this mode is suitable for copying a continuous-tone object such as a photograph.

Developing sleeve 404 is rotated by motor 96*a*. Motor 96*a* is controlled by main processor 80 through motor driver 94. Upon this control (switching control), sleeve 404 can be rotated at 240 or 150 rpm.

Other arrangements and operations are the same as those in the first embodiment, and a description thereof will be omitted.

Figure 29:
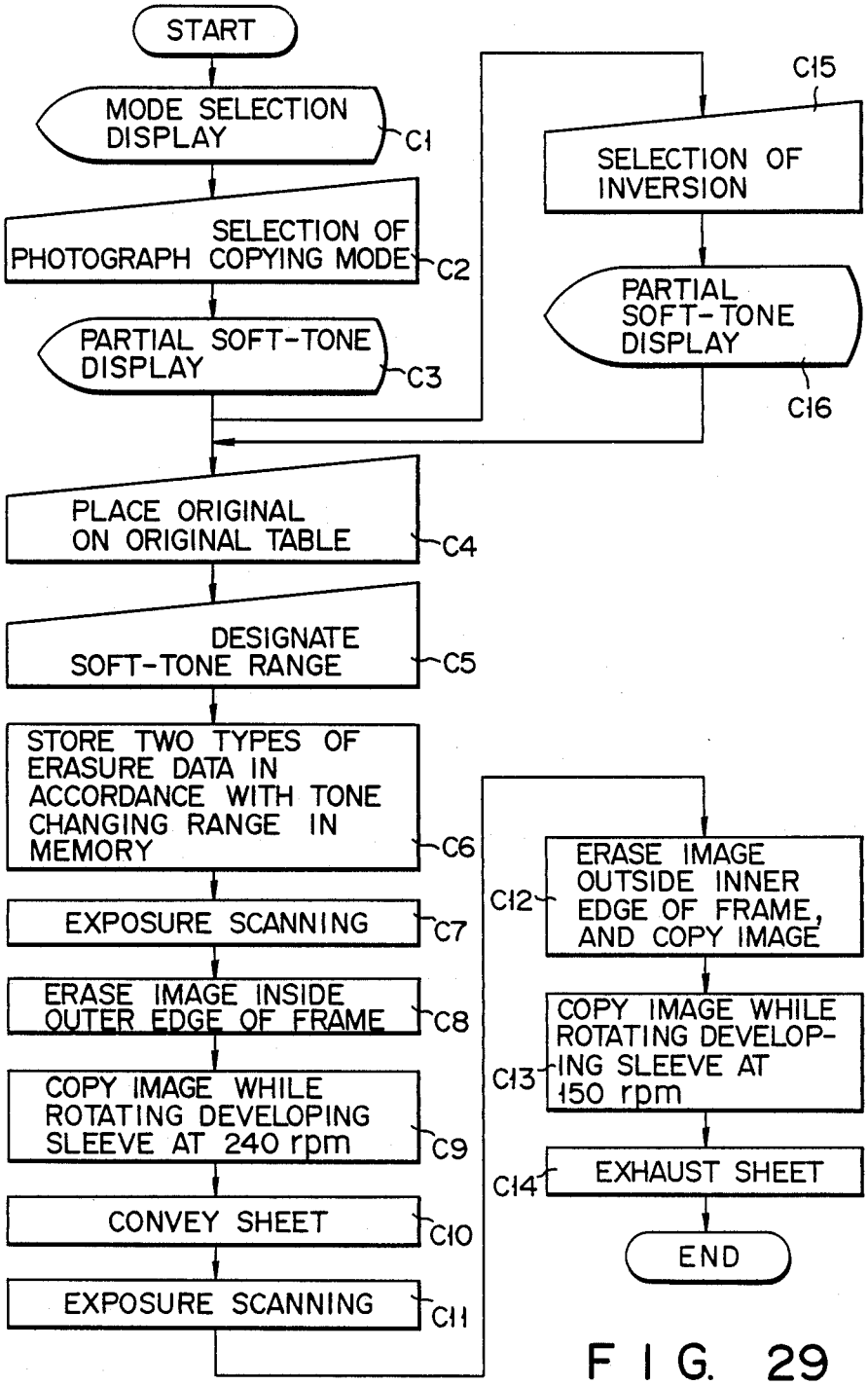
FIG. 29 is a flow chart for explaining a copying operation of an original of the third embodiment.

The copying operation of the third embodiment will be described with reference to the flow chart shown in FIG. 29. In the flow chart of FIG. 29, steps C1 to C6 are the same as steps A1 to A6 in the flow chart (FIG. 17) of the first embodiment, and a description thereof will be omitted.

When copy key 202 is depressed in the state of step C6, a copying operation of a portion other than a tone changing portion of original O is performed using developer 402 and erasure array 110. More specifically, first carriage 302 is moved to perform exposure scanning of original O (step C7).

With this operation, erasure data of a photograph (soft tone) portion shown in FIG. 11A is supplied from memory 106 to array driver 108. Erasure array 110 is operated in accordance with the erasure data, and a charge of a portion inside outer edge Wb of frame W is removed from photoconductive drum 36 (step C8). In this case, the rotation of motor 96 is controlled by main processor 80, so that developing sleeve 404 is rotated at a rotational frequency of 240 rpm (step C9).

Figure 30:
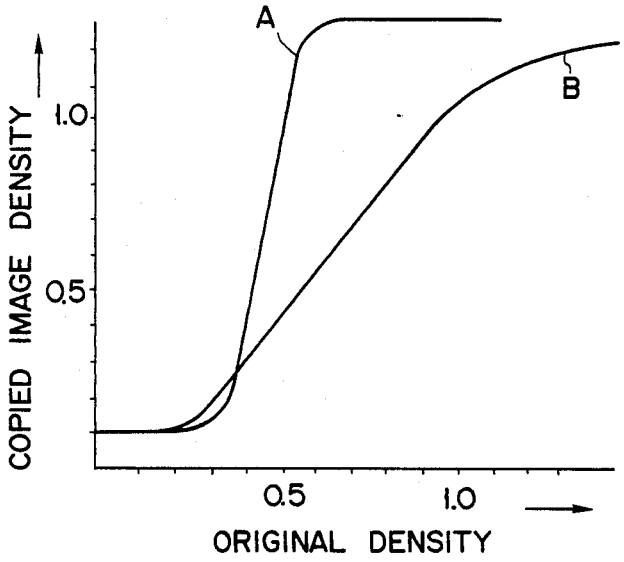
FIG. 30 is a graph showing the relationship between an original image density and a copied image density in accordance with a $\gamma$ value.

Therefore, after an image of original O is developed and transferred, a high-contrast image having a large $\gamma$ value (characteristic curve A in FIG. 30) of only a portion of original O other than the range surrounded by outer edge Wb of frame W is copied on paper sheet P, as shown in FIG. 21A. Thereafter, copied sheet P is conveyed again to the transfer section by multiple copying unit 78 (step C10).

A copying operation of the tone changing portion of original O is then performed using developer 402 and erasure array 110. More specifically, first carriage 302 is moved to perform exposure scanning of original O (step C11).

With this operation, erasure data of a rough-tone portion shown in FIG. 11B is supplied from memory 106 to array driver 108, and erasure array 110 is operated in accordance with the erasure data. Thus, a charge of a portion outside inner edge Wa of frame W is removed from drum 36 (step C12). In this case, the rotation of motor 96 is controlled by main processor 80, so that developing sleeve 404 is rotated at a rotational frequency of 150 rpm (step C13).

Therefore, a soft-tone image (small $\gamma$ value; characteristic curve B shown in FIG. 30) of a portion of original O corresponding to the range surrounded by inner edge Wa of frame W is formed on the surface of drum 36 with high photograph reproducibility. In synchronism with this operation, paper sheet P conveyed to the transfer section by multiple copying unit 78 is fed, and an image of the portion of the range surrounded by inner edge Wa of frame W is transferred to sheet P. As shown in FIG. 21B, a rough-tone image of a portion of original O other than the range surrounded by outer edge Wb of frame W, and a soft-tone image of a portion of the range surrounded by inner edge Wa of frame W are formed on paper sheet P. Sheet P is then exhausted onto exhaust tray 70 via exhaust roller pair 68 (step C14).

In this manner, an image of a soft-tone photograph has a good tone property, and an image of a rough-tone character portion has a high contrast. Thus, a clear image which is easy to see can be copied. Images do not overlap each other during the tone changing operation, and can be clearly copied.

The operator depresses selection key 206 in accordance with the display of step C3, thereby selecting an inversion mode (step C15). Display section 204 displays a portion inside a pattern frame, as shown in FIG. 18*b*, thereby performing a partial tone display (step C16). Thereafter, the operation of steps C4 to C14 is performed. As a result, an image of a soft-tone photograph has a good tone property, and an image of a rough-tone character portion has a high contrast. Thus, a clear image which is easy to see can be copied.

When a tone changing operation of a photograph portion is to be performed, i.e., when a predetermined portion of an original is copied in a different tone (soft tone) mode, a portion inside a designated range is erased and the developing sleeve is rotated at 240 rpm to perform the first copying operation. Then, a portion outside the designated range is erased and the developing sleeve is rotated at 150 rpm to perform the second copying operation. Therefore, an image of a soft-tone photograph has a good tone property, and an image of a rough-tone character portion has a high contrast. Thus, a clear image which is easy to see can be copied.

A tone changing range can be easily designated by a light spot, resulting in good operability.

A fourth embodiment will be described below. In this embodiment, the position of a developing main pole of stationary magnetic poles in a developing sleeve is changed so as to perform a tone changing operation.

Figure 31:
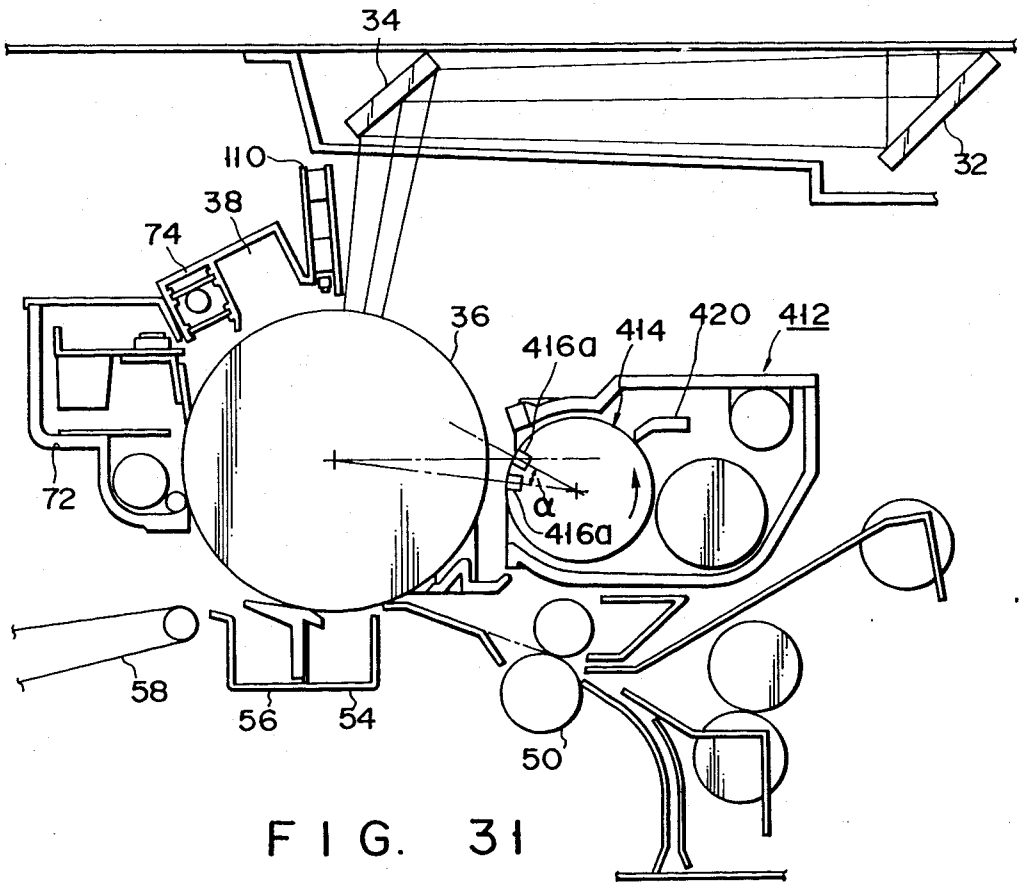
FIG. 31 is a side sectional view showing an arrangement of a photoconductive drum and a developer according to a fourth embodiment of the present invention.

FIG. 31 shows components around developer 412 constituting developer unit 40 (FIG. 2) and photoconductive drum 36 according to the fourth embodiment. Developer 412 comprises developing sleeve 414 which is arranged to oppose photoconductive drum 36 and to be rotatable in a direction of an arrow in FIG. 31 and is formed of a nonmagnetic material, stationary magnetic poles 416 included in sleeve 414, stirring roller 418 for stirring a developing agent (toner) stored in developer 412, and blade 420 for regulating an amount of toner. A distance between developing sleeve 414 and blade 420 is 1.0 mm, and a distance between sleeve 414 and drum 36 is 1.2 mm. In the developing agent, a ferrite carrier having a particle size distribution of 150 to 300 mesh is used as a carrier, and negatively charging toner consisting of a styrene-acrylic resin having an average particle size of 10 $\mu$m is used as toner.

A tone changing means of an original will be described with reference to FIGS. 31, 32A, 32B, 32C, 32D, 32E, 33A, 33B and 34.

Figure 32A:
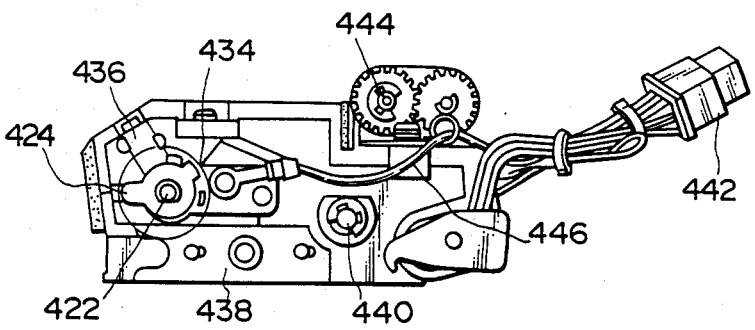
FIGS. 32A, 32B, 32C, 32D, and 32E are schematic views showing an arrangement of a pole position moving unit in a developing sleeve.
Figure 32B:
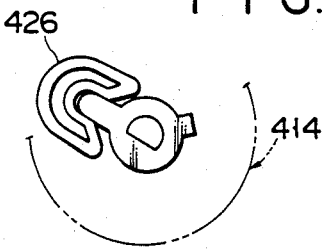

The position of developing main pole 416*a*, i.e., rotational angle α of developing sleeve 414 can be changed with respect to photoconductive drum 36. As shown in FIG. 32A, drive arm 424 is fixed to part of magnet shaft 422 of sleeve 414. Coupler 426 is engaged with drive arm 424, as shown in FIGS. 32B and 32C. Coupler 426 is engaged with solenoid armature 428. Return spring 432 has one end hooked at the outer wall of solenoid 430 and the other end engaged with coupler 426. Note that reference numeral 434 denotes a main pole position adjusting plate; 436, a stop, 438, a developer stopper; 440, a stirring blade shaft; 442, a developer connector; 444, a feed roller shaft; and 446, a bias cord.

Figure 32D:
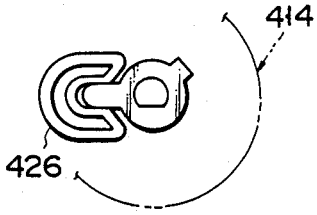
Figure 32C:
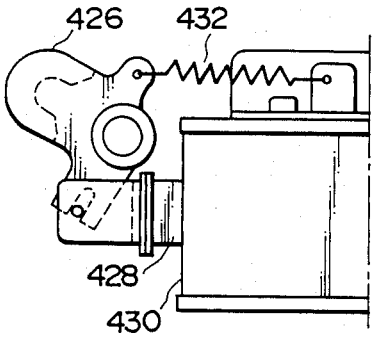
Figure 33A:
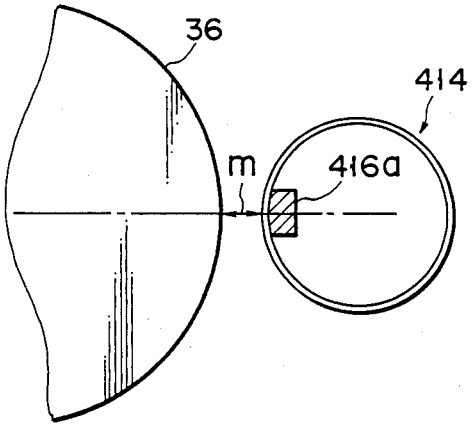

With this arrangement, armature 428 is moved to the right upon biasing of solenoid 430, as shown in FIG. 32C, and coupler 426, drive arm 424, and sleeve 414 are rotated counterclockwise. As shown in FIG. 33A, the center of main pole 416*a* of sleeve 414 coincides with the base line perpendicular to a depending line passing through the center of drum 36. In this case, a distance (minimum distance) between main pole 416*a* and drum 36 is given by m.

Figure 32E:
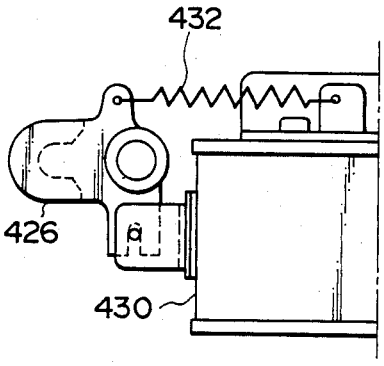
Figure 33B:
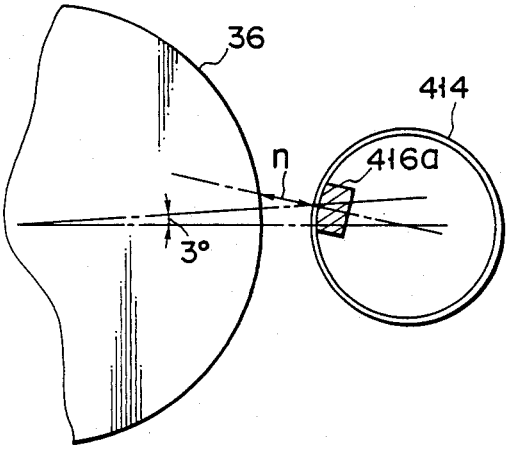

When solenoid 430 is deenergized, armature 428 is moved to the left, as shown in FIGS. 32D and 32E. With this operation, coupler 426 and drive arm 424 are engaged, and the central position of main pole 416*a* of sleeve 414 is offset from the base line by about 3 degrees (FIG. 33B). If a distance (minimum distance) between main pole 416*a* and drum 36 in this case is given by n, the relationship between distances m and n is represented by $m<n$.

Figure 34:
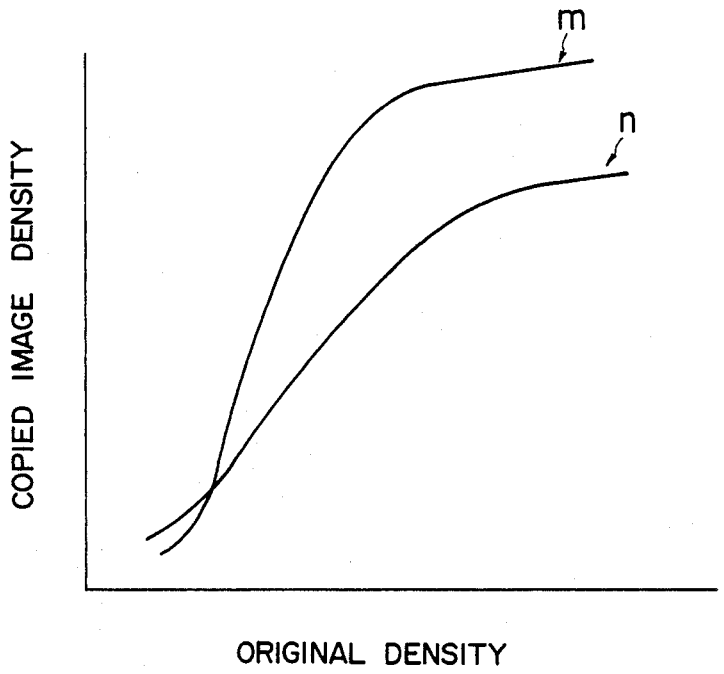
FIG. 34 is a graph showing the relationship between an original image density and a copied image density upon movement of a pole position.

When the position of main pole 416*a* is changed, the tone changing operation is performed, as shown in FIG. 34, and an image of a designated region can have a different tone based on data designated by spot light source 300 for designating a tone changing range of an original.

Figure 35:
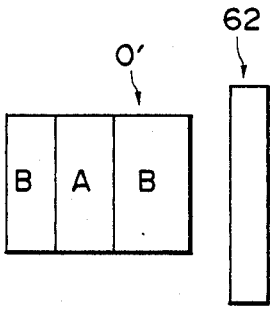
FIG. 35 is a view showing an image which is copied upon movement of a pole position.

Assume that the operator wants to perform a combined copying operation of original O′ shown in FIG. 35. For region B, development is performed while main pole 416*a* is set at the position shown in FIG. 33A. For region A of original O′, solenoid 430 is operated to move drive arm 424 upward, and development is performed while main pole 416*a* is set at the position shown in FIG. 33B. For region B of original O′, solenoid 430 is returned to a normal state and drive arm 424 is moved downward. Thus, development is performed while main pole 416*a* is set at the position shown in FIG. 33A.

Note that regions A and B of original O′ are designated by operating operation keys 222, 224, 226, 228, and 230. Solenoid 430 is operated in accordance with the designation.

Figure 36:
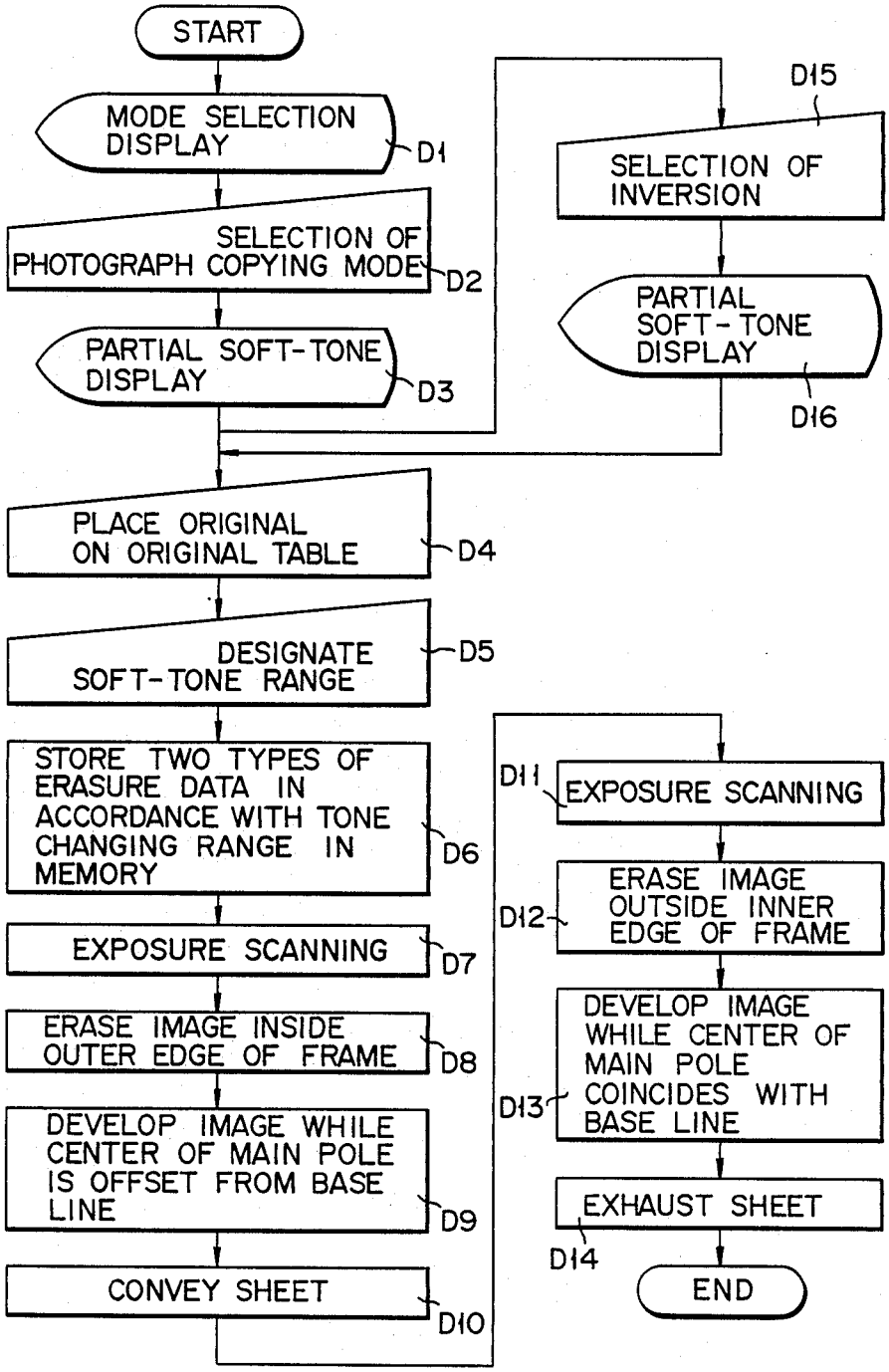
FIG. 36 is a flow chart for explaining a copying operation of an original of the fourth embodiment.

The copying operation of the fourth embodiment will be described with reference to the flow chart shown in FIG. 36. In the flow chart of FIG. 36, steps D1 to D8 are similar to steps C1 to C8 shown in the flow chart (FIG. 29) of the third embodiment, and a description thereof will be omitted.

In the state of step D8, development is performed while the central position of main pole 416*a* in sleeve 414 is offset from the base line perpendicular to a depending line passing through the center of drum 36 by main processor 80 (step D9). Thereafter, a high-contrast image (characteristic curve with a large γ value) of only a portion of original O other than the range surrounded by outer edge Wb of frame W is copied on transferred sheet P.

Thereafter, copied sheet P is again conveyed to the transfer section by multiple copying unit 78 (step D10). A copying operation of a tone changing portion of original O is then performed using developer 412 and erasure array 110. More specifically, first carriage 302 is moved to perform exposure scanning of original O (step D11).

Thus, erasure data of a rough-tone portion shown in FIG. 11B is supplied from memory 106 to array driver 108, and erasure array 110 is operated in accordance with the erasure data. With this operation, a charge corresponding to a portion outside inner edge Wa of frame W is removed from drum 36, and a copying operation is performed again (step D12). In this case, the central position of main pole 416*a* coincides with the base line perpendicular to a depending line passing through the center of drum 36 by main processor 80 (step D13).

Therefore, a soft-tone image of a portion of original O corresponding to a range surrounded by inner edge Wa designated by spot light source 300 is formed on the surface of drum 36 with high photograph reproducibility. In synchronism with this operation, paper sheet P fed to the transfer section by multiple copying unit 78 is fed, and an image of the portion of the range surrounded by inner edge Wa of frame W is transferred to sheet P. A rough-tone image of a portion of original O other than the range surrounded by outer edge Wb of frame W and a soft-tone image of a portion of the range surrounded by inner edge Wa of frame W are formed on paper sheet P, as shown in FIG. 21B. Sheet P is then exhausted to exhaust tray 70 via exhaust roller pair 68 (step D14).

In this manner, an image of a soft-tone photograph has a good tone property, and an image of a rough-tone character portion has a high contrast. Thus, a clear image which is easy to see can be copied. Images do not overlap each other, and can be clearly copied.

The operator depresses selection key 206 in accordance with the display in step D3, thereby selecting an inversion mode (step D15). Display section 204 displays a portion inside a pattern frame, as shown in FIG. 18B, thereby performing a partial tone display (step D16). Thereafter, the operation of steps D4 to D14 is performed. As a result, an image of a soft-tone photograph has a good tone property, and an image of a rough-tone character portion has a high contrast. Thus, a clear image which is easy to see can be copied. Images do not overlap each other, and can be clearly copied.

Thus, the above operation can be achieved by changing the position of main pole 416*a* of developer 412 at a timing at which a row set region, which is perpendicular to a moving direction of a recording material and is designated in advance by operation keys 222, 224, 226, and 228, and 230, of one latent image formation surface on drum 36 is developed by developer 412.

When a tone changing operation of a photograph portion is to be performed, i.e., when a predetermined portion of an original is copied in a different tone (soft tone) mode, the main pole position in the developing sleeve of the developer is changed to coincide with or not to coincide with the base line. Therefore, an image of a soft-tone photograph has a good tone property, and an image of a rough-tone character portion has a high contrast. Thus, a clear image which is easy to see can be copied.

A tone changing range can be easily designated by the spot light source, resulting in good operability.

In a fifth embodiment, a distance between a developing sleeve and a photoconductive drum is changed to change a tone as in the fourth embodiment.

Figure 37:
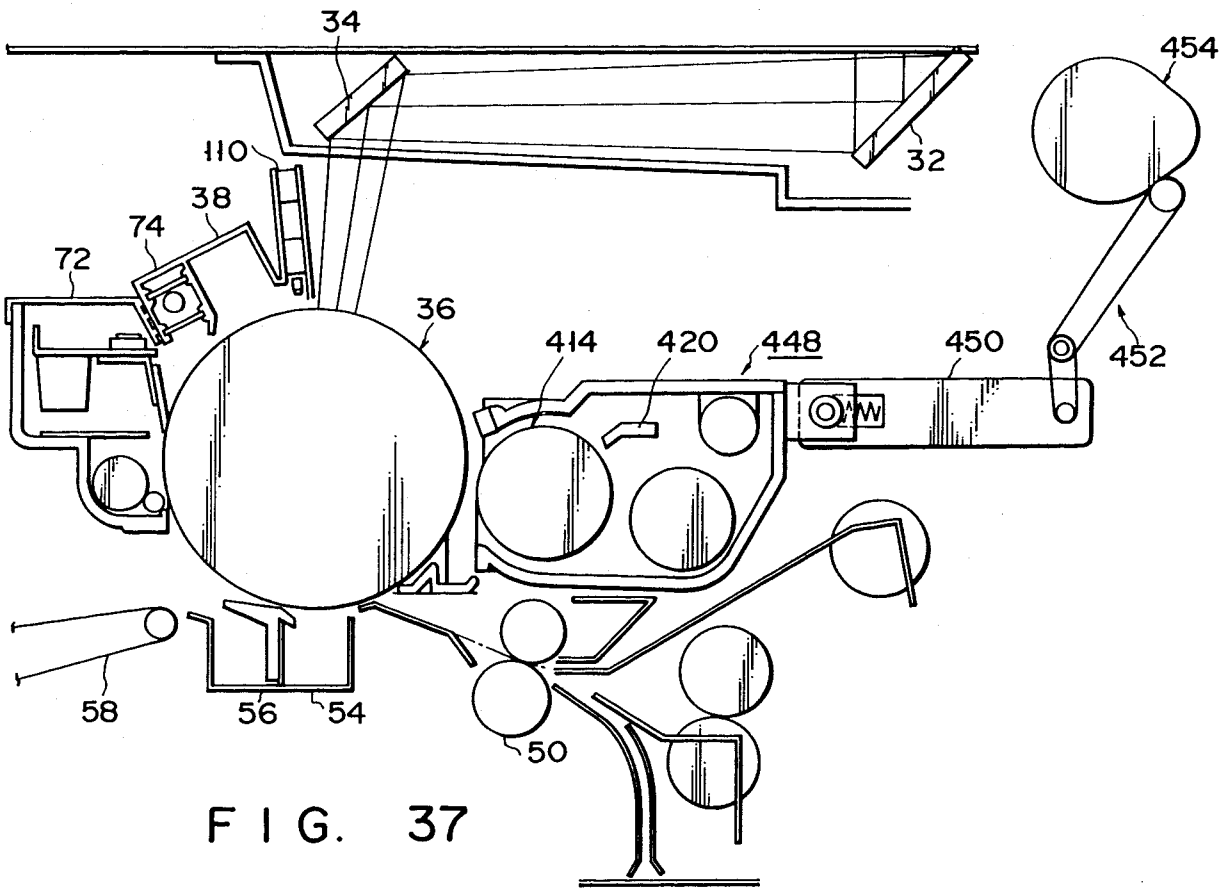
FIG. 37 is a side sectional view showing an arrangement of components around a photoconductive drum and a developer according to a fifth embodiment of the present invention.

FIG. 37 shows an arrangement of developer 448 constituting developer unit 40 and components around it. The distance from developer 448 to photoconductive drum 36 can be changed. One end of lever 450 is fixed to developer 448, and the other end thereof is pivotally supported by link mechanism 452. The other end of link mechanism 452 is moved along the outer surface of cam 454 which is rotatably supported by a stationary portion (not shown).

Figure 38A:
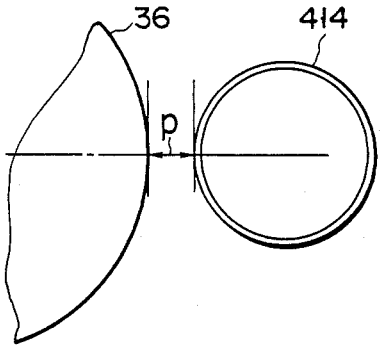
Figure 38B:
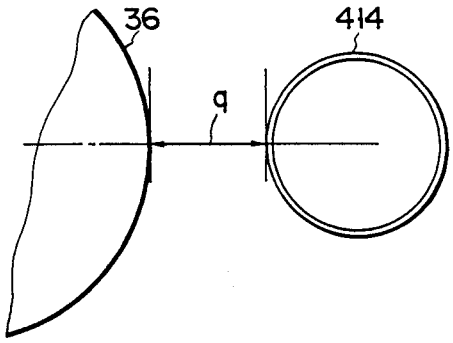
Figure 39:
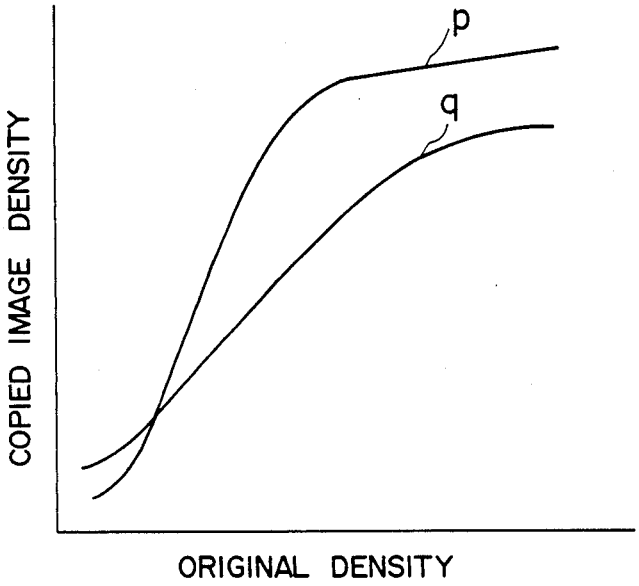
FIG. 39 is a graph showing the relationship between an original image density and a copied image density in accordance with the distance between the photoconductive drum and the developing sleeve.

With this arrangement, cam 454 is rotated to operate link mechanism 452, and lever 450 is moved to the right or left in FIG. 37. Upon this movement, the distance between drum 36 and sleeve 414 is changed. In this case, it is decreased (p) as shown in FIG. 38A. For example, if the distance is 1.0 mm, the characteristics of the original density and the copied image density are represented by curve p shown in FIG. 39. In contrast to this, as shown in FIG. 38B, when the distance between drum 36 and sleeve 414 is increased (q), e.g., is 1.10 mm, the characteristics of the original density and the copied image density are represented by curve q in FIG. 39. Thus, the image tone can be changed, and a designated range can be copied to be an image having a different tone.

Assume that an operator wants to perform a combined copying operation of original O' shown in FIG. 35. For region B, development is performed with distance q shown in FIG. 38B. For region A of original O', cam 454 is operated, and developer 448 approaches drum 36 through link mechanism 452 and lever 450. More specifically, development is performed with distance p shown in FIG. 38A. Again for region B of original O', developer 448 is moved away from drum 36, and development is performed with distance q shown in FIG. 38B.

Note that regions A and B of original O' are designated by operation keys 222, 224, 226, 228, and 230 on operation panel 200, and upon this designation, cam 454 is operated.

Figure 40:
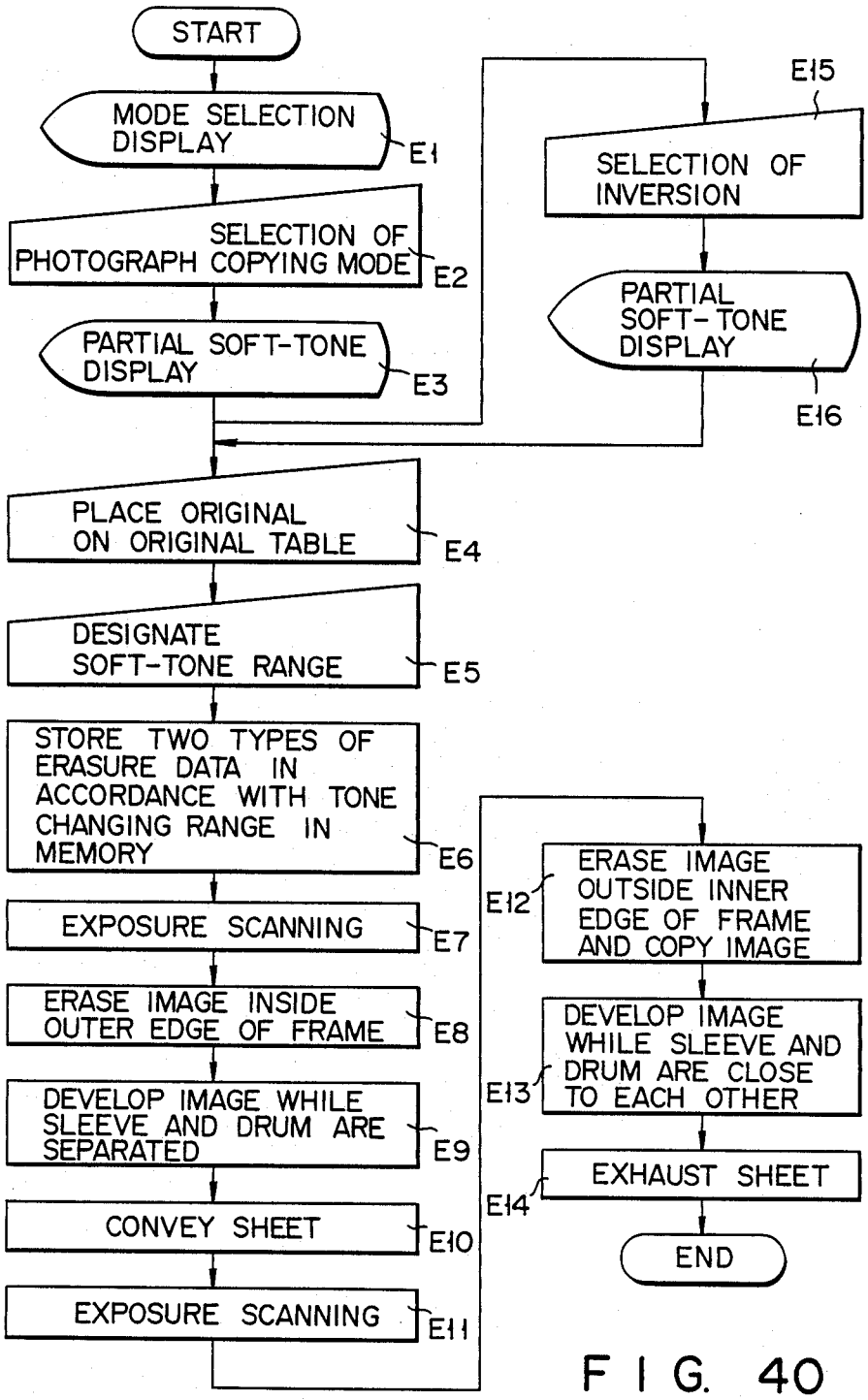
FIG. 40 is a flow chart for explaining a copying operation of an original according to the fifth embodiment of the present invention.

A copying operation according to the fifth embodiment will be described with reference to the flow chart shown in FIG. 40. In the flow chart of FIG. 40, steps E1 to E8, E15 and E16 are the same as steps D1 to D8, D15 and D16 in the flow chart (FIG. 36) of the fourth embodiment, and a description thereof will be omitted.

In the state of step E8, development is performed while a distance between drum 36 and sleeve 414 of developer 448 is kept widened (step E9). Thereafter, a high-contrast image (characteristic curve with a large $\gamma$ value) of only a portion other than a range surrounded by outer edge Wb of frame W of original O is copied on transferred sheet P, as shown in FIG. 21A.

Thereafter, copied sheet P is fed again to the transfer section by multiple copying unit 78 (step E10). A copying operation of a tone changing portion of original O is performed using developer 448 and erasure array 110. More specifically, first carriage 302 is moved to perform exposure scanning of original O (step E11).

With this operation, erasure data of a rough-tone portion shown in FIG. 11B is supplied from memory 106 to array driver 108, and erasure array 110 is operated in accordance with the erasure data. Thus, a charge corresponding to a portion outside inner edge Wa of frame W is removed from drum 36, and a copying operation is performed again (step E12). In this case, development is performed while the distance between drum 36 and sleeve 414 is decreased by main processor 80 (step E13).

Therefore, a soft-tone image of a portion of original O corresponding to a range surrounded by inner edge Wa designated by spot light source 300 is formed on the surface of drum 36 with high photograph reproducibility. In synchronism with this operation, paper sheet P fed to the transfer section by multiple copying unit 78 is fed, and an image of the portion of the range surrounded by inner edge Wa of frame W is transferred to sheet P. A rough-tone image of a portion of original O other than the range surrounded by outer edge Wb of frame W and a soft-tone image of a portion of the range surrounded by inner edge Wa of frame W are formed on paper sheet P, as shown in FIG. 21B. Sheet P is then exhausted to exhaust tray 70 via exhaust roller pair 68 (step E14).

In this manner, an image of a soft-tone photograph has a good tone property, and an image of a rough-tone character portion has a high contrast. Thus, a clear image which is easy to see can be copied. Images do not overlap each other, and can be clearly copied.

When a tone changing operation of a photograph portion is performed, i.e., when a predetermined portion of an original is copied in a different tone (soft tone) mode, the distance between the developing sleeve and the photoconductive drum is changed. Therefore, an image of a soft-tone photograph has a good tone property, and an image of a rough-tone character portion has a high contrast. Thus, a clear image which is easy to see can be copied.

A tone changing range can be easily changed by the spot light source, resulting in good operability.

In a sixth embodiment, as the tone changing means, a frequency of an AC developing bias voltage is switched.

For example, in developer 402 shown in FIG. 5, developing sleeve 404 is rotated at the same speed (166 mm/sec) as photoconductive drum 36 in the same direction. The distance between sleeve 404 and blade 410 is 180 $\mu$m, and the distance between sleeve 404 and drum 36 is 200 $\mu$m. A magnetic field at the leading end position of blade 410 on developing sleeve 404 is about 1,000 G (Gauss), and a magnetic field at a developing position is about 750 G. The thickness of a magnetic toner layer as a developing agent is limited to 70 $\mu$m by blade 410. The toner is fed to the developing section while being negatively charged by friction with the surface of sleeve 404.

Sleeve 404 and blade 410 are kept in an electrically conducting state in order to prevent a discharge therebetween, and an AC voltage is applied to a conductive member of photoconductive drum 36 by a power supply (not shown). The frequency of the AC voltage is 100 Hz, and the AC voltage is applied while a DC voltage of +200 V is superposed on a sine wave having an amplitude of 400 V (800 Vpp). A latent image potential on drum 36 is +500 V on an image portion, and 0 V on a non-image portion.

Figure 41:
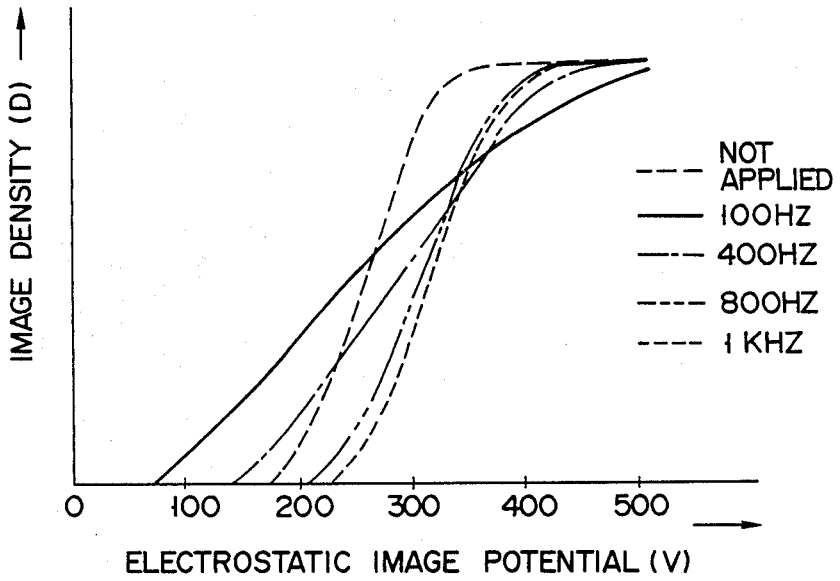
FIG. 41 is a graph showing the relationship between an original image density and a copied image density in accordance with a frequency of a developing bias voltage according to a sixth embodiment of the present invention.

As described above, the frequency of the AC developing bias voltage is switched, so that the copied image density with respect to the original density is changed, as shown in FIG. 41. Therefore, when no AC bias voltage is applied, i.e., when only a DC voltage of 200 V is applied, a rough-tone image having a large $\gamma$ value (gamma; gradient of a characteristic curve of an image density with respect to a latent image potential) is obtained. However, when an original has a high background density and a low contrast, a high-contrast image free from fogging can be obtained by exposure adjustment.

As the AC developing bias voltage, an AC voltage of a low frequency of 100 Hz is applied to be superposed on a DC voltage of +200 V, thereby obtaining a soft-tone image having a wide dynamic range with respect to an original density. Thus, this mode is suitable for copying a continuous-tone object such as a photograph.

As shown in FIG. 6, main processor 80 controls bias switching circuit 142 which applies an AC developing bias voltage upon turning on of power supply circuit 140 in developer 402, and applies a DC developing bias voltage upon turning off of power supply circuit 140. Bias switching circuit 142 is controlled by main processor 80. When circuit 142 receives a bias ON signal from main processor 80, it turns on power supply circuit 140 to superpose an AC voltage of a low frequency of 100 Hz on a DC voltage of +200 V and applies the superposed voltage as the developing bias voltage. In contrast to this, when bias switching circuit 142 receives an AC developing bias OFF signal from main processor 80, it turns off power supply circuit 140, and applies only a DC voltage of +200 V.

Figure 42:
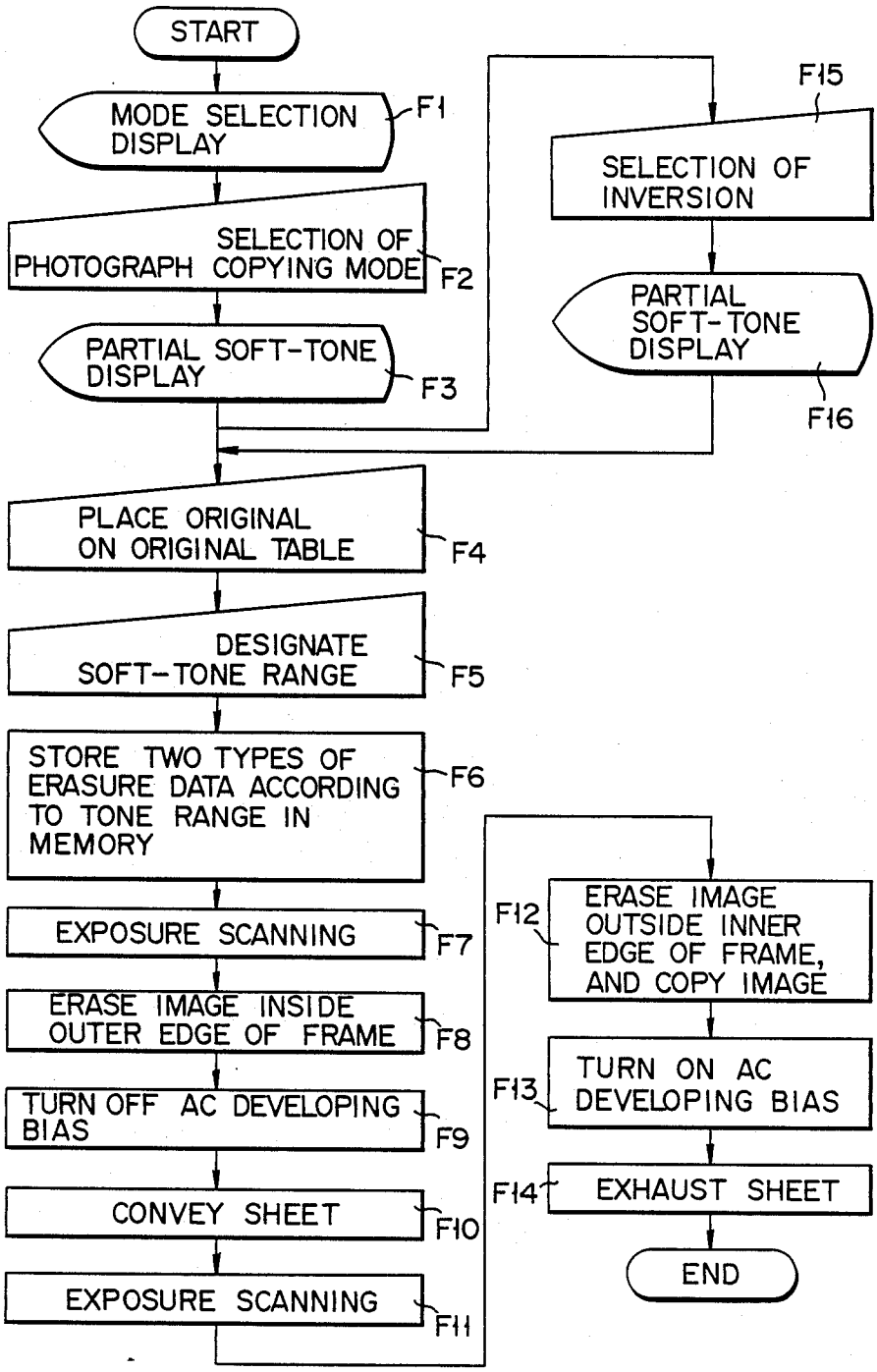
FIG. 42 is a flow chart for explaining a copying operation of an original of the sixth embodiment.

The copying operation according to the sixth embodiment will be described with reference to the flow chart shown in FIG. 42. In the flow chart of FIG. 42, steps F1 to F8 and steps F15 and F16 are the same as steps D1 to D8 and steps D15 and D16 in the flow chart (FIG. 36) of the fourth embodiment, and a description thereof will be omitted.

In the state of step F8, bias switching circuit 142 is switched in response to an AC developing bias OFF signal from main processor 80. With this operation, power supply circuit 140 is turned off, and only a DC voltage of +200 V (DC developing bias voltage) is applied as the developing bias voltage, and development is performed (step F9).

Therefore, when the image is developed and transferred, a high-contrast image (characteristic curve with a large $\gamma$ value ) of only a portion of original O other than a range surrounded by outer edge Wb of frame W is copied on paper sheet P, as shown in FIG. 21A.

Thereafter, copied sheet P is fed again to the transfer section by multiple copying unit 78 (step F10). Then, a copying operation of a tone changing portion of original O is performed using developer 402 and erasure array 110. More specifically, first carriage 302 is moved to perform exposure scanning of original O (step F11).

With this operation, erasure data of a rough-tone portion shown in FIG. 11B is supplied from memory 106 to array driver 108, and erasure array 110 is operated in accordance with the erasure data. Thus, a charge corresponding to a portion outside inner edge Wa of frame W is removed from drum 36 (step F12). In this case, bias switching circuit 142 is switched in response to an AC developing bias ON signal from main processor 80. Power supply circuit 140 is then turned on, and a DC voltage of +200 V is superposed on a sine wave having a frequency of 100 Hz and an amplitude of 400 V (800 Vpp). The resultant developing bias voltage is applied to perform development (step F13).

Therefore, a soft-tone image of a portion of original O corresponding to a range surrounded by inner edge Wa designated by spot light source 300 is formed on the surface of drum 36 with high photograph reproducibility. In synchronism with this operation, paper sheet P fed to the transfer section by multiple copying unit 78 is fed, and an image of the portion of the range surrounded by inner edge Wa of frame W is transferred to sheet P. A rough-tone image of a portion of original O other than the range surrounded by outer edge Wb of frame W and a soft-tone image of a portion of the range surrounded by inner edge Wa of frame W are formed on paper sheet P, as shown in FIG. 21B. Sheet P is then exhausted to exhaust tray 70 via exhaust roller pair 68 (step F14).

In this manner, an image of a soft-tone photograph has a good tone property, and an image of a rough-tone character portion has a high contrast. Thus, a clear image which is easy to see can be copied. Images do not overlap each other, and can be clearly copied.

When a tone changing operation of a photograph portion is to be changed, i.e., when a predetermined portion of an original is copied in a different tone (soft tone) mode, a portion inside a designated range is erased during a first copying operation, and a developing bias voltage is applied while a DC voltage of 200 V is superposed on a sine wave having a frequency of 100 Hz and an amplitude of 400 V (800 Vpp), thereby performing a copying operation. During the second copying operation, a portion outside the designated range is erased, and only a DC voltage of +200 V is applied as the developing bias voltage, thereby performing a copying operation. Therefore, an image of a soft-tone photograph has a good tone property, and an image of a rough-tone character portion has a high contrast. Thus, a clear image which is easy to see can be copied. In addition, a tone changing range can be easily designated by the spot light source, resulting in good operability.

Figure 43:
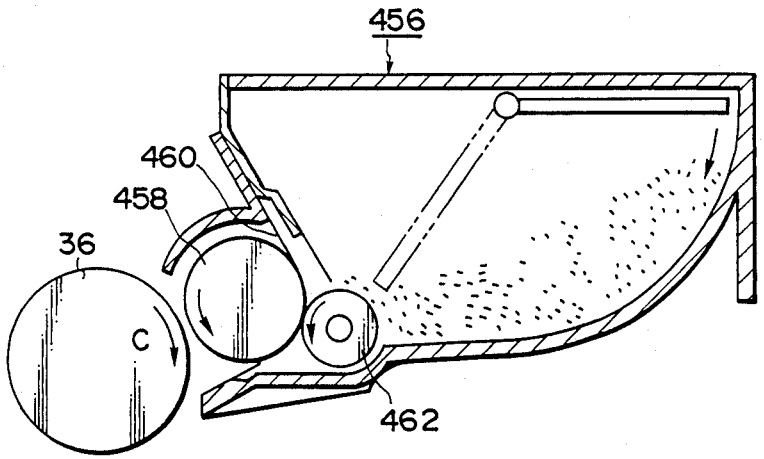
FIG. 43 is a schematic side sectional view showing a developer according to a seventh embodiment of the present invention.

FIG. 43 shows developer 456 of developer unit 40 according to a seventh embodiment. More specifically, developer 456 stores a developing agent (toner), and developing sleeve 458 is arranged to oppose photoconductive drum 36 and to be rotatable in a direction of an arrow in FIG. 43. Coating blade 460 is provided above sleeve 458. Blade 460 is formed of a conductive material such as stainless steel for frictionally charging toner. Recovery roller 462 for recovering toner particles which are not subjected to development is provided below sleeve 458. Coating blade 460 is brought into contact with sleeve 458. A distance between sleeve 458 and photoconductive drum 36 is set to be 250 $\mu$m. Furthermore, a superposed voltage of DC voltage of −200 V and AC voltages of 1.5 kV, 2 kHz is applied to drum 326 as a developing bias.

Figure 44:
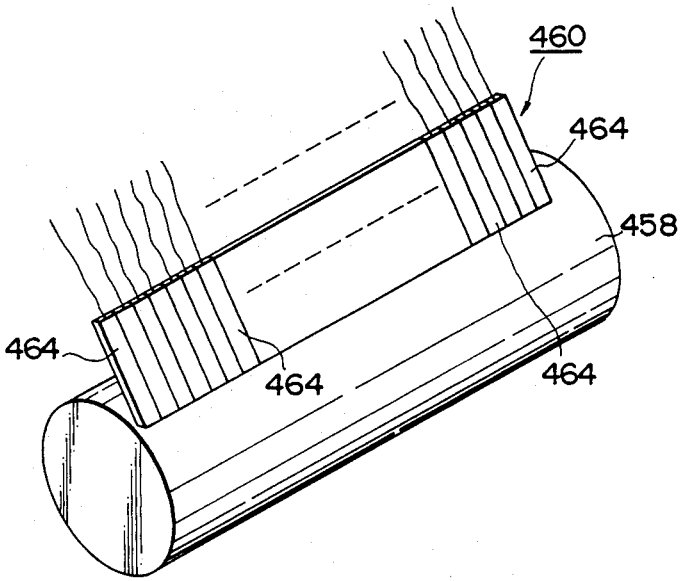
FIGS. 44 and 45 are respectively a schematic perspective view and a schematic front view showing the positional relationship between a developing sleeve and a coating blade.
Figure 45:
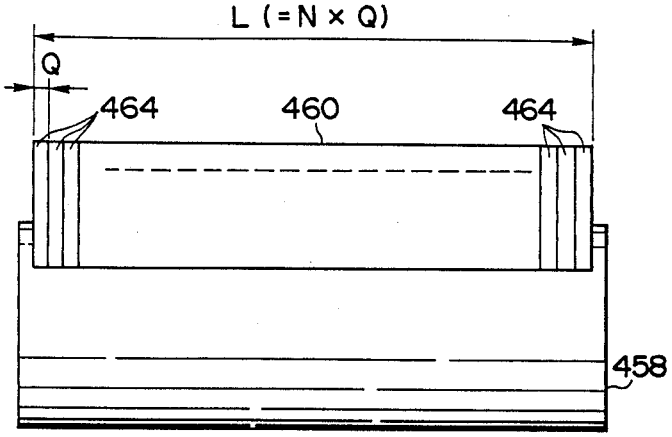

Coating blade 460 is constituted by a plurality of divided blade elements 464 which are disposed along the axial direction of developing sleeve 458, as shown in FIGS. 44 and 45. The number of divided blade elements 464 coincides with the capacity in the column direction of memory 106. If a width of each divided blade element 464 is given as Q and the number of elements 464 is given by N, total length L of blade 460 is $L=N\times Q$.

The plurality of divided blade elements 464 are connected to voltage application section 466 which selectively applies a voltage based on data designated by spot light source 300 for designating a tone changing range.

A voltage is applied to or not applied to divided blade elements 464 so that a copied image density with respect to an original density is changed. More specifically, when no voltage is applied to divided blade elements 464, a difference between a frictionally charged potential of toner and a surface potential of drum 36 becomes large. Therefore, a saturated image density is high, and a rough-tone image which has a narrow dynamic range with respect to a developing density and a large $\gamma$ value is obtained. When an original has a high background density and a low contrast, a high-contrast image free from fogging can be obtained by exposure adjustment.

In contrast to this, when a voltage is applied to divided blade elements 464, a difference between the frictionally charged potential of toner and the surface potential of drum 36 becomes small. Therefore, a soft-tone image which has a small $\gamma$ value (about 1.0) and a wide dynamic range with respect to a developing density can be obtained. Thus, this mode is suitable for copying a continuous-tone object such as a photograph.

Figure 46:
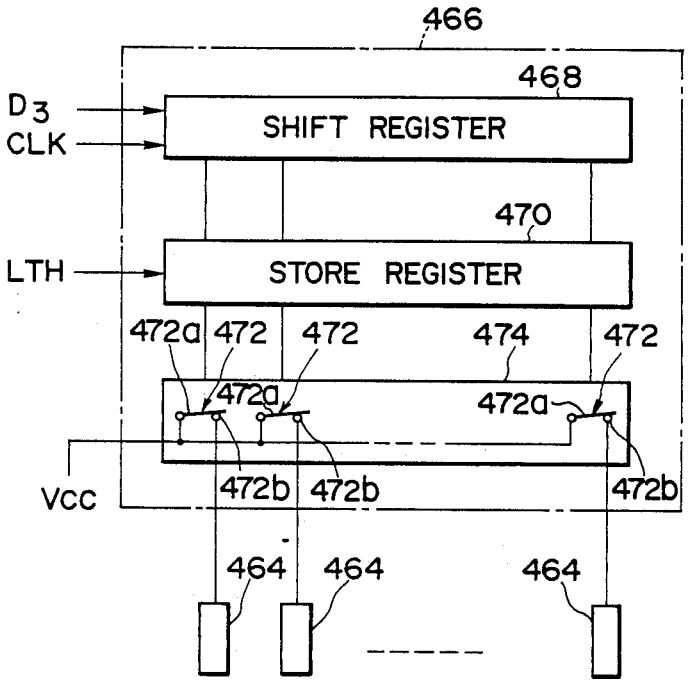
FIG. 46 is a diagram showing an arrangement of a voltage application section.

Voltage application section 466 comprises shift register 468 having the same number of bits as that in the column direction of memory 106, store register 470 for storing the content of shift register 468, and switch circuit 474 comprising a plurality of switch elements which are turned on/off in response to output signals from store register 470, as shown in FIG. 46. Movable contact 472*a* of each switch element 472 is grounded, and fixed contact 472*b* is connected to corresponding divided blade element 464. Divided blade elements 464 receive a voltage of −300 V.

Figure 47:
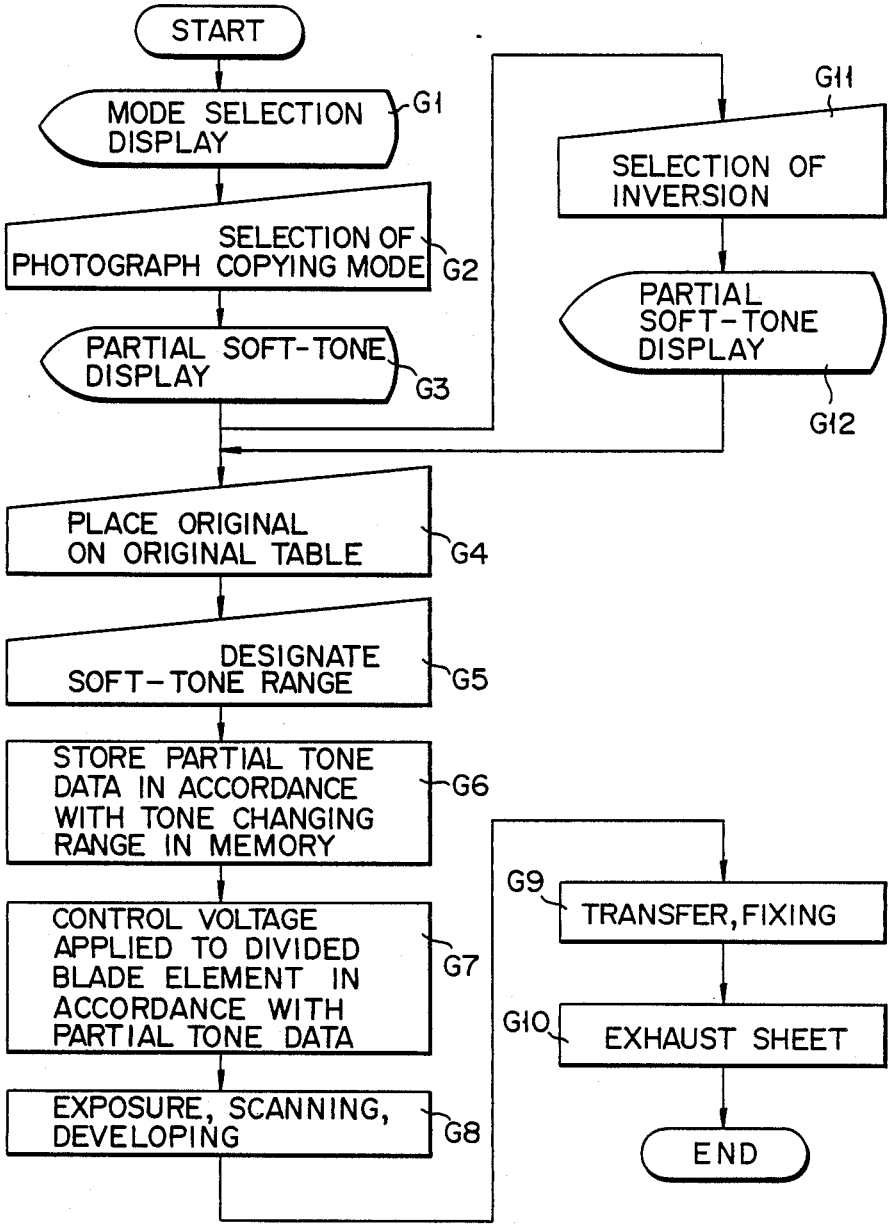
FIG. 47 is a flow chart for explaining a copying operation of an original of the seventh embodiment.

The copying operation according to the seventh embodiment will be described with reference to the flow chart shown in FIG. 47. In the flow chart of FIG. 47, steps G1 to G6, G11 and G12 are the same as steps B1 to B6, B12 and B13 in the flow chart (FIG. 27) of the second embodiment, and a description thereof will be omitted.

In step G6, when copy key 202 is depressed after a tone changing range of original O is designated, first carriage 302 and photoconductive drum 36 are operated, and one-line data $D_3$ is sequentially read out from memory 106 in the row direction. Readout data $D_3$ is transferred to shift register 468 of voltage application section 466 in response to clock signal CLK. After one-line data is transferred to shift register 468 of voltage application section 466, main processor 80 outputs latch signal LTH, and storage data in shift register 468 is supplied to store register 470 in accordance with signal LTH.

Each switch element 472 of switch circuit 474 is controlled by the output signal from store register 470. More specifically, when store register 470 outputs a HIGH-level output signal, corresponding switch element 472 is turned on; otherwise, is turned off. As a result, when switch element 472 is turned on, a voltage is applied to corresponding divided blade element 464, and when it is turned off, no voltage is applied (step G7). The potential of toner frictionally charged by divided blade element 464 applied with a voltage is a negative potential having a large absolute value. In contrast to this, the potential of toner frictionally charged by divided blade element 464 receiving no voltage is a negative potential having a small absolute value. Thereafter, exposure scanning of original O, and development are performed (step G8).

Therefore, a soft-tone image of a portion of original O corresponding to a range surrounded by inner edge Wa of frame W is formed on the surface of photoconductive drum 36 with high photograph reproducibility. A rough-tone, high-contrast image of a portion of original O other than the range surrounded by outer edge Wb of frame W is also formed. When the image on drum 36 is transferred, an image of a portion of original O other than the range surrounded by outer edge Wb of frame W is copied on paper sheet P in a partial tone mode, and the other portion is copied thereon in a fundamental tone mode, as shown in FIG. 21B (step G9).

Paper sheet P subjected to copying is exhausted to exhaust tray 70 via exhaust roller pair 68 (step G10).

In this manner, an image of a soft-tone photograph has a good tone property, and an image of a rough-tone character portion has a high contrast. Thus, a clear image which is easy to see can be copied.

In the first to seventh embodiments described above, as image properties of an original to be partially changed, an image tone is changed. In an eighth embodiment, as image properties of an original to be partially changed, a polarity of an image portion is changed to copy the image. In the following embodiment, only the arrangement and operation different from those of the first to seventh embodiments will be described, and a description of the same arrangement and operation will be omitted.

Figure 48:
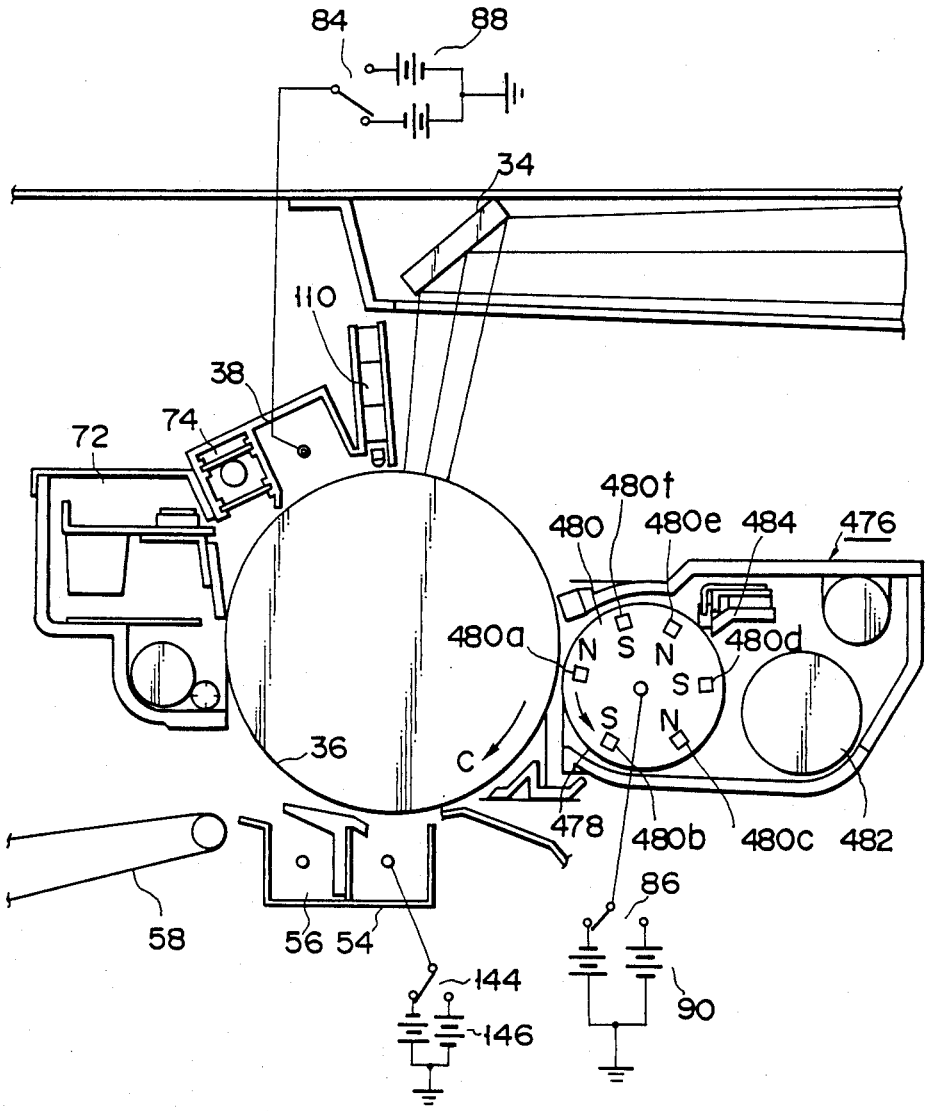
FIG. 48 is a schematic sectional view showing an arrangement of a photoconductive drum and a developer according to an eighth embodiment of the present invention.

FIG. 48 shows photoconductive drum 36, developer 476 constituting developer unit 40, and components therearound. Photoconductive drum 36 comprises an a-silicon photosensitive body. In this drum 36, a charge injection prevention layer is interposed between a conductive substrate and a photoconductive layer, and an insulating layer is provided on the surface. Drum 36 is rotated at a peripheral velocity of 166 mm/sec in a direction of arrow c in FIG. 48. The surface of drum 36 is charged by charger 38 (to +500 V or −500 V), and thereafter, an image is slit-exposed thereon, thereby forming an electrostatic latent image thereon. The latent image is visualized by toner fed from developer 476 storing, e.g., black toner. A DC voltage of +4.7 kV or −4.5 kV is selectively applied as a charging voltage from power supply circuit 88 to charger 38. When drum 36 is charged by the DC voltage of +4.7 kV by charger 38, drum 36 is positively charged (+500 V). When drum 36 is charged by the DC voltage of −4.5 kV, drum 36 is negatively charged (−500 V). Power supply circuit 88 is controlled by main processor 80 through switching circuit 84, and switches voltages and polarities in accordance with positive and negative polarity signals from main processor 80.

Developer 476 is constituted by nonmagnetic sleeve 478 serving as a developing sleeve, stationary magnetic pole 480 included in sleeve 478, stirring roller 482, and blade 484 for regulating the amount of a developing agent. A DC voltage of +150 V or −300 V is selectively applied as a positive or negative developing bias voltage from power supply circuit 90 to sleeve 478. Power supply circuit 90 is controlled by main processor 80 through switching circuit 86, and switches voltages and polarities in accordance with a positive or negative polarity signal from main processor 80.

Stationary magnetic pole 480 comprises a ferrite magnet, and is constituted by developing main pole 480*a*, and convey poles 480*b* to 480*f*. A magnetic force applied on developing sleeve 478 by developing main pole 480*a* is 1,000 G (Gauss), and magnetic forces applied on developing sleeve 478 by convey poles 480*b*, 480*c*, . . . , 480*f* are respectively 500 G, 300 G, 300 G, 500 G, and 500 G in the order named. A gap between sleeve 478 and blade 484 is 1.0 mm, and a gap between sleeve 478 and drum 36 is 1.2 mm. In a developing agent used in developer 476, a ferrite carrier having a particle size distribution of 150 to 300 mesh is used as a carrier, and negatively charging toner using a styrene-acrylic resin having an average particle size of 10 μm is used as toner.

Figure 49:
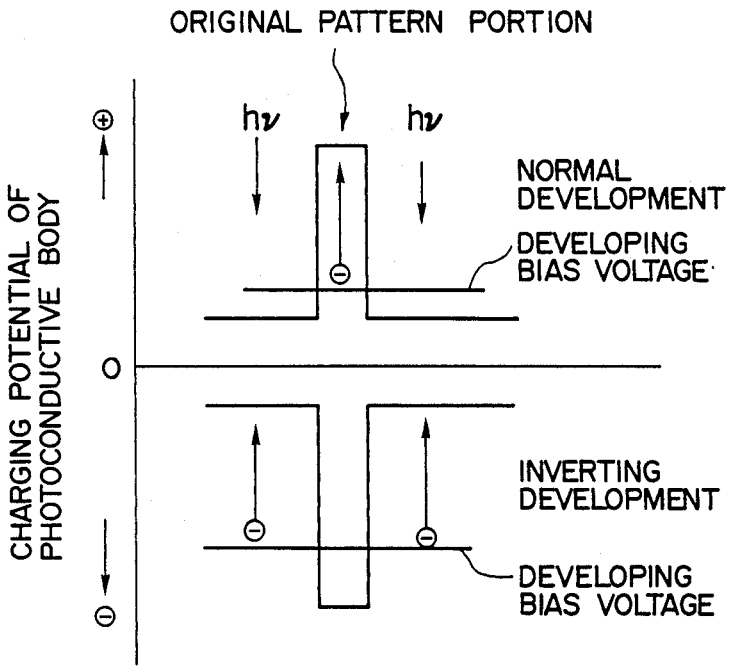
FIG. 49 is graph for explaining the relationship between a charging potential of a photoconductive drum and a developing bias voltage when normal and inverting development operations are performed.

A case will be described with reference to FIG. 49 wherein development is performed for an original having a positive image. More specifically, when normal development from a positive image to positive image (to be referred to as positive-positive) is performed, drum 36 is positively charged, and an image is developed using negatively charging toner ⊖ (see an upper portion of FIG. 49). When inverting development from a positive image to a negative image (to be referred to as positive-negative hereinafter) is performed, drum 36 is negatively charged, and a potential other than that of a pattern portion of a positive original is attenuated by exposure scanning. A negative charge attenuation portion is developed using negatively charging toner ⊖ at a developing bias potential near a negatively high potential of drum 36, thereby performing inverting development (see a lower portion of FIG. 49).

Figure 50:
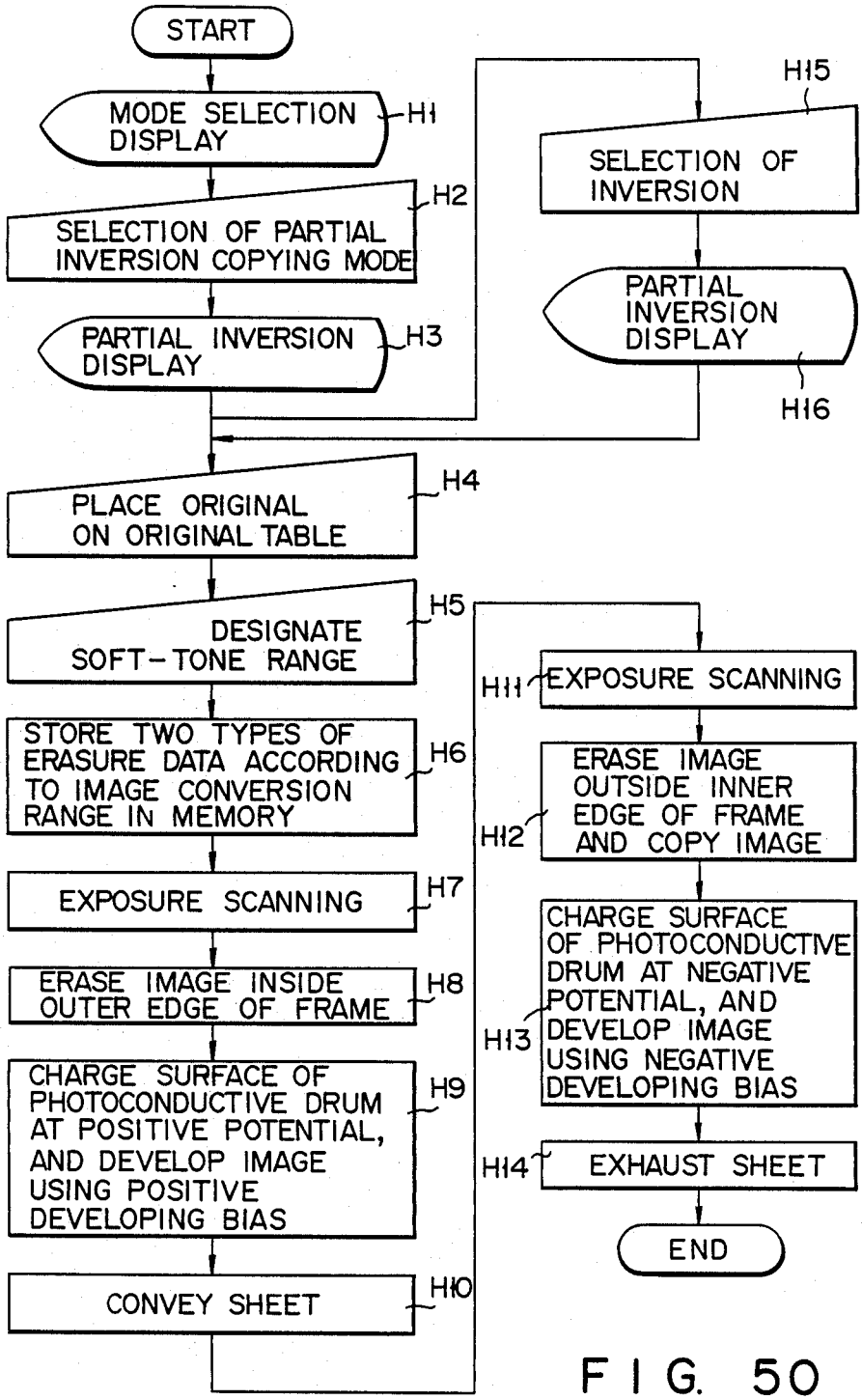
FIG. 50 is a flow chart for explaining a copying operation of an original of the eighth embodiment.

The copying operation of the eighth embodiment will be described with reference to the flow chart of FIG. 50.

Figure 51A:
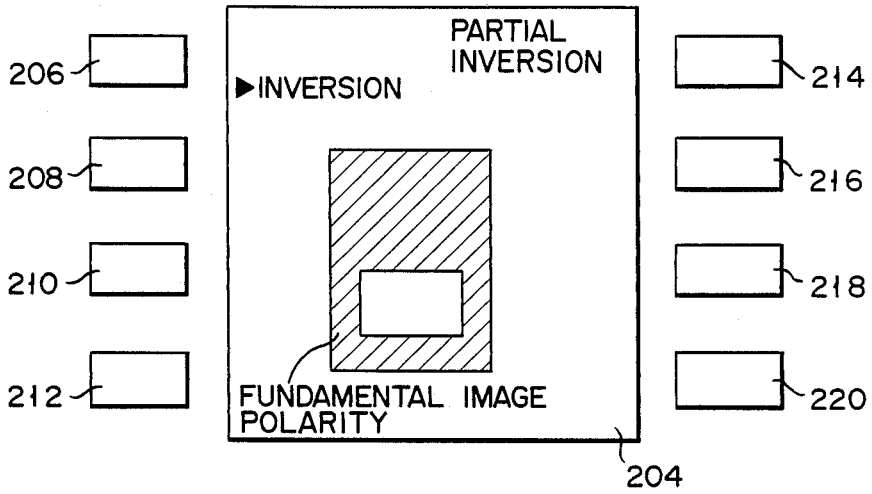

Assume that various modes, e.g., a timing/masking mode, an image move mode, an edge erasure mode, and the like are displayed on display section 204. In this display mode designation state (step H1), an operator selects a photograph copying (tone changing) mode by depressing, e.g., selection key 216 (step H2). A selection screen for inversion of image polarity is displayed in correspondence with selection key 206 shown in FIG. 51A, and patterns of an original frame and a designation range (pattern frame) are displayed (step H3). In this case, only a fundamental image polarity (positive) portion is displayed, thus performing a partial inversion display (polarity conversion; positive-negative).

Figure 52:
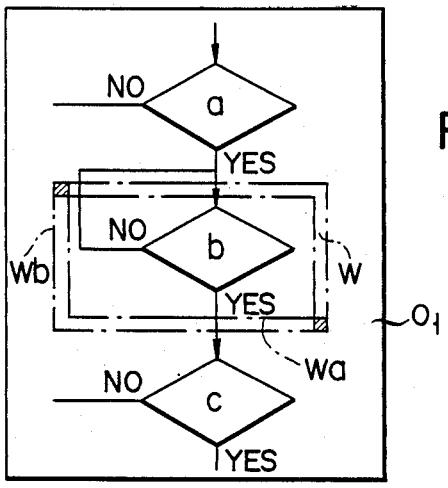
FIG. 52 is a view showing an original to be subjected to a partial inversion copying operation.

The operator then turns over original $O_1$ on which an image shown in FIG. 52 is formed, and places it on original table 12 (step H4). The operator designates points $S_1$ and $S_2$ as a polarity changing range on original $O_1$ (see FIG. 10) using operation keys 222, 224, 226, and 228, and position designation key 230 (step H5). Main processor 80 performs calculations based on inner and outer edges Wa and Wb of frame W designated by spot light source 300, i.e., coordinate positions of points $S_1''$ and $S_2''$ and those of of points $S_1'$ and $S_2'$. As shown in FIG. 11A, HIGH-level signals are stored at addresses of memory 106 corresponding to a portion inside outer edge Wb of frame W designated by spot light source 300 as erasure data of an inverting development (negative) portion, and LOW-level signals are stored at addresses corresponding to a portion outside outer edge Wb of frame W designated by light source 300. In addition, as shown in FIG. 11B, HIGH-level signals are stored at addresses corresponding to a portion outside inner edge Wa of frame W designated by light source 300, and LOW-level signals are stored at addresses corresponding to a portion inside inner edge Wa of frame designated by light source 300 (step H6).

When copy key 202 is depressed in this state, a copying operation of a portion of original $O_1$ other than the polarity changing portion is performed using developer 476 and erasure array 110. More specifically, first carriage 302 is moved to perform exposure scanning of original $O_1$ (step H7).

With this operation, erasure data of an inversion portion shown in FIG. 11A is supplied from memory 106 to array driver 108. In accordance with this erasure data, erasure array 110 is driven, and a charge of a portion inside outer edge Wb of frame W is removed from drum 36 (step H8). In this case, switching circuits 84 and 86 are controlled in accordance with the positive polarity signal from main processor 80, so that a voltage of +4.7 kV is applied to charger 38 to positively charge drum 36 (+500 V). In addition, a voltage of +150 V is applied to sleeve 478 as a positive developing bias voltage (step H9).

Figure 53A:
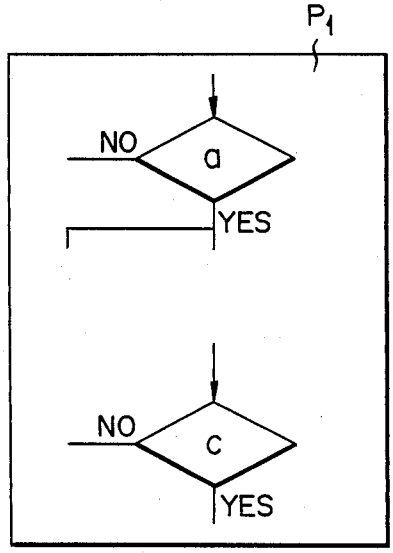

When the image is developed and transferred, a positive image (the same polarity as that of the original) of only a portion of original $O_1$ other than the range surrounded by outer edge Wb of frame W is copied on paper sheet $P_1$, as shown in FIG. 53A. Thereafter, sheet $P_1$ is conveyed again to the transfer section by multiple copying unit 78 (step H10).

Then, a copying operation of a polarity changing portion of original $O_1$ is performed using developer 476 and erasure array 110. More specifically, first carriage 302 is moved to perform exposure scanning of original $O_1$ (step H11).

With this operation, erasure data of a positive portion shown in FIG. 11B is supplied from memory 106 to array driver 108, and erasure array 110 is operated in accordance with the erasure data, thereby removing a charge of a portion outside inner edge Wa of frame W from drum 36 (step H12). In this case, switching circuits 84 and 86 are controlled in accordance with a negative polarity signal from main processor 80, so that a voltage of −4.5 kV is applied to charger 38 to negatively charge drum 36 (−500 V), and a voltage of −300 V is applied to developing sleeve 478 as a negative developing bias voltage (step H13).

Figure 53B:
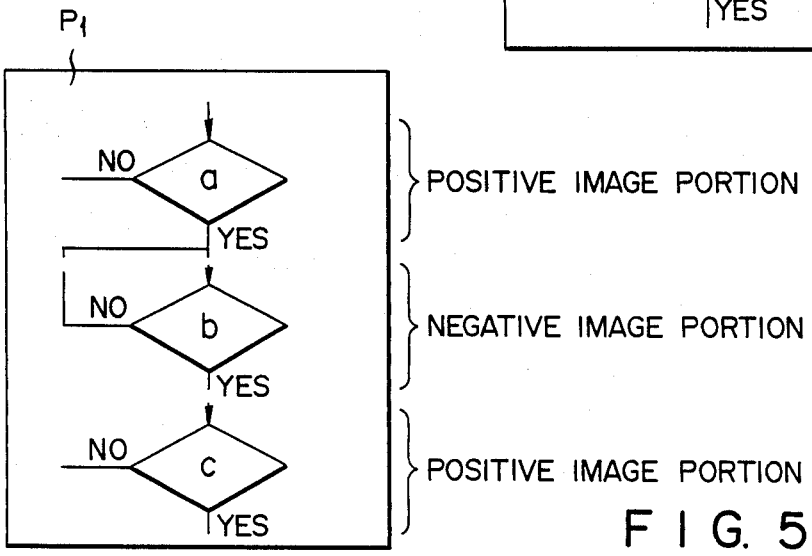

Therefore, a negative image (inverted image polarity to that of the original) of a portion of original $O_1$ corresponding to the range surrounded by inner edge Wa of frame W is formed on the surface of drum 36. In synchronism with this operation, paper sheet $P_1$ fed to the transfer section by multiple copying unit 78 is fed, and the image of the portion of the range surrounded by inner edge Wa of frame W is transferred to sheet $P_1$. As shown in FIG. 53B, a positive image (same image polarity as the original) of a portion of original $O_1$ other than the range surrounded by outer edge Wb of frame W, and a negative image (inverted image polarity to that of the original) of a portion of the range surrounded by inner edge Wa of frame W are formed on paper sheet $P_1$. Then, paper sheet $P_1$ is exhausted to exhaust tray 70 through exhaust roller pair 68 (step H14).

Thus, a portion of a positive original can be copied in a negative image polarity, and the other portion can be copied in a positive image polarity. Positive and negative images do not overlap each other during the image polarity changing operation, and can be clearly copied.

Figure 51B:
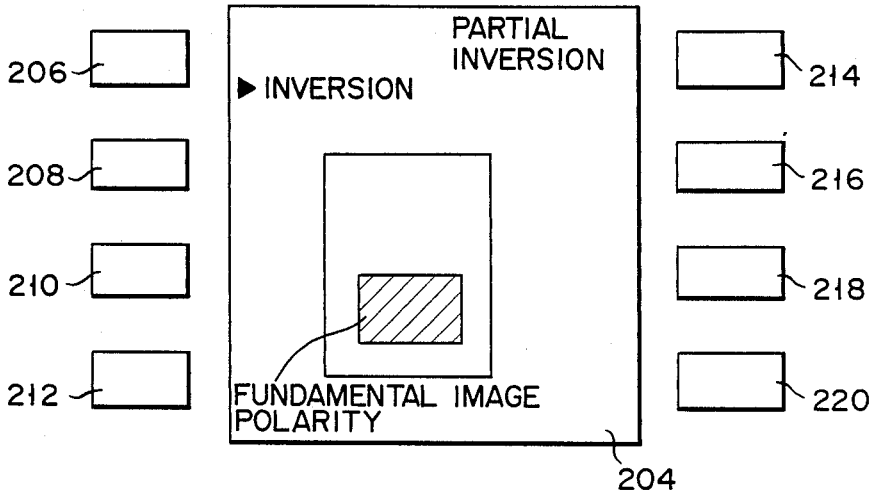

When the operator depresses selection key **206*a* in accordance with the display in step H3, he selects an inversion mode (for converting part of an original image not into a negative image but into a positive image) (step H15). Display section 204 displays a portion inside the pattern frame, as shown in FIG. 51B**, thereby performing a partial inversion display (step H16). Thereafter, the operation of steps H4 to H14 is performed, so that only a portion of a positive original can be copied in a negative image polarity, and the other portion can be copied in a positive image polarity.

When the image polarity of an original is partially changed, i.e., when a predetermined portion of an original is copied in the negative image polarity and the other portion is copied in the positive image polarity, the first copying operation is performed such that after a portion inside a designated range is erased, drum 36 is positively charged, and a positive developing bias voltage of +150 V is applied to the developing sleeve to perform a copying operation. During the second copying operation, a portion outside the designated range is erased, and drum 36 is negatively charged. In addition, a negative developing bias voltage of −300 V is applied to the developing sleeve to perform a copying operation. Thus, a portion of an original can be copied in the negative image polarity, and the other portion can be copied in the positive image polarity. The polarity changing range can be easily designated by a light spot, resulting in good operability.

In this embodiment, one portion is subjected to polarity changing operation. However, the present invention is not limited to this, and the polarity changing operation can be performed for a plurality of portions.

In the eighth embodiment, the bipolar (positive and negative) photoconductive drum is used. In a ninth embodiment described below, a developer has a bipolar developing agent, and a developing bias voltage is changed, so that a portion of an original is copied in the negative image polarity, and the other portion is copied in the positive image polarity.

As shown in FIG. 48, photoconductive drum 36 is rotated in a direction of arrow c in FIG. 48, and is charged (to +700 V) by charger 38. Thereafter, an image is slit-exposed on the surface of drum 36, thereby forming an electrostatic latent image thereon. The latent image is visualized by positive and negative (charging) toners, i.e., a bipolar one-component magnetic developing agent having both positive and negative polarities supplied from developer 476.

A DC voltage (transfer voltage) of +4.5 kV (normal development) or −4.3 kV (inverting development) is applied as a charging voltage from power supply circuit 146 to transfer charger 54 through switching circuit 144. Power supply circuit 146 is coupled to main processor 80 through switching circuit 144, and is controlled thereby.

A DC voltage of +200 V (developing bias voltage for normal development) or +400 V (developing bias voltage for inverting development) is selectively applied from power supply circuit 90 to developing sleeve 478 in developer 476. As toner stored in developer 476, negatively charging toner (negative toner; toner having an opposite polarity to drum 36) using a styrene-acrylic resin having an average particle size of 11 μm as a main resin, and positively charging toner (positive toner; toner having the same polarity as drum 36) using a styrene-acrylic resin having an average particle size of 10 μm are used.

Figure 54A:
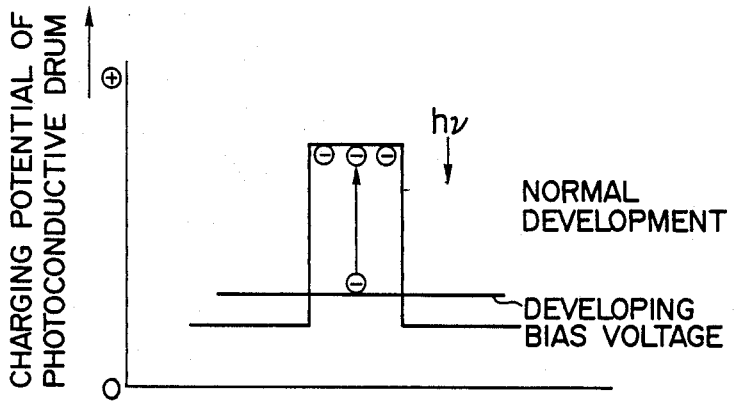
Figure 54B:
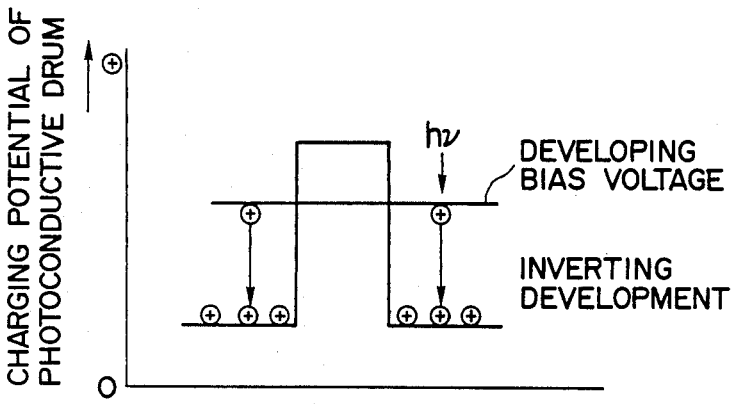

A case will be described with reference to FIGS. 54A and 54B wherein development is performed in both positive and negative polarities.

When positive-positive normal development is performed, drum 36 is positively charged to +700 V, and the developing bias voltage is set to be +200 V and the transfer voltage is set to be +4.5 kV. Then, development is performed using negatively charging toner ⊖ in developer 476 (see FIG. 54A). When positive-negative inverting development is performed, drum 36 is positively charged to +700 V, the developing bias voltage is set to be +400 V and the transfer voltage is set to be −4.3 kV. Then, performed using positively charging toner ⊕ in developer 476 (see FIG. 54B).

Figure 55:
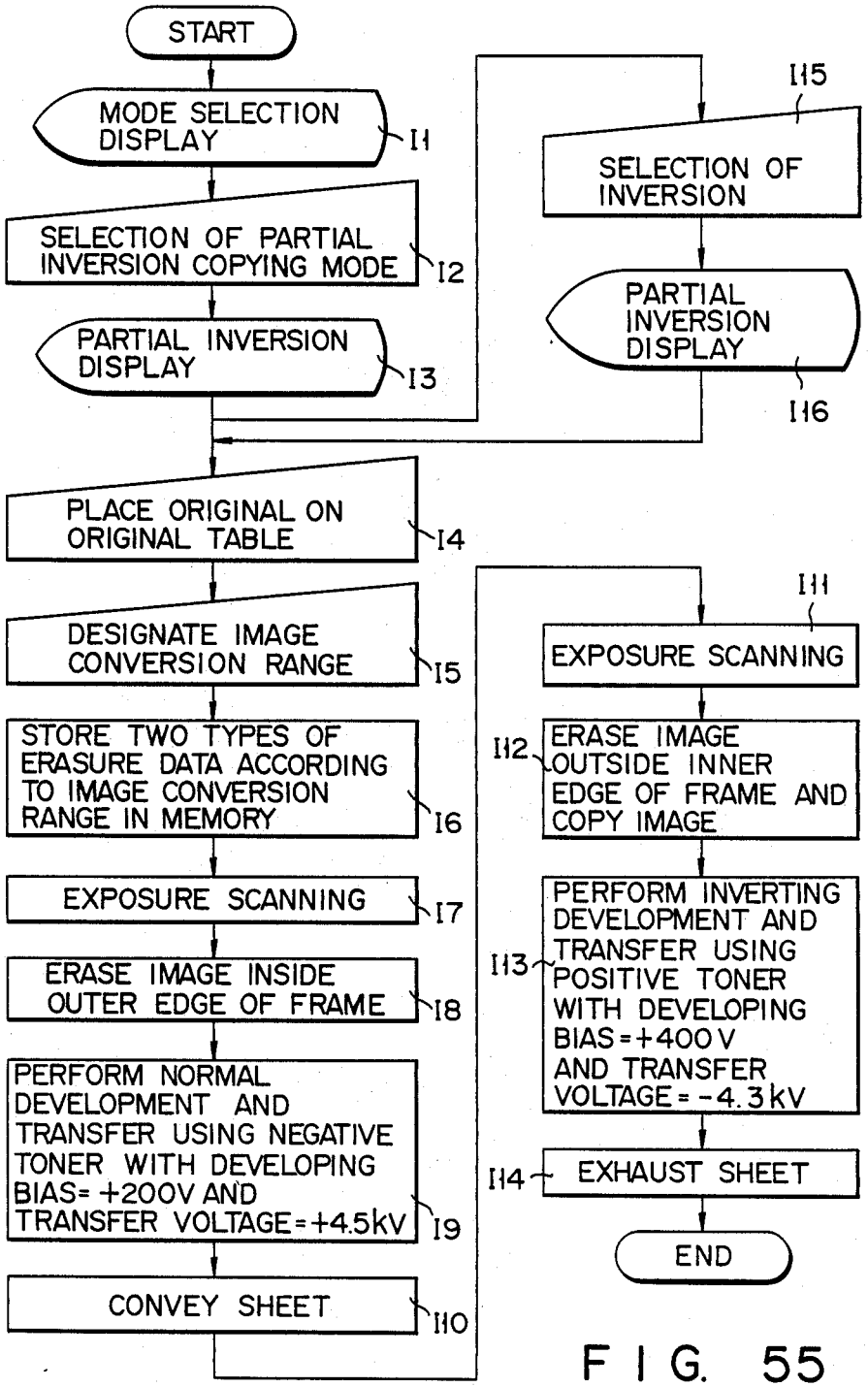
FIG. 55 is a flow chart for explaining a copying operation of an original according to a ninth embodiment of the present invention.

The copying operation of the ninth embodiment will be described with reference to the flow chart shown in FIG. 55. In the flow chart of FIG. 55, steps I1 to I8, steps I15 and I16 are the same as steps H1 to H8, steps H15 and H16 in the flow chart (FIG. 50) of the eighth embodiment, and a description thereof will be omitted.

When a charge of a portion inside outer edge Wb of frame W is removed from drum 36 in step I8, switching circuits 86 and 144 are controlled in accordance with the normal development signal from main processor 80. A developing bias voltage of +200 V in the normal development mode is applied to developing sleeve 478, and a voltage of +4.5 kV is applied to transfer charger 54 (step I9).

Therefore, a positive image (the same image polarity as the original) of only a portion of original $O_1$ other than the range surrounded by outer edge Wb of frame W is formed on the surface of drum 36 by negative toner. In synchronism with this operation, paper sheet $P_1$ is fed to the transfer section by register roller pair 50, and an image of the portion other than the range surrounded by outer edge Wb of frame W is transferred to sheet $P_1$. When the image is developed and transferred, a positive image (the same image polarity as the original) of only a portion other than the range surrounded by outer edge Wb of frame W is transferred onto paper sheet $P_1$, as shown in FIG. 53B. Thereafter, sheet $P_1$ is fed again to the transfer section by multiple copying unit 78 (step I10).

A copying operation of a polarity changing portion of original $O_1$ is then performed using developer 476 storing positive and negative toners and erasure array 110. More specifically, first carriage 302 is moved to perform exposure scanning of original $O_1$ (step I11).

With this operation, erasure data of a positive portion shown in FIG. 11B is supplied from memory 106 to array driver 108, and erasure array 110 is operated in accordance with the erasure data, thereby removing a charge of a portion outside inner edge Wa of frame W (step I12). In this case, switching circuits 86 and 144 are controlled in accordance with an inverting development signal from main processor 80, so that a voltage of −4.3 kV is applied to transfer charger 54 and a developing bias voltage of +400 V in the inverting development mode is applied to sleeve 478 (step I13).

Therefore, a negative image (inverted image polarity to the original) of a portion of original $O_1$ corresponding to a range surrounded by inner edge Wa of frame W is formed on the surface of drum 36 by positive toner. In synchronism with this operation, paper sheet $P_1$ fed to the transfer section by multiple copying unit 78 is fed, and the image of the portion of the range surrounded by inner edge Wa of frame W is transferred to sheet $P_1$. As shown in FIG. 53B, a positive image (the same image polarity as the original) of a portion of original $O_1$ other than the range surrounded by outer edge Wb of frame W and a negative image (inverted image polarity to the original) of a portion of the range surrounded by inner edge Wa of frame W are formed on paper sheet $P_1$. Sheet $P_1$ is then exhausted to exhaust tray 70 via exhaust roller pair 68 (step I14).

When an image polarity of a portion of an original is to be changed, i.e., when a predetermined portion of an original is copied in the negative image polarity and the other portion is copied in the positive image polarity, development is performed using a one-component magnetic developing agent having both the negative and positive charging polarities, and the transfer voltage polarity is set to be the same as that of the photoconductive drum in the normal development mode and to be opposite to that of the drum in the inverting development mode. The first copying operation is performed using negatively charging toner after a portion inside a designated range is erased, and the second copying operation is performed using positively charging toner after a portion outside the designated range is erased. Therefore, a portion of an original is copied in the negative image polarity, and the other portion is copied in the positive image polarity.

Figure 56:
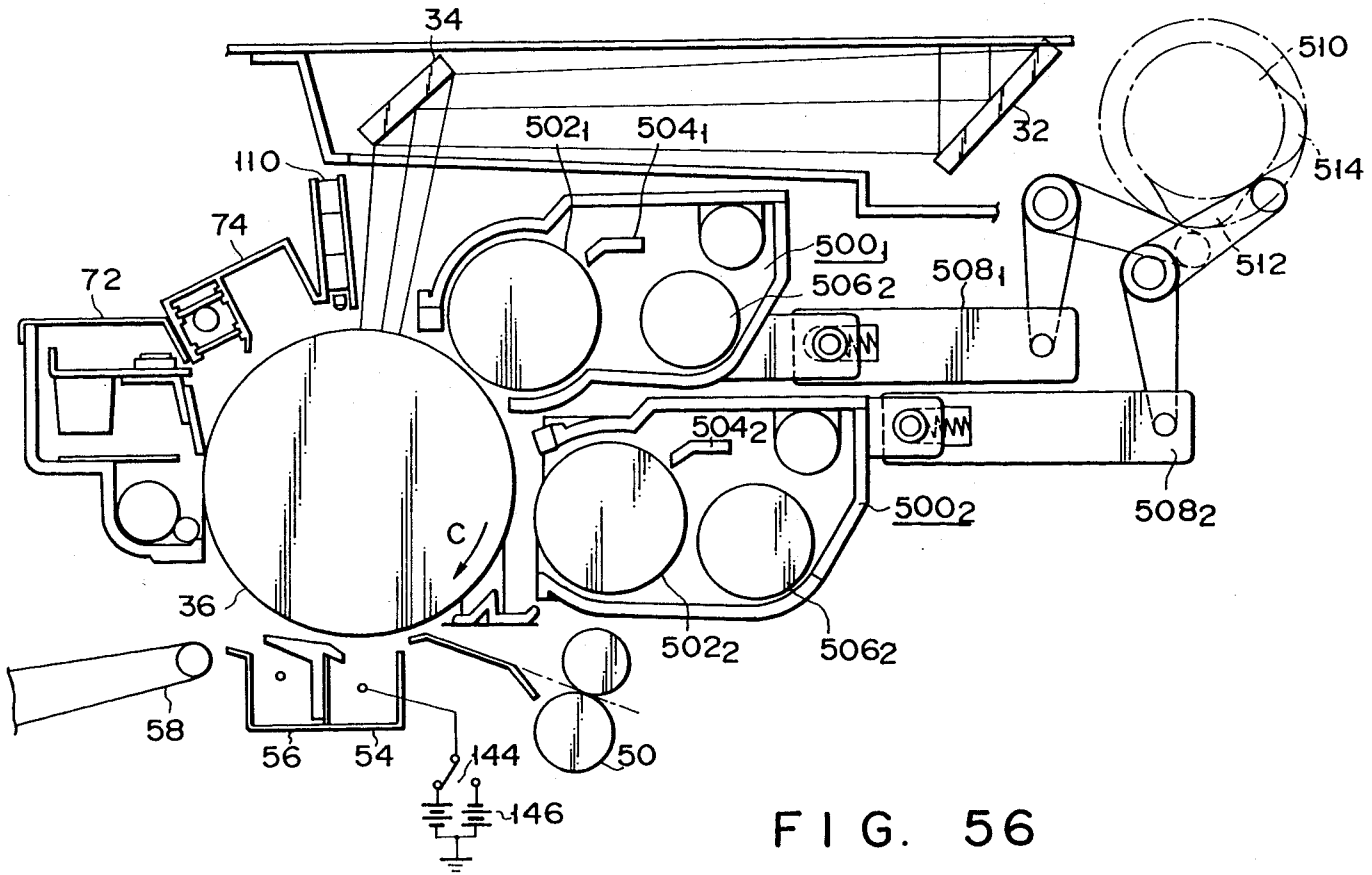
FIG. 56 is a schematic side sectional view showing an arrangement of a developer according to a tenth embodiment of the present invention.

FIG. 56 shows first and second developers $\mathbf{500_1}$ and $\mathbf{500_2}$ constituting developer unit 40 and components therearound according to a tenth embodiment of the present invention. In this embodiment, a description of the same arrangement and operation as those in the first to ninth embodiments described above will be omitted.

More specifically, first developer $\mathbf{500_1}$ is constituted by nonmagnetic sleeve $\mathbf{502_1}$ serving as a developing sleeve, stirring roller $\mathbf{504_1}$, and blade $\mathbf{506_1}$ for regulating an amount of developing agent. A DC voltage of +200 V is applied as a developing bias voltage in the normal development mode to sleeve $\mathbf{502_1}$ by a power supply circuit (not shown). A developing agent used in first developer $\mathbf{500_1}$ for performing normal development includes a ferrite carrier having a particle size distribution of 100 to 325 mesh as a carrier, and negatively charging toner (negative toner; toner having an opposite polarity to drum 36) using a styrene-acrylic resin having an average particle size of 11 μm as a main resin.

Similarly, second developer $\mathbf{500_2}$ is constituted by nonmagnetic sleeve $\mathbf{502_2}$ serving as a developing sleeve, stirring roller $\mathbf{504_2}$, and blade $\mathbf{506_2}$ for regulating an amount of developing agent. A DC voltage of +400 V is applied as a developing bias voltage in the inverting development mode to sleeve $\mathbf{502_2}$ by a power supply circuit (not shown). A developing agent used in second developer $\mathbf{500_2}$ for performing the inverting development includes a fluorine-coated magnetite carrier having a particle size distribution of 100 to 250 mesh as a carrier, and positively charging toner (positive toner; toner having the same polarity as drum 36) using a styrene-acrylic resin having an average particle size of 10 μm as a main resin.

Figure 57A:
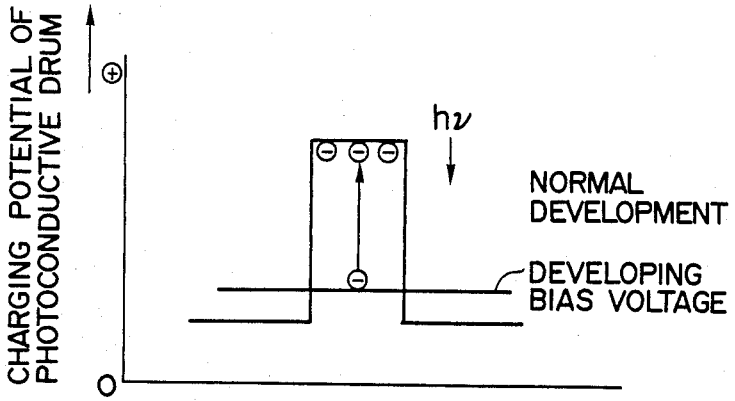
Figure 57B:
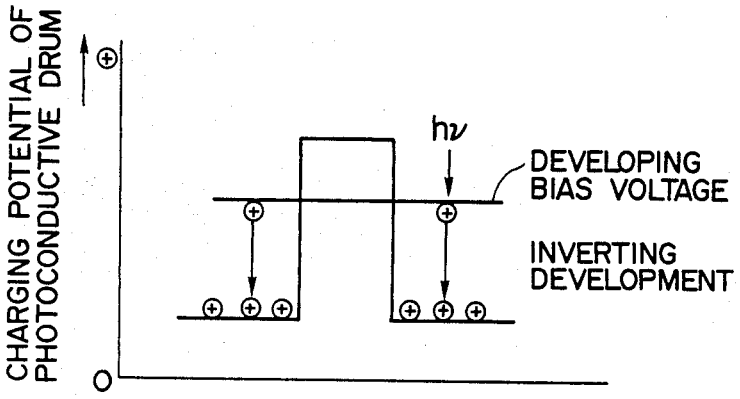

A case will be described with reference to FIGS. 57A and 57B wherein development is performed for an original having a positive image.

More specifically, when positive-positive normal development is performed, drum 36 is positively charged to +700 V, the developing bias voltage is set to be 200 V and the transfer voltage is set to be +4.5 kV. Then, development is performed using negatively charging toner ⊖ in first developer $\mathbf{500_1}$ (see FIG. 57A). When positive-negative inverting development is performed, drum 36 is positively charged to +700 V, the developing bias voltage is set to be +400 V and the transfer voltage is set to be −4.3 kV. Then, development is performed using positively charging toner ⊕ in second developer $\mathbf{500_2}$ (see FIG. 57B).

First and second developers $\mathbf{500_1}$ and $\mathbf{500_2}$ are coupled to first and second link mechanisms $\mathbf{508_1}$ and $\mathbf{508_2}$, respectively, as shown in FIG. 56. Upon movement of first and second link mechanisms $\mathbf{508_1}$ and $\mathbf{508_2}$, first and second developers $\mathbf{500_1}$ and $\mathbf{500_2}$ are moved toward or away from photoconductive drum 36. First link mechanism $\mathbf{508_1}$ is moved to the right or left in FIG. 56 by cam portion 512 of moving cam 510. Similarly, second link mechanism $\mathbf{508_2}$ is moved to the right or left in FIG. 56 by cam portion 514 of moving cam 510. Developer moving cam 510 is rotated by a motor (not shown), and is operated under the control of main processor 80.

Figure 58:
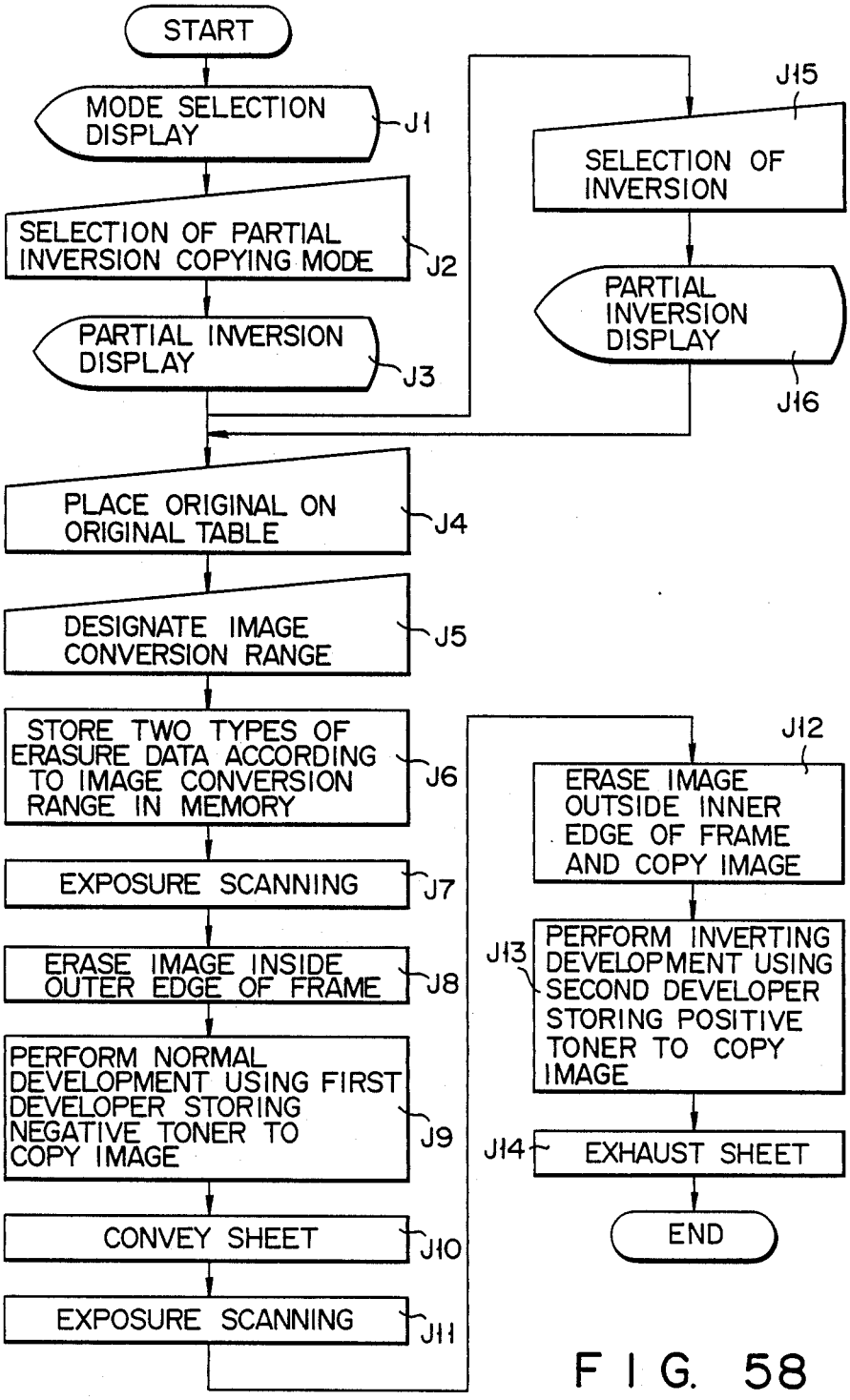
FIG. 58 is a flow chart for explaining a copying operation of an original according to the tenth embodiment.

The copying operation according to the tenth embodiment will be described with reference to the flow chart shown in FIG. 58. In the flow chart of FIG. 58, steps J1 to J8, steps J15 and J16 are the same as steps H1 to H8, steps H15 and H16 in the flow chart (FIG. 50) of the eighth embodiment, and a description thereof will be omitted.

After the erasure operation of step J8, the motor (not shown) is rotated under the control of main processor 80, so that first link mechanism $\mathbf{508_1}$ is moved (to the left in FIG. 56) upon operation of cam portion 512 of cam 510. Thus, first developer $\mathbf{500_1}$ for the normal development is brought into contact with drum 36, and is set in a development state. At the same time, switching circuit 144 and the like are controlled in accordance with the normal development signal from main processor 80, so that a voltage of +4.5 kV is applied to transfer charger 54, and a developing bias voltage in the normal development mode of +200 V is applied to developing sleeve $\mathbf{502_1}$ (step J9).

Therefore, a positive image (the same image polarity as the original) of a portion of original $O_1$ other than the range surrounded by outer edge Wb of frame W is formed on the surface of drum 36 by negative toner. In synchronism with this operation, paper sheet $P_1$ is fed to the transfer section by register roller pair 50, and an image of the portion other than the range surrounded by outer edge Wb of frame W is transferred to sheet $P_1$. When the image is developed and transferred, a positive image (the same image polarity as the original) of only a portion other than the range surrounded by outer edge Wb of frame W is transferred onto paper sheet $P_1$, as shown in FIG. 53B. Thereafter, sheet $P_1$ is fed again to the transfer section by multiple copying unit 78 (step J10).

A copying operation of a polarity changing portion of original $O_1$ is then performed using developer $\mathbf{500_2}$ storing positive and negative toners and erasure array 110. More specifically, first carriage 302 is moved to perform exposure scanning of original $O_1$ (step J11).

With this operation, erasure data of a positive portion shown in FIG. 11B is supplied from memory 106 to array driver 108, and erasure array 110 is operated in accordance with the erasure data, thereby removing a charge of a portion outside inner edge Wa of frame W from drum 36 (step J12). After the erasure operation, the motor (not shown) is rotated under the control of main processor 80, so that second link mechanism $\mathbf{508_2}$ is moved (to the left in FIG. 56) upon operation of cam portion 514 of cam 510. Thus, second developer $\mathbf{500_2}$ for the inverting development is brought into contact with drum 36, and is set in the developing state. At the same time, first link mechanism 5081 is moved (to the right in FIG. 56), so that first developer $\mathbf{500_1}$ is moved away from drum 36. In this case, switching circuit 144 and the like are controlled in accordance with the inverting development signal from main processor 80, so that a voltage of −4.3 kV is applied to transfer charger 54, and a developing bias voltage of +400 V in the inverting developing mode is applied to sleeve $\mathbf{502_2}$ (step J13).

Therefore, a negative image (inverted image polarity to the original) of a portion of original $O_1$ corresponding to a range surrounded by inner edge Wa of frame W is formed on the surface of photoconductive drum 36 by positive toner. In synchronism with this operation, paper sheet $P_1$ fed to the transfer section by multiple copying unit 78 is fed, and an image of the portion of the range surrounded by inner edge Wa of frame W is transferred to paper sheet $P_1$ As shown in FIG. 53B, a positive image (the same image polarity as the original) of a portion other than the range surrounded by outer edge Wb of frame W of original $O_1$, and a negative image (inverted image polarity to the original) of a portion of the range surrounded by inner edge Wa of frame W are formed on paper sheet $P_1$. Paper sheet $P_1$ is then exhausted to exhaust tray 70 via exhaust roller pair 68 (step J14).

When an image polarity of a portion of an original is changed, i.e., when a predetermined portion of an original is copied in the negative image polarity and the other portion is copied in the positive image polarity, the first copying operation is performed using one developer storing negatively charging toner after a portion inside a designated range is erased, and the second copying operation is performed using the other developer storing positively charging toner after a portion outside the designated range is erased. Therefore, a portion of an original can be copied in the negative image polarity, and the other portion can be copied in the positive image polarity.

According to the present invention, image formation can be performed while changing image properties of a portion of an original image to be different from those of the other portion, and an image property changing range can be easily designated.

What is claimed is:

1. An image forming apparatus comprising:

image forming means for forming an image using a first image property or a second image property;

selecting means for selecting either the first image property or the second image property;

designation means for designating a range in which said image forming means is to reproduce a partial image, which is located within the designated range, using the image property selected by the selecting means;

tone changing means for changing a property of the image reproduced from the original in the designated range by varying a surface potential of an image carrier of said image forming means; and control means for controlling the image forming operation of said image forming means based on the image property selected by the selecting means and the range designated by said designation means.

2. An apparatus according to claim 1, wherein said designation means is a spot light source.

3. An apparatus according to claim 1, wherein said tone changing means changes the tone of the image reproduced from the designated range by changing the rotational speed of a rotatable developing sleeve provided in developing means of said image forming means.

4. A apparatus according to claim 1, wherein said tone changing means changes the tone of the image reproduced from the designated range by varying the frequency of an AC bias voltage applied to the developing means of said image forming means.

5. An apparatus according to claim 1, wherein said changing means comprises polarity changing means for changing the polarity of the image reproduced from an original.

6. An apparatus according to claim 5, wherein the polarity changed by said polarity changing means is a positive or negative image.

7. An apparatus according to claim 6, wherein an image carrier of said image forming means employs a bipolar photoconductive body, and said polarity body changing means changes a charging voltage of said bipolar photoconductive body and a developing bias voltage of developing means of said image forming means, thereby changing the polarity of the image reproduced within the designated range.

8. An apparatus according to claim 6, wherein said property changing means includes:

a developing means which uses a developing agent containing as first agent having a positive charging property and a second agent having a negative charging property, and which forms, on said recording medium, an image reproduced form the original image, from which a part within said designated range has been erased by erasure means, by applying a transfer voltage of the same polarity as that of an image carrier of said image forming means onto the recording medium by using one of said agents contained in said developing agent, and simultaneously forms, on said recording medium, an image corresponding to the erased part of the image reproduced from the original image, by applying a transfer voltage of the polarity opposite to that of an image carrier of said image forming means onto the recording medium by using the other agent contained in said developing agent, whereby the polarity of said part of the images is changed.

9. An apparatus according to claim 6, wherein said image forming means having a developing means comprises first developer means for performing normal development and second developer means for performing inverting development, and said polarity changing means changes the polarity of the image corresponding to the designated range such that an image reproduced from the original image, from which an image inside the designated range is erased by erasure means, is formed on the recording medium in one polarity using said first developer means, and an image corresponding to that part of the image reproduced from the original image which has been erased by said erasure means is formed on the recording medium in the other polarity using said second developer means.

10. An electronic copying apparatus having a function of partially changing the tone of an image reproduced from an original image, said apparatus comprising:

an original table on which the original is placed;

designation means for designating a predetermined range for partially changing the tone of the image reproduced form the original placed on said original table;

image forming means for focusing and developing an optical image obtained by optically scanning the original placed on said original table so as to form an image;

transfer means for transferring the image formed by said image forming means to a recording medium;

changing means for changing the tone of the image corresponding to the predetermined range of the original designated by said designation means;

wherein said changing means changes the tone of the formation image corresponding to the predetermined range of the original such that an image inside or outside the predetermined range of the original is optically discharged using a discharging element whose discharging light amount is controlled by a liquid crystal element; and control means for performing a control operation such that an image inside the predetermined range designated by said designation means is formed on the recording medium in one tone determined by said changing means, and an image outside the predetermined range is formed on said recording medium in the other tone determined by said changing means.

11. An apparatus according to claim 10, wherein said liquid crystal element is provided between an image carrier of said image forming means and said discharging element.

12. An apparatus according to claim 11, wherein said liquid crystal element and said discharging element comprise a linear array of light emitting elements.

13. An apparatus according to claim 10, wherein said changing means changes the tone of the formation image corresponding to the predetermined range of the original by changing a position of a developing main pole in a developing sleeve provided in developing means of said image forming means.

14. An apparatus according to claim 10, wherein said changing means changes the tone of the formation image corresponding to the predetermined range of the original by substantially changing a distance between a developing sleeve provided in developing means of said image forming means and an image carrier of said image forming means.

15. An apparatus according to claim 10, wherein said image forming means having a developing means has a rotatable developing sleeve for conveying a developing agent, the developing agent being frictionally charged by a plurality of divided blade members axially disposed on said developing sleeve so as to be supplied to an image carrier of said image forming means, and said changing means changes the tone of an image corresponding to the predetermined range of the original by selectively applying a voltage to said divided blade members from voltage application means in accordance with a position of the image corresponding to the predetermined range of the original.

* * * * *